United States Patent [19]

Minamitaka

[11] Patent Number: 4,951,544

[45] Date of Patent: Aug. 28, 1990

[54] APPARATUS FOR PRODUCING A CHORD PROGRESSION AVAILABLE FOR A MELODY

[75] Inventor: Junichi Minamitaka, Tokyo, Japan

[73] Assignee: Cadio Computer Co., Ltd., Tokyo, Japan

[21] Appl. No.: 335,213

[22] Filed: Apr. 6, 1989

[30] Foreign Application Priority Data

Apr. 6, 1988 [JP] Japan ..... 63-82884
Apr. 6, 1988 [JP] Japan ..... 63-82885
May 25, 1988 [JP] Japan ..... 63-125930

[51] Int. Cl.[5] ..... G10H 1/38
[52] U.S. Cl. ..... 84/613; 84/637
[58] Field of Search ..... 84/613, 650, 637, 669, 84/715

[56] References Cited

U.S. PATENT DOCUMENTS 4,539,882 9/1985 Yuzawa ..... 84/613 X

FOREIGN PATENT DOCUMENTS 58-87593 5/1983 Japan .

*Primary Examiner*—W. B. Perkey

*Attorney, Agent, or Firm*—Frishauf, Holtz, Goodman & Woodward

[57] ABSTRACT

A melody harmonization apparatus is disclosed which can determine and produce available chords as many as there are for each segment (e.g., bar) of a given melody. In determining available chords, the apparatus does not need excessive constraints or merely hypothesized assumptions with respect to a melody under analysis such as no change of key throughout the melody and particular tonal musical effect or function of last melody notes. In an embodiment, a set of chord candidates are scanned. Each chord candidate is tentatively assumed available for a melody segment of interest. Then melody tones in that melody segment are analyzed and identified in a forward reasoning by exploring a network of musical knowledge of classifying melody tone functions or characters based on the tentative assumption while checking local melodic waves or movements. The reasoning continues either until a contradiction or counterexample of the tentative assumption is found or until a verification or justification of the assumption has been made as the case may be. Thus the associated chord candidate is determined available in the latter case and inavailable in the former case.

62 Claims, 40 Drawing Sheets

<MELODY NOTE>

PITCH-----REPRESENTED BY 16-BIT DATA
LOWEST 8 BITS = VERTICAL POSITION OF NOTE IN OCTAVE

HIGHEST 8 BITS = OCTAVE NUMBER OF NOTE

DURATION ----- REPRESENTED BY INTEGRAL RATIO TO UNIT LENGTH

<CHORD>

LOWEST 8BITS = ROOT
0:C,1:C#,2:D,3:E♭,4:E,5:F,6:F#
7:G,8:A♭,9:B♭,10:B♭,11:B

HIGHEST 8 BITS = TYPE
0:maj 1:min 2:dim 3:aug 4:sus4 5:7th
6:m7th 7:m6th 8:6th 9:M7th

*DURATION OF CHORD---SAME FORMAT AS MELODY NOTE DURATION

| ADDRESS (NOTE NO) | <MELODY> DATA(HEX) | DESCRIPTION |
|---|---|---|
| 0(1) | 406 | PITCH OF NOTE1=F#4 |
| | 4 | DURATION OF NOTE1= ♩ |
| 2(2) | 406 | |
| | 4 | |
| 4(3) | 407 | |
| | 4 | |
| 6(4) | 409 | |
| | 4 | |
| 8(5) | 409 | |
| | 4 | |
| 10(6) | 407 | |
| | 4 | |
| 12(7) | 406 | |
| | 4 | |
| 14(8) | 404 | |
| | 4 | |
| 16(9) | 402 | |
| | 4 | |
| 18(10) | 402 | |
| | 4 | |
| 20(11) | 404 | |
| | 4 | |
| 22(12) | 406 | |
| | 4 | |
| 24(13) | 406 | |
| | 4 | |
| 26(14) | 404 | |
| | 4 | |
| 28(15) | 404 | |
| | 8 | |

PRODUCTION RULE DATA
| | L | X | U | Y | N |
|---|---|---|---|---|---|
| no.1: | 0 | 1 | 0 | 2 | 3 |
| no.2: | -2 | 2 | 2 | -2 | -101(III) |
| no.3: | -2 | 2 | 2 | 4 | 5 |
| no.4: | -2 | 3 | 2 | -1 | -3 |
| no.5: | -2 | 3 | 2 | -4 | -101(III) |
FIG. 9(a)
FIG.9(b)
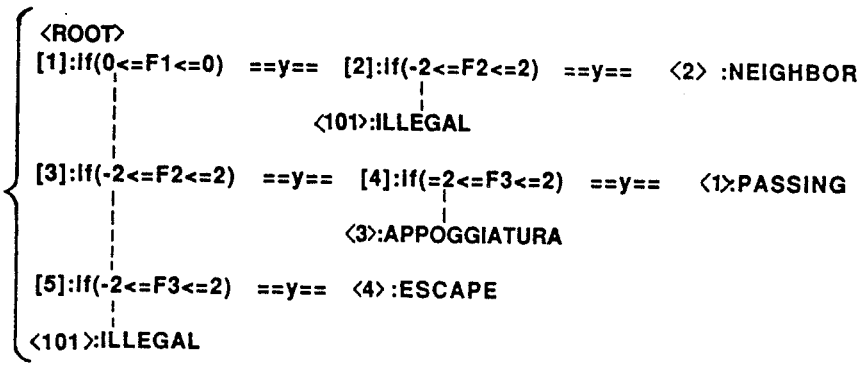
FIG.9(c)
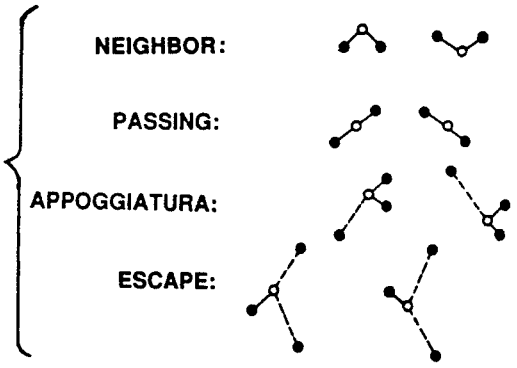

< CHORDS >

| ADDRESS | DATA (HEX) | DESCRIPTION |
|---|---|---|
| 0 | 0 | Cmaj |
| 1 | 1 | $C^{\#}$ maj |
| 2 | 2 | ⋮ |
| 3 | 3 | |
| ⋮ | | |
| 10 | $(a)_{16}$ | $B^{b}$ maj |
| 11 | $(b)_{16}$ | Bmaj |
| 12 | $(100)_{16}$ | Cmin |
| 13 | $(101)_{16}$ | $C^{\#}$min |
| ⋮ | ⋮ | ⋮ |
| 23 | $(10b)_{16}$ | Bmin |
| ⋮ | ⋮ | ⋮ |

(EXAMPLE)
CHORD ; Cmaj $F_1 = 1$
$F_2 = -1$
$F_3 = 1$
$F_4 = 0404-0400 = 4$
$F_5 = 2$
$F_6 = 1$
$F_7 = 0404-0402 = 2$
$F_8 = 0402-0400 = 2$

*-*

| | | | | | | | | |
|---|---|---|---|---|---|---|---|---|
| HARMONIC TONE 1 | * | | * | | * | | | * |
| HARMONIC TONE 2 | | * | * | | | | * | * |
| | | | | | * | * | * | * |
| $F_5$ | 0 | 1 | 2 | 3 | 4 | 5 | 6 | 7 |

<CHOij>

| | | | | | | | | | | | | | |
|---|---|---|---|---|---|---|---|---|---|---|---|---|---|
| BAR #1 | (MATCHING) | | | | | | | | | | | | |
| | 0 | 0 | 1 | 0 | 0 | 0 | 0 | 0 | 0 | 0 | 0 | 0 | (MAJOR) |
| | 0 | 0 | 0 | 0 | 0 | 0 | 1 | 0 | 0 | 0 | 0 | 0 | (MINOR) |
| | C | | D | | E | F | | G | | A | | B | |
| | (NONHARMONIC ANALYSIS) | | | | | | | | | | | | |
| | 0 | 0 | 1 | 0 | 0 | 0 | 0 | 0 | 0 | 0 | 0 | 0 | |
| | 0 | 0 | 0 | 0 | 0 | 0 | 1 | 0 | 0 | 0 | 0 | 0 | |
| | (SCALE ANALYSIS) | | | | | | | | | | | | |
| | 0 | 0 | 1 | 0 | 0 | 0 | 0 | 0 | 0 | 0 | 0 | 0 | |
| | 0 | 0 | 0 | 0 | 0 | 0 | 1 | 0 | 0 | 0 | 0 | 0 | |
| BAR #2 | (MATCHING) | | | | | | | | | | | | |
| | 1 | 0 | 1 | 0 | 0 | 0 | 0 | 0 | 0 | 1 | 0 | 0 | |
| | 0 | 0 | 0 | 0 | 1 | 0 | 1 | 0 | 0 | 1 | 0 | 0 | |
| | (NONHARMONIC ANALYSIS) | | | | | | | | | | | | |
| | 1 | 0 | 1 | 0 | 0 | 0 | 0 | 0 | 0 | 1 | 0 | 0 | |
| | 0 | 0 | 0 | 0 | 1 | 0 | 1 | 0 | 0 | 1 | 0 | 0 | |
| | (SCALE ANALYSIS) | | | | | | | | | | | | |
| | 1 | 0 | 1 | 0 | 0 | 0 | 0 | 0 | 0 | 1 | 0 | 0 | |
| | 0 | 0 | 0 | 0 | 1 | 0 | 1 | 0 | 0 | 1 | 0 | 0 | |
| BAR #3 | (MATCHING) | | | | | | | | | | | | |
| | 0 | 0 | 1 | 0 | 0 | 0 | 0 | 0 | 0 | 0 | 0 | 0 | |
| | 0 | 0 | 0 | 0 | 0 | 0 | 0 | 0 | 0 | 0 | 0 | 1 | |
| | (NONHARMONIC ANALYSIS) | | | | | | | | | | | | |
| | 0 | 0 | 1 | 0 | 0 | 0 | 0 | 0 | 0 | 0 | 0 | 0 | |
| | 0 | 0 | 0 | 0 | 0 | 0 | 0 | 0 | 0 | 0 | 0 | 1 | |
| | (SCALE ANALYSIS) | | | | | | | | | | | | |
| | 0 | 0 | 1 | 0 | 0 | 0 | 0 | 0 | 0 | 0 | 0 | 0 | |
| | 0 | 0 | 0 | 0 | 0 | 0 | 0 | 0 | 0 | 0 | 0 | 1 | |
| BAR #4 | (MATCHING) | | | | | | | | | | | | |
| | 1 | 0 | 1 | 0 | 1 | 0 | 1 | 0 | 0 | 1 | 0 | 1 | |
| | 0 | 1 | 0 | 1 | 1 | 0 | 1 | 0 | 0 | 1 | 0 | 1 | |
| | (NONHARMONIC ANALYSIS) | | | | | | | | | | | | |
| | 1 | 0 | 1 | 0 | 1 | 0 | 1 | 0 | 0 | 1 | 0 | 1 | |
| | 0 | 1 | 0 | 1 | 1 | 0 | 1 | 0 | 0 | 1 | 0 | 1 | |
| | (SCALE ANALYSIS) | | | | | | | | | | | | |
| | 1 | 0 | 1 | 0 | 1 | 0 | 1 | 0 | 0 | 1 | 0 | 1 | |
| | 0 | 1 | 0 | 1 | 1 | 0 | 1 | 0 | 0 | 1 | 0 | 1 | |

FIG. 34

<MELODY (2)>

400
2
405
2
407
2
408
2
400
8

BAR # 1

(MATCHING)

| | | | | | | | | | | | | |
|---|---|---|---|---|---|---|---|---|---|---|---|---|
| 1 | 1 | 0 | 0 | 0 | 1 | 0 | 0 | 1 | 0 | 0 | 0 | (MAJOR) |
| 1 | 0 | 0 | 0 | 0 | 1 | 0 | 0 | 0 | 0 | 0 | 0 | (MINOR) |
| C | | D | | E | F | | G | | A | | B | |

(NONHARMONIC ANALYSIS)

| | | | | | | | | | | | |
|---|---|---|---|---|---|---|---|---|---|---|---|
| 1 | 0 | 0 | 0 | 0 | 1 | 0 | 0 | 1 | 0 | 0 | 0 |
| 1 | 0 | 0 | 0 | 0 | 1 | 0 | 0 | 0 | 0 | 0 | 0 |

(SCALE ANALYSIS)

| | | | | | | | | | | | |
|---|---|---|---|---|---|---|---|---|---|---|---|
| 0 | 0 | 0 | 0 | 0 | 0 | 0 | 0 | 1 | 0 | 0 | 0 |
| 1 | 0 | 0 | 0 | 0 | 1 | 0 | 0 | 0 | 0 | 0 | 0 |

APPARATUS FOR PRODUCING A CHORD PROGRESSION AVAILABLE FOR A MELODY

FIELD OF THE INVENTION

The present invention relates to music analyzer systems and more particularly to a melody harmonization apparatus for determining and producing chords available for a given melody.

BACKGROUND OF THE INVENTION

Apparatus for providing a progression or succession of chords available for a given melody were known. Such apparatus have been built in electronic music instruments.

Japanese patent application laid open to public as Sho No. 58-87593 discloses an apparatus of this kind which comprises the following means in order to determine chords for a melody:

(a) first implicit means assumes that a given melody always has a single key;

(b) second implicit means assumes that a given melody always ends on a resolution point such as a tonic or key;

(c) key determining means, which is operable based on the above assumptions, determines a key of the given melody, the determined key being represented by a pitch or pitch class (e.g., A, B, C) indicative of a tonic or key note and a mode (either major or minor);

(d) chord generator means generates seven diatonic chords from the determined key because third implicit means assumes that a given melody is always a diatonic melody which implies diatonic chords;

(e.g., for C major key, seven diatonic chords are triads of C major, D minor, E minor, F major, C major, A minor and B diminished);

(e) for each bar of the given melody, matching means evaluates a degree of matching between pitch or pitch class content of each of the seven diatonic chords and that of a melody bar of interest; and (e.g., for a diatonic chord of triad C major, the pitch content thereof is given by C, E and G);

(f) a chord transition table stores fixed transition probabilities (weights) each from one diatonic to the next diatonic chord;

(g) for each of the seven diatonic chords, multiplication means multiplies a degree of matching (evaluated by the matching means) by a corresponding weight (supplied from the transition table) to obtain a product;

(h) for each bar of the melody, selecting means selects one of the seven diatonic chords from the chord generator means with respect to a bar of interest such that the selected diatonic chord has the maximum product among those seven diatonic chords.

Another prior art apparatus for producing a chord succession available for a given melody is disclosed in U.S. Pat. No. 4,539,882. This apparatus comprises the following means:

(a) first implicit means assumes that a given melody has always a single key;

(b) second implicit means assumes that a given melody always ends on a resolution point such that the pitch of the last melody note must be a member of a tonic chord;

(c) under the above assumptions, key determining means determines a key specific to the given melody;

(d) third implicit means assumes that a given melody always starts with a tonic tone or a member of a tonic chords;

(e) for each bar of the presently given melody, important or conspicuous tone evaluation means evaluates one or more important melody tones contained in a bar of interest;

(f) using the third assumption, the important tone(s) and the detemined key, a chord is selected for the first bar of the currently given melody;

(g) table means is provided which returns a selected chord for a current bar in response to the selected chord for the preceding bar and important melody tone(s) in the current bar; and (h) for each successive bar of the given melody, table access means references the table means using the selected chord for the preceding bar and the evaluated important melody tone or tones in the current bar whereby a chord is selected or determined per bar.

As noted, either of the prior art apparatus implicity takes several assumptions or constraints on a melody to be analized. One constraint requires that a melody for analysis must be relatively long, ending with a predetermined point (resolution point). Another requires no change of key (modulation) in the course of a melody under analysis. Third requires that only particular family of chords such as diatonic chords are assumed for a melody for analysis. Although a melody in general can suggest more than one harmonic interpretations, because of the nature of music, either prior art apparatus only provides a single succession or progression of chords for a melody. Further, none of the prior art apparatus contemplates a temporal order, series, succession or stream of melody notes in a melodY in bar. It is a characteristic of the nature of music that with a first melody suggesting a set of chords, a second melody, which has the same or similar pitch content of the first melody but a different order, succession of melody notes from the second (i.e., the first melody wave is different from the second), can suggest a different set of chords.

The present invention is provided to overcome these problems.

SUMMARY OF THE INVENTION

In accordance with an illustrative aspect of the present invention, there is provided an apparatus for selectively producing an available chord for a melody, which comprises knowledge storage means for storing a musical knowledge of classifying nonharmonic tones in a melody in accordance with an analyzed stream of that melody and an available chord for the melody, melody supply means for supplying a melody, chord candidate supply means for supplying a chord candidate, execution means for executing classification of all nonharmonic tones in the melody from the melody supply means by applying the musical knowledge to an analyzed stream of the melody from the melody supply means based on the assumption that the chord candidate is available for the melody from the melody supply means, and determination means for determining from the classification provided by the execution means as to whether the chord candidate is available for the melody from the melody supply means, thereby to selectivley produce an available chord for the melody.

This arrangement is in contrast with the prior art as mentioned in the section of "background of the invention" in that the present apparatus contemplates a "stream" of a melody to be analyzed, instead of a "set" of the melody tones forming the melody to be analyzed or those melody parameters which do not change even if a temporal or horizontal order, series or stream of the melody does change. With a suitable musical knowledge stored in the knowledge storage means, it is possible to provide a different classification of individual melody tones or notes depending on their sequence, order or stream. For example, "re" may be classified (identified) as a melodic nonharmonic passing tone when it appears in a melody such as "do", "re", "mi" asssuming a chord of say C major for this melody. When "re" appears in a melody such as "do", "re", "do", the "re" may be classified as a melodic nonharmonic neighbor tone.

Another feature of the apparatus is that, when a chord candidate is supplied, the apparatus tentatively or initially assumes that candidatate as being available for a melody in question, then classifies nonharmonic tones contained in the melody in question by applying the stored musical knowledge thereto based on the assumption, and determines the validity of the assumption from the results of the classification. If the assumption is correct, a chord candidate assumed is reasoned available for the melody in question, otherwise unavailable therefor. In this respect, the apparatus can be said to be an expert system of AI (Artifical Intelligence) designed for harmonization of a given melody. Using AI terminology, the execution means, which is cooperative with other elements such as knowledge storage means and the determination means can be called a "reasoning", "inference" or "deduction" device or system.

The combination of the knowledge storage means, execution means and determination means serves to test a chord candidate for it availability for a melody of interest, starting with the assumption of the chord candidate, exploring through the stored knowledge using the assumption and an analized stream of the melody of interest (an instanciation or example of a melody) either until a verification or justification of the assumption is made or found or until a contradiction or counterexample of the assumption is encountered as the case may be.

Further, with this arrangement, the chord candidate supplied from the chord supply means can be virtually any chord. Moreover, the melody supply means can supply virtually any melody, not restrictive as in the prior art apparatus which generally request that the melody under analysis must be relatively long, must have a single key i.e., no change of key (modulation) in the course of melody, must end with a predetermined cadence or a resolution point indicative of that single key and so on. For example, the apparatus of the invention as mentioned above can determine availability/inavailability of a chord candidate for a melody which is as short as a single measure or bar.

Further, it should be noted that the arrangement such as discussed above (as well as a scale-melody analyzer arrangement which will be described later) is readily extendable in several ways. A first extension is associated with a number of chords which a chord candidate supply means supplies. By increasing the number of chord candidates supplied, a number of available chords will generally increase, though depending on a melody under analysis. According to this approach, there may be provided an apparatus for producing available chords as many as there are for a melody which comprises knowledge storage means for storing a musical knowledge of classifying nonharmonic tones contained in a melody in accordance with a stream of tones forming that melody and an available chord for that melody, melody supply means for supplying a melody, chord candidate supply means for supplying a plurality of different chord candidates, execution means for executing, with respect to each chord candidate of the plurality of chord candidates from the chord candidate supply means, classification of all nonharmonic tones in the melody from the melody supply means by applying the musical knowledge to a stream of tones forming the melody from the melody supply means based on the assumption that each chord candidate is available for the melody from the melody supply means, and determination means for determining from the classification by the execution means with respect to each chord candidate, as to what chord candidates are available for the melody from the melody supply means thereby to produce available chords as many as there are for the melody. For example, the above chord candidate supply may supply 24 or more chord candidates, or 84 or more chord candidates, or even more. Such a chord candidate supply may be conveniently implemented by an automatic chord generator which scans a set of chords which may be stored in a chord table or memory. The chord table may be either a permanent memory such as ROM (read only memory) or a read-write memory (RWM or RAM) data of which can be made, changed, added, modified or corrected by a user via a suitable input unit. In a version, a user may designate a set of chords by family names for example, which set is a subset of all chords stored in a chord memory.

A second extension of the first-mentioned apparatus is directed to the length of a melody for which available chords will be determined and produced. Longer melodies are generally dividable into a plurality of segments each having a musical time duration during which a chord or harmony can last without change thereof. For each segmented melody, a chord candidate (which can be different depending on a segmented melody of interest) is supplied and tested for its availability for the segmented melody of interest whereby an available chord is selectively produced with respect to each segmented melody.

A third extension is a combination of the first and second extensions above. In this case, available chords as many as possible can be determined and produced for each segment of a melody. All available chords found in the apparatus may be stored in a two-dimensional array made in a memory. The first dimension of the array corresponds to the length of the entire melody or the number of the segmented melodies while the second dimension of the array with repect to a particular melody segment indicates the number of available chords found in that particular melody segment.

It will be understood that the above-mentioned execution means cooperative with the knowledge storage means has sufficient abilities of reasoning in connection with the availability test of chords but it generally consumes time in order to complete the reasoning, particularly when it is intended to provide available chords as many as possible for each segment of a long melody, although an absolute length of the total execution time may be much faster than in the case of a corresponding harmonic analysis by a human who happens to do such a job in an exhausive manner. A human typically takes a "heuristic" approach to get good or selected chord candidates which seem to be available and then, determines availabilities using musical knowledge of his or her own. For a human, exhausive approaches are tedious, painful sometimes.

In order to reduce the total execution time (and somewhat simulate a heuristic aspect of human intelligence) there is provided an apparatus for producing available chords as many as there are for a melody which comprises melody supply means for supplying a melody, chord candidate supply means for supplying a plurality of different chord candidates, preliminary chord test responsive to the chord candidate supply means and the melody supply means for passing a portion of the plurality of different chord candidates, the portion defining passed chord candidates, knowledge storage means for storing a musical knowledge of classifying nonharmonic tone contained in a melody in accordance with a stream of tones forming that melody and an available chord for that melody, execution means for executing, with respect ot each chord candidate of the passed chord candidates from the preliminary chord test means, classification of all nonharmonic tones in the melody from the melody supply means by applying the musical knowledge to a stream of tones forming the melody from the melody supply means based on the assumption that each chord candidate of the passed chord candidates is available for the melody from the melody supply means, and determination means for determining from the classification by the exeuction means with respect to each chord candidate of the passed chord candidates as to what chord candiates are available for the melody from the melody supply means thereby to produce available chords as many as there are for the melody.

Preferably, the preliminary chord test means is arranged to provide a considerable reduction in chord candidates without substantial loss or missing of available chords. In a version, the preliminary chord test means comprises means for deriving a pitch content of the melody from the melody supply means, pitch-matching means for matching each of the plurality of chord candidates from the chord candidate supply means against the pitch content of the melody and for passing those chord candiates each having a degree of matching higher than a preselected threshold level, whereby the preliminary chord test means not only serves to provide a substantial reduction in time required by the execution means for completing the executing for the passed chord candidates only instead of executing for all of the plurality of the chord candidates directly from the chord candidate supply means, but also holds that the determination means is unlikely to miss an available note even though the preliminary chord test means can reject a considerable portion of the plurality of the chord candidates supplied thereto.

In accordance with another aspect of the present invention, there is provided an apparatus for selectively producing an available chord for a melody which comprises melody supply means for supplying a melody, chord candidate supply means for supplying a chord candidate, scale generator means for generating at least one musical scale in accordance with the chord candidate, evaluator means for evaluating a relationship formed between each of the at least one musical scale from the scale generator means and the melody from the melody supply means, and determining means for determining from the relationship evaluated by the evaluator means as to whether the chord candidate is available for the melody from the melody supply means thereby to selectivley produce an available chord for the melody. In a version, each of the musical scale has a plurality of different scale degrees part of which includes all chord members of the chord candidate and the apparatus further comprising means responsive to the melody supply means for defining a pitch content of the melody and wherein the determining means determines the chord candidate to be available for the melody from the melody supply means when the relationship evaluated by the evaluator means indicates that the pitch content of the melody is a subset of the plurality of different degrees of the musical scale.

The scale generator may generate a plurality of musical scales which may be either fixed in number or variable in number according to a chord candidate supplied. In a fixed number version, the scale generator may produce three scales each having a plurality of scale degrees containing, as a part, tonic, dominant and subdominant, the first of the three scales having the tonic which corresponds to a root of the chord candidate, the second of the three scales having the dominant which corresponds to the root of the chord candidate, the third of the three scales having the subdominant which corresponds to the root of the chord candidate, the apparatus further comprising means responsive to the melody supply means for defining a pitch content of the melody and wherein the evaluator means comprises means for matching the pitch content of the melody against a pitch content of the plurality of the scale degrees with respect to each of the three scales.

The determining means may determines the chord candidate to be available for the melody from the melody supply means when the relationship evaluated by the evaluator means indicates that the pitch content of the melody is a subset of the plurality (e.g., three) of different degrees with respect to one of the plurality of the musical scales.

It is understood that a combination of the scale generator means, the evaluator means and determining means functions to test a supplied chord candidate for its availability for a given melody. Such combination may be called a scale-melody analyzer while the first-mentined combination of the knowledge storage means, the execution means and the determination means can be regarded as a stream-melody analyzer or a nonharmonic-melody analyzer. Using these terms, a combination of a scale-melody analyzer and a stream-melody analyzer can be readity provided which tests chord candidates for their availabilities for a given melody. In a series arrangement, one of the scale-melody analyzer and the stream-melody analyzer is positioned upstream and passes available chords found by itself as chord candidates to an downstream positioned analyzer, the other of the two analyzers. Typically, the two analyzer are implemented on a computer which typically performs processes in a series manner according to a program built therein. In a parallel arrangement, result (available chords) from both the scale-melody analyzer and the stream-melody analyzer are ANDed to provide systematically available chords. In recent years, there has been developed or being developed a variety of parallelism or concurrent processing in the art of computers. Any suitable computer architectures for parallel processing may be applied and designed to implement the parallel arrangement discussed above. With extended versions of apparatus as described earlier and which produce available chords as many as possible for each segment of a melody, many user may find it fun to search for a succession of chords or a small number of successions which are felt or thought best suited for the entire melody, according to their tastes, intentions or musical concepts. However, those who have an insufficient experience or musical knowledge may wish to obtain a machine-made or AI-made single chord progression or succession, or to get a number of but well-sorted chord successions in accordance with suitable chord selection or priority criteria.

A third aspect of the invention is directed to selection of chords. In accordance with an embodiment of the invention in this aspect, there is provided an apparatus for producing a succession of chords for a melody which comprises melody supply means for supplying a melody which is dividable into a plurality of melody segments each having a duration during which a chord can last without change thereof, available chord means for determining and supplying available chords as many as there are for each melody segment of the melody respectively corresponding to (a different) one of the plurality of melody segments, contraint supply means for supplying at least one tonal constraint, distance measuirng means for measuring, with respect to each melody segment of the meldoy, tonal distances respectively assigned to one of the available chords for a melody segment which is (a respective) one of the plurality of melody segments, deviation evaluating means for evaluating, with respect to each melody segment of the melody, tonal deviations respectively assigned to (a different) one of the available chords for a melody segment which is (a respective) one of the plurality of melody segments, each deviation being a function of a tonal distance measured by the distance mesuring means and assigned to one of the available chords, and the at least one tonal constraint from the constraint supply means, and chord selecting means for selecting, with respect to each melody segment of the melody, a chord such that the selected chord has been assigned the least tonal deviation among the available chords including the selected chord for a melody segment which is (a different) one of the plurality of melody segments whereby a single chord is selected per melody segment so that a succession of chords will be produced for the melody from the melody supply means.

The combination of above deviation evaluating means and the chord selection means may be regarded as a chord selection criteria means.

A version of the constraint supply means may comprises first contraint supply means for supplying a first tonal constraint, and seocnd constraint supply means for supplying a second tonal constraint. Correspondingly, the distance measuring means may comprise first distance measuring means for measuring, with respect to each melody segment of the melody, first tonal distances respectively assigned to one of the available chords for a melody segment which is one of the plurality of melody segments, and second distance measuring means for measuring, with respect to each melody segment of the melody, second tonal distances respectively assigned to one of the avialable chords for a melody segment which is one of the plurality of melody segments. The above first distance mesuring means may comprise global reference means for evaluating a relatively high-leveled tonal reference indicative of a relatively high-leveled tonal function of a melody supplied from the melody supply means and global distance measuring means for measuring, with respect to each melody segment of the melody, the first tonal distances respectively asigned to one of the available chords for a melody segment in question, each of the first tonal distances with respect to the melody segment in question being defined by a distance of one of the available chords for the melody segment in question from the relatively high-leveled tonal reference, while the second distance mesuring means may comprise local reference means for providing a relatively low-leveled tonal reference indicative a relatively low-leveled tonal function of the melody from the melody supply means and local distance mesuring means for measuring, with respect to each melody segment of the melody, the second tonal distance respectively assigned to one of the available chords for the melody segment in question, each of the second tonal distances with respect to the melody segment in question being defined by a distance of one of the available chords for the melody segment in question from the relatively low-leveled tonal referene which is locally associated with the melody segment in question.

BRIEF DESCRIPTION OF THE DRAWINGS

The above and other objects, features and advantages of the present invention will be more apparent from the following description taken in conjunction with the accompanying drawing in which:

FIGS. 9(*a*), 9(*b*), and 9(*c*) illustrate data of production rules representative of musical knowledge of classifying nonharmonic tones, also showing a network of the production rules and symbolic representations of several nonharmonic tones;

FIG. 34 illustrates results of chordal or harmonic analysis of a melody material, here, "Ode to Joy" from Beethoven's Ninth Symphony shown in FIG. 7, as derived from successive tests of matching between melody and chord notes, nonharmonic analytic or categoric reasoning and scale-testing;

DETAILED DESCRIPTION

Basic arrangements for producing or determining available chords for a given melody in accordance with novel aspects of the invention will first be discussed, and thereafter, a more specific embodiment thereof will be taken up.

Figure 1:
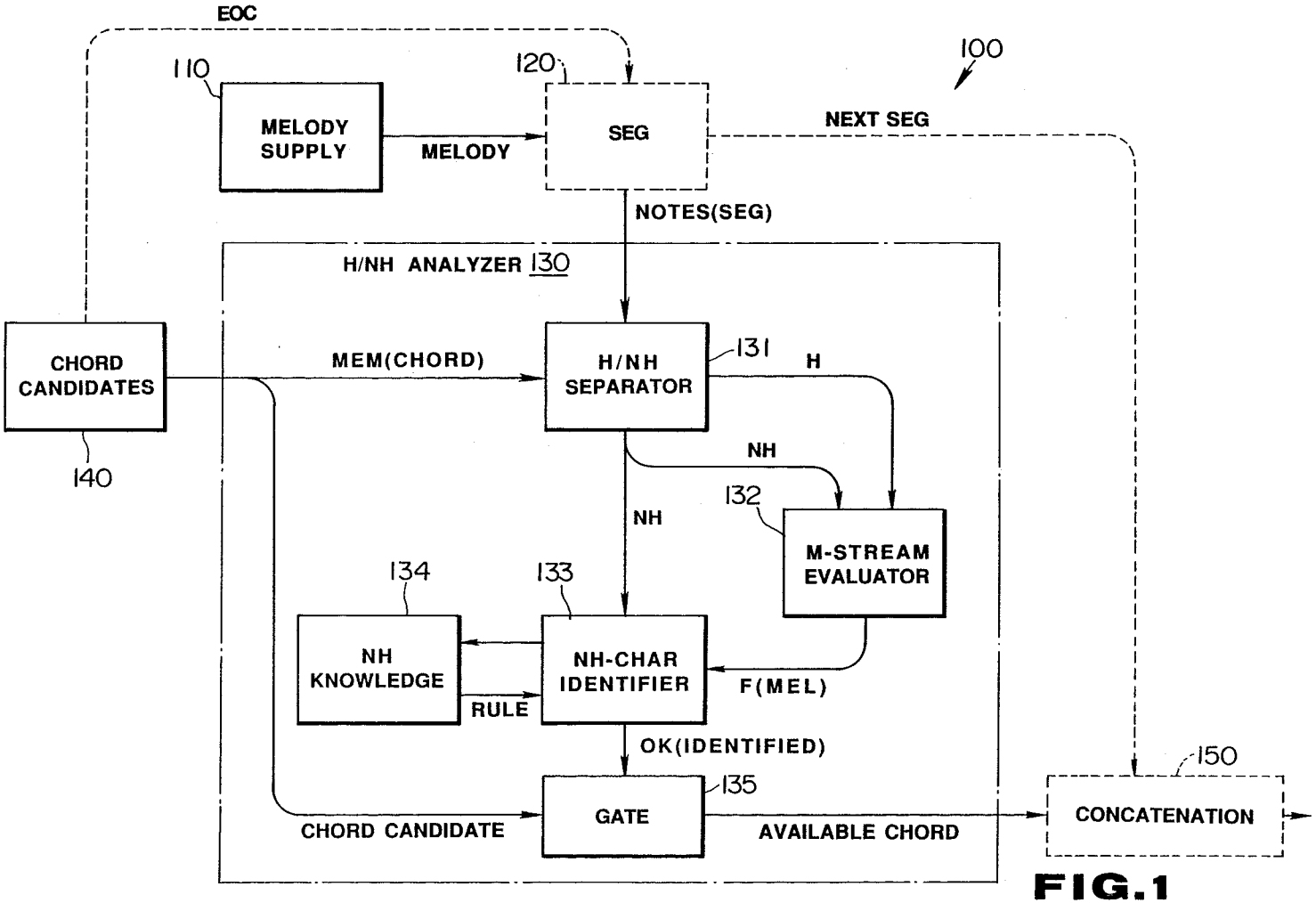
FIG. 1 shows a functional arrangement of apparatus for producing chords available for a given melody in accordance with one aspect of the invention.

Referring first to FIG. 1, there is shown a logical arrangement of a system generally designated 100 for producing available chords for a melody. In FIG. 1, such a melody is provided by a melody supply 110 which may comprise a melody input unit such as a keyboard of an electronically operated musical instrument or personal computer, optical image scanner/-reader of a printed music capable of recognizing melody notes from the image, and so on. The melody supply 110 may further comprise a memory into which melody data from a melody input unit are temporarily stored and will be read out as necessary therefrom for harmonic analysis or chordal interpretations of the melody.

If a melody supplied from the source 110 is short enough for a single chord to last over the entire melody length, such a melody may be directly passed onto a harmonic-nonharmonic analyzer designated 130 which produces available chords as many as there are according to its internal reasoning. A longer melody may, however, be provided by the melody supply 110 which implies changes of harmony or chord at appropriate times in its course. For this purpose, a segmentation module designated by a block 120 of dotted lines may be disposed between the melody supply 110 and the analyzer 130 to segment a melody from the source 110 and pass melody segments one at a time to the analyzer module 130 which then functions to reason or deduce available chords for each melody segment. When a full automatic version of the melody segmentation module 120 is desired, it is convenient, though not restrictive for each melody segment or block to have a length of one measure or bar assuming that a change of harmony can only occur over a bar-line. Under such assumption, what is required for the segmentation module 120 is mainly to locate a bar on the melody in the source 110 and to supply the melody note(s) of the bar to the "melody segment" analyzer 130. It will be obvious for a person skilled in the art to construct such a segmentation module. In the alternative, a user may locate a melody segment during which the same harmony is seen (mentally heard) to last by using a suitable display unit for providing a visual presentation of the entire melody and an input device for "telling" the system a segment of the melody which he or she has decided for analysis.

The analyzer module 130 is arranged to determine avilability of a chord or chords for a melody provided either directly from the melody supply 110 or indirectly via the segmentation module 120. In either case, a melody is the first input to the analyzer 130. A chord candidate source 140 is shown to provide a second input, i.e., a candidate or candidates of chord to the analyzer module 130. An automatic version of the chord candidate supply 140 may comprise a chord scanner for producing a set of chords one at a time during the scanning, each chord being represented by its constituent notes or members which may be stored in a suitable memory. In this case, the analyzer module 130 will determine available chords as many as there are in the set of chord candidates. As an alternative, a user may ask the system the availability of a chord candidate such as the one he feels good for a melody under analysis, such a candidate being entered to the system by means of any suitable input unit. This arrangement may be effective for educational purposes.

The analyzer module 130 comprises a harmonic/nonharmonic tone separator 131 which operatively receives melody notes from the melody supply 110 or segmentation module 120 and constituent notes of a chord candidate from the chord supply 140, uses the latter chord information to separate the received melody notes into harmonic (H) and nonharmonic (NH) tones by attaching, for example, corresponding labels thereto. A melodic stream evaluator 132 is provided which receives, from the H/NH separator 131, melody notes each with a lable of melodic harmonic tone or nonharmonic tone and evaluates characteristic profile or stream of a melody around each melodic nonharmonic tone. The evaluated melodic stream will be referred to as a situational function because it represents a local situation or condition of melody. The situational function may comprise a plurality of musical parameters. For example, one parameter may indicate a vertical or pitch distribution around the melodic nonharmonic tone in question, such as pitch intervals among notes. Another parameter may indicate a horizontal note distribution around the nonharmonic tone under investigation, such as the locations of harmonic and nonharmonic tones near the nonharmonic tone of interest.

Each melodic nonharmonic tone from H/NH separator 131 and the associated situational function from the melodic stream evaluator 132 are received by nonharmonic character identifier 133 which is arranged to reason or deduce a musical character of each supplied nonharmonic tone by applying rules in a NH knowledge memory 134 to the situational function around that nonharmonic tone. The rules stored in NH knowledge memory 134 represents a musical knowledge of classifying nonharmonic tones. The stored rules are so linked as to form a tree-structured inference network with an initial rule or root, terminal rules or leaves each indicative of a classified type or character of a nonharmonic tone and intermediate rules or nodes for connection from the root to the respective leaves. Each rule may comprise conditional part or if-part, and then and else-parts or consequent parts. According to the overall tree-structure of NH musical knowledge, some leaves are deemed "valid" or healthy leaves indicative of available nonharmonic tones for a melody while some other leaves are deemed "invalid" or unsound leaves indicative of unavailable or strange nonharmonic tones.

In order to analyze each melody note supplied from the H/NH separator 131 and labeled with a melodic nonharmonic tone, the NH character identifier 133 explores the network of NH knowledge, starting from the root rule and moving towards a leave or terminal rule while referencing the situational functions associated with a melodic nonharmonic tone in question. More specifically, NH character identifier 133 substitutes a melodic value of a situational function for a variable (labeled with that function) in a if-part of a rule and checks as to whether the if-part is satisfied. If met, the character identifier 133 selects the then-part to move to or "reason forward to" a rule to be applied next if any. If the conditional part has failed, the module 133 will reason forward to a rule to be applied next by selecting and referencing the else-part. Each else or then-part serves either as a pointer to the next rule as long as there remains any rule for further reasoning, or a terminal or leaf indicative of the result of reasoning i.e., a classified character of the melodic nonharmonic tone. In this manner, each melody note labeled with a melodic nonharmonic tone is analyzed or identified with respect to its nonharmonic character or function.

The NH-character identifier 133 produces an OK signal when melody notes supplied from H/MH separator 131 with labels of melodic nonharmonic tones are all found to be available or valid nonharmonic tones. The OK signal enables a gate 135 to pass a chord candidate as an available chord for a melody under analysis which has been provided to the harmonic-nonharmonic analyzer 130 directly from the melody supply 110 or indirectly via the melody segmentation module 120. When the character identifier 133 has found from the results of reasoning that there is an unavailable or invalid nonharmonic tone or tones in the melody, it provides a NG signal to the gate function 135 which, at this time, rejects a chord candidate proposed by the chord supply 140. The NG signal has a implication that a chord candidate is unavailable for a melody. Systematically, the harmonic and nonharmonic analyzer module 130 accepts a chord candidate as an available chord for a melody when all notes in the melody are found to be valid notes which can be labeled either with a harmonic tone (at the separator 131) or with a valid nonharmonic tone (at the character identifier 133 cooperative with the melodic stream evaluator 133 and the knowledge memory 134). To state it another way, the system 100 produces an available chord whenever (1) a melody under analysis has a musical period of time during which a chord in question such as the one supplied from the chord source 140 can last without change of harmony and (2) the melody under analysis is formed by a stream or succession of notes arranged in such a manner that all possible nonharmonic tones in the melody have been successfully identified as valid notes according to the musical knowledge built in the system under the tentative assumption that each member of a chord in question can be used as a melodic harmonic tone in the melody.

As stated, the chord candidate 140 may comprise an automatically operable chord scanner which has a set of chords and during the scanning supplies them one at a time to the melody analyzer module 130 which may receive a segmented melody from the segmentation module 120. With this arrangement, the analyzer module 130 will determine the availability of every chord candidate for the current segment of melody. When the chord scanner has completed a scanning cycle, it provides an end-of-chord (EOC) signal to the melody segmentation module 120 which then selects the next melody segment from the melody source 110 and supplies it to the analyzer module 130. In addition, the segmentation module 120 produces a signal indicative of a new segment number and supplies it to a chord concatenation module designated 150. As seen in FIG. 1, available chord information found by the melody analyzer module 130 is sent to the concatenation module, the function of which is to produce a two-dimensional array of available chords (such as shown in a table 310 in FIG. 3) concatenated in a horizontal or temporal direction of melody. Each element of such a two-dimensional array may be expressed by {Ci, j} wherein "i" is an available chord row number and "m" is a segment or column number. In response to a new segment number from the melody segmentation unit 120, the chord concatenation module 150 re initializes a row number. Each time the concatination module 150 receives an available chord from the analyzer module 130, it places or stores that chord at a location in the array specified by the current row and segment numbers and increments the current row number.

It should be noted that the system 100 discussed above is capable of producing or reasoning available chords as many as there are for a melody supplied directly from the melody source or indirectly via the melody segmentation module. In other words, the present system 100 is free from unreasonable or undesired constraints on a melody under analysis as practiced in the prior art. One of said constraints requests that there is no change of key (modulation or tonal fluctuation) in the course of melody to be analyzed. Another constraint is such that a melody under analysis must be relatively long, always ending with a predetermined cadence or cadences which limitedly determine the ending chords and so on.

Figure 2:
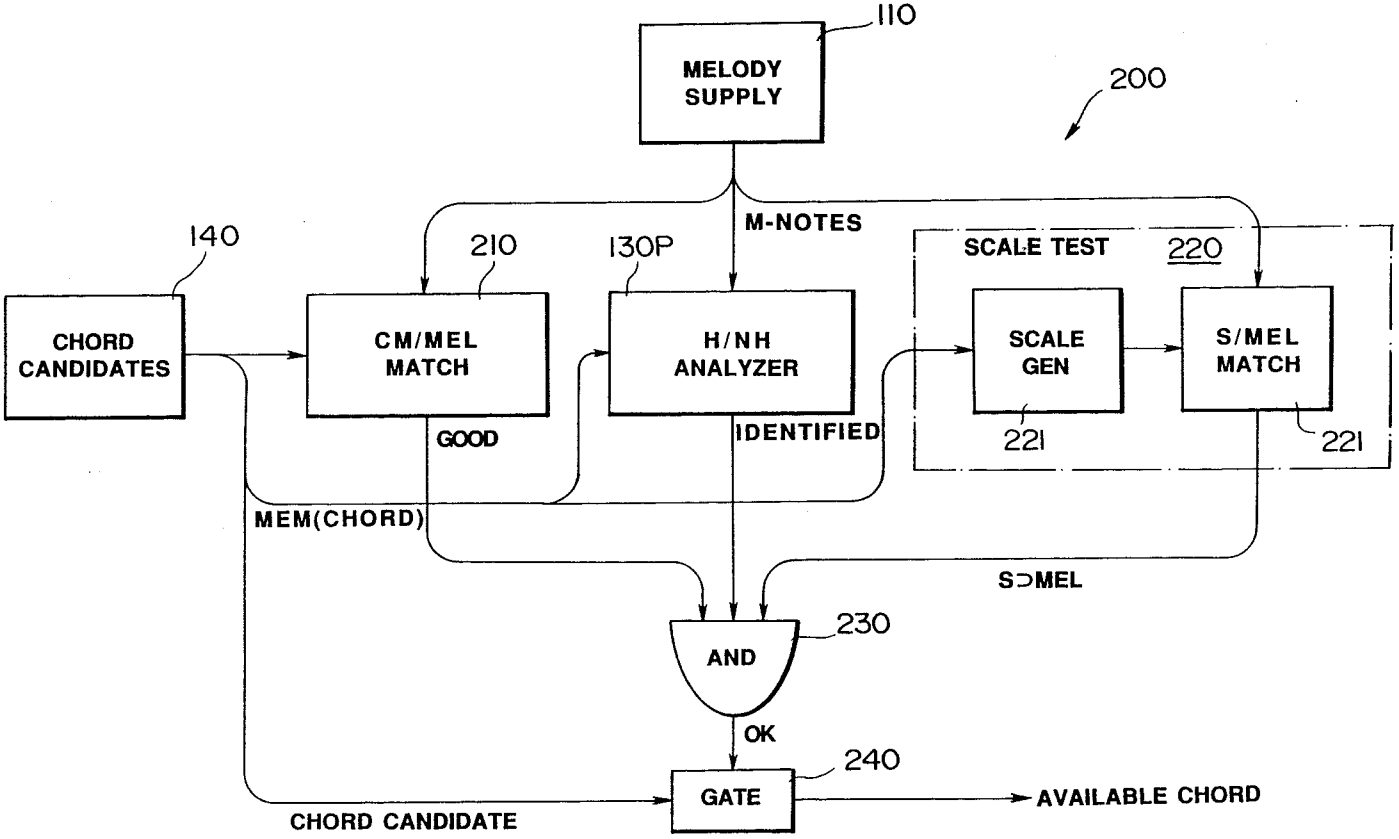
FIG. 2 shows another functional arrangement of apparatus for producing chords available for a given melody in accordance with another aspect of the invention.

Referring to FIG. 2, there is shown a functional arrangement of another system generally designated 200 for producing available chords for a melody. This arrangement 200 has three different modules disposed in parallel to each other for testing the availability of a chord candidate for a melody, the first module being identified as chord member/melody notes (CM/MEL) match module 210, the second as harmonic/nonharmonic (N/NH) analyzer module 130P and the third as scale test module 220. These modules are shown directly coupled to melody supply 110, but may be indirectly coupled thereto via a melody segmentation module such as the one 120 shown in FIG. 1. Each module 210, 130P and 220 is supplied with chord candidates one at a time from the chord source 140 discussed in connection with FIG. 1. The second or N/NH analyzer module 130P corresponds to the harmonic-nonharmonic analyzer 130 in FIG. 1, excluding, however, the gate 135. The first or CM/MEL match module 210 is arranged to match melody notes against chord notes or members of a chord candidate for evaluating a degree of matching therebetween. If the evaluated matching degree is relatively high, the match module 210 determines the chord candidate as an available chord (which can, however, be considered sometimes an unavailable chord in the overall system 200, as will be apparent from the following description) and produces a locally OK signal indicated "good" in FIG. 2.

The third or scale test module 220 comprises a scale generator 221 and scale notes-melody notes (S/MEL) match submodule 221. The scale generator 221 operatively produces at least one scale each having a plurality of different pitches or notes as a function of a chord candidate from the chord source 140. A version of the scale generator 221 produces three diatonic scale each made of seven pitches, the first diatonic scale having a key-note, tonic or first scale degree of the same pitch as the root of a chord candidate in question, the second scale having a key note corresponding to a dominant note or perfect fifth degree of the first diatonic scale, and the third diatonic scale having a subdominant note or perfect fourth degree of the first diatonic scale. A note of third degree of each diatonic scale is given a distance of major third degree or two whole-tone steps from the key-note when a chord candidate pertains to a family of major chord and when a chord candidate belongs to a class of minor chord, it is given a distance of minor third degree or one whole-tone plus one half-tone from the key-note. The three diatonic scales can be said to have three important tonal-harmonic implications or functions, tonic function (of the first diatonic scale), dominant function (of the second) and subdominant function (of the third). Therefore, the production of these diatonic scales in the scale generator 221 is useful and effective particularly when a melody under analysis has a style of so called tonal music. It may be possible, however, for the scale generator to produce a nondiatonic scale or scales if desired. Another version of the scale generator 221 produces a note scale or scales which depend not only from parameters of a supplied chord candidate such as chord type and root but also from a characteristic stream or pitch line of melody notes to be analyzed. The latter information may be provided to the scale generator 221 from the melody stream evaluator.

In either case, each scale of a plurality of pitches is supplied to the S/MEL match submodule 221 for testing a melody from the melody supply. The submodule 221 evaluates a pitch relationship between the pitch content of the scale and that of the melody and determines a (local or provisional) availability of a chord candidate according to the evaluated pitch relationship. A version of the submodule 221 checks as to whether all melody note pitches are included in the pitches of one of the scales such as the three diatonic scales stated above, i.e., the pitch contents of the melody are a subset of those of a scale. If this is the case, the submodule 221 produces a local OK signal designated here in FIG. 2 by S⊃MEL. Otherwise, it will produce a NG signal instead.

All OK/NG signals from the three analyzer modules 210, 130P and 220 are ANDed in an AND gate 230 which selectively produces a global OK signal and supplies it to a chord pass/kill gate 240 only when all three analyzer modules 210, 130P and 220 have provided their own local OK signals. In response to the global OK signal, the gate 240 passes a chord candidate therethrough as a systematically available chord.

It will be noted here that the first or CM/MEL match module 210 can complete the analysis or local determination of chord availability in a shorter time than the second and third analyzer modules 130P and 220. In addition, scope of those chord candidates which are accepted by the first module 210 as available chords are generally wide, though depending on the matching criterion or the threshold degree of matching between the pitch content of a melody and that of a chord candidate. From a systematic aspect, the role of the first analyzer module 210 disposed in parallel with the second and third analyzer module 130P and 220 is not essential in the arrangement 200 of FIG. 2 because the main job of the first analyzer module 140 is only to evaluate a degree of inconsistency of a melody pitch content against a chord pitch content and such evaluation is statistical or heuristic rather than musical. It should be noted, however, that logical equivalence holds even if the parallel arrangement 200 of FIG. 2 is modified into a serial one in which the three analyzer modules 210, 130P and 220 are coupled in a series. More specifically, each analyzer module further comprises a chord pass/kill gate disposed in a manner as the gate 135 of analyzer module 130 in FIG. 1. In a series structure, CM/MEL match module is placed first such that the systematic analysis starts on the CM/MEL match module followed by the second e.g., H/NH analyzed module and the third e.g., scale test module; each module except the last one passes available chords to the next module which takes such chords for candidates and initiates its melody analysis of determining the availability of each chord candidate. In this arrangement, the role of CM/MEL match module, which is so placed as to first test the chord availability, is significant or contributive in shortening the time required for the system to complete the entire analysis because the CM/MEL match module can provide a considerable reduction in the number of chords which the downstream positioned modules have to test or reason for availability.

The CM/MEL module, now functioning as a preliminary analyzer or chord filter, should not however, reject those chords which would, if delivered to the downstream positioned analyzer module 130P or 220, be found available for a melody in question. This problem will be overcome easily by providing a suitable threshold matching level in the CM/MEL match module.

In the alternative, CM/MEL match module may be deleted or excluded from the system if the overall analysis speed thereof is not a problem.

If desired, H/MH analyzer module 130P may also be inoperative according to a mode of the system 200 or even deleted completely therefrom leaving only the scale test module 220 as a single melody analyzer module.

The systems discussed in the foregoing are capable of producing as many available chords as there are for a given melody, without the need of unreasonable or excessive constraints on a given melody and harmonic interpretations thereof. This is believed to accord with the nature of music which generally allows a melody to have or suggest various harmonic or chordal implications. In the presence, of substantially all possible or available chords for a melody, many users will find it fun to search for a chord progression which is felt best suited to a melody of interest. Some users may, however, wish to get a single or small number of machine made chord progressions, depending for example on their experience in music. Further, chords provided by the above systems are available but individually. Thus, combining those available chords one after another without any reasoning can result in a strange or unfamiliar chord progression not suited for the melody. Therefore, the provision of an apparatus which is supplied with available chords such as from the above systems and automatically selects one of the alternatives in available chords for each melody segment will be convenient and helpful to some users.

Figure 3:
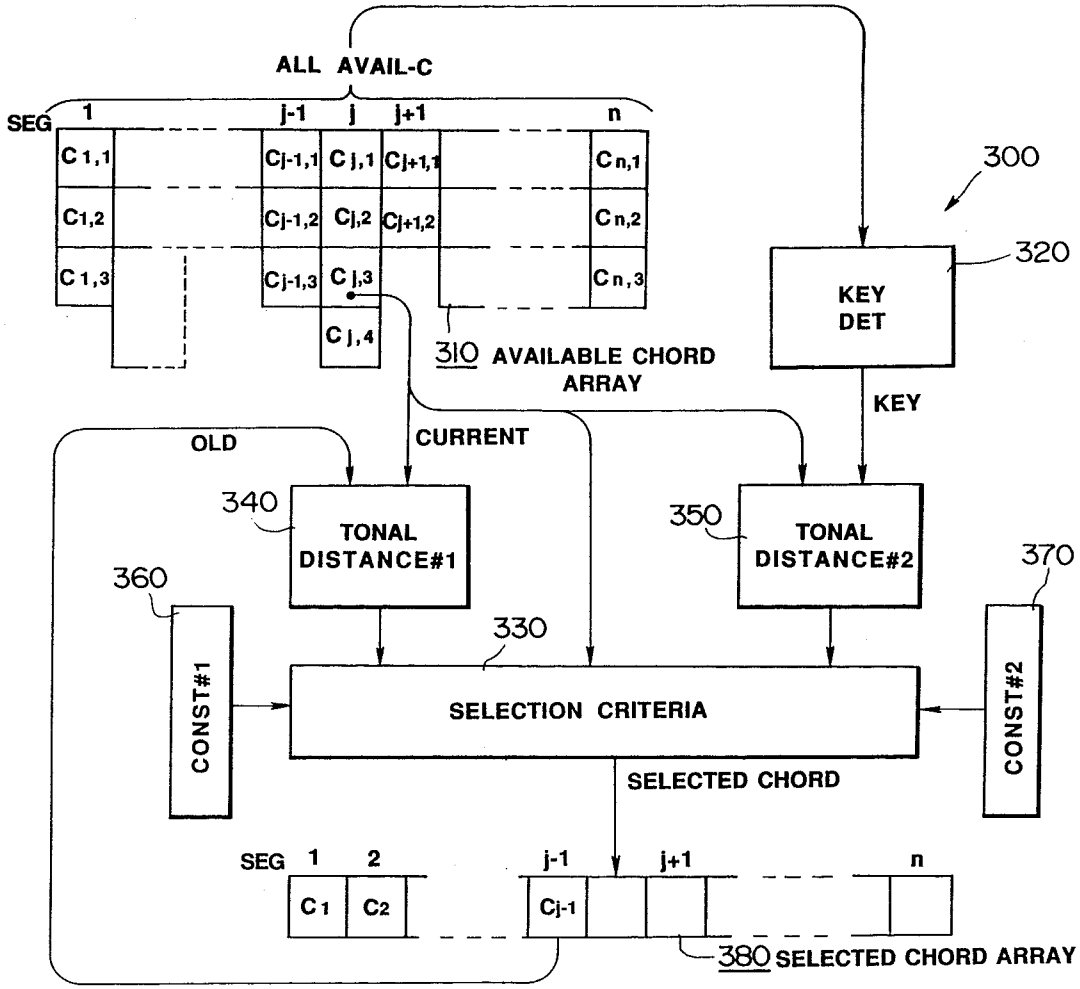
FIG. 3 shows a functional arrangement of apparatus for selecting a chord progression for a given melody.

FIG. 3 illustrates a functional arrangement of an apparatus 300 for the purpose. A set of available chords on which the apparatus 300 operates to select or produce a chord progression are provided in a two dimensional array 310 (already produced by one of the systems as mentioned earlier). In the array or table 310, a column number corresponds to the same segment number of melody. Each column of the table have available chords for a corresponding melody segment. The number of available chords per melody segment depends on the characteristic of a melodic line in an individual melody segment as well as harmonic or chordal interpretations thereof made by a system that has prepared the available chord array 310. Each available chord in the array 310 may be identified or expressed by {C i,j} in which (i,j) indicates a location of the available chord in the array 310. Selected chord array 380 is a one dimensional array into which the apparatus 300 writes a progression or succession of chords as selected from the two dimensional chord array 310. Selection of chords is made by the remaining portion of the apparatus 300 comprising a key determination module 320, a first tonal distance measurement module 340, a second tonal distance measurement module 350, a first constraint supply 360, a second constraint supply 370 and a selection criteria module 330.

The key determination module 320 is arranged to determine a key of melody as a whole, using all available chords stored in the two dimensional chord array 310. In a version, the module 320 comprises a frequency distribution measuring submodule for measuring a frequency distribution of chords in the chord array 310, and a key detection submodule for determining a key of melody in accordance with the measured frequency distribution of chords. The latter submodule may comprise means for finding a chord with the highest frequency in the array 310 whereby a key of melody is specified by that chord. For example, if the chord of the highest frequency is C major, a key of melody is C major. A key of melody may also be regarded as a tonic chord of melody.

The first tonal distance measuring module 340 measures a distance of tonal-harmonic function between two consecutive chords, one for a melody segment, the other for the next melody segment. As seen in FIG. 3, the module 340 is arranged to receive a selected chord designated OLD which is from the selected chord array 380, and particularly from one element thereof numbered (j−1) here in FIG. 3, selected for a corresponding numbered melody segment. The module 340 also receives an available chord designated CURRENT from a portion of the available chord array 310 having a column or segment number of j which is the next number to (j−1) pointing to the OLD. A scanning and synchronization mechanism of the apparatus 300 is such that it reads out all available chords in j-th column of the table 310, and supplies them one at a time as a CURRENT chord to the first distance measuring module 340 (as well as the second distance measuring module 350 and the selection criteria module 330) under the selection of (j−1) the chord in the array 380 as an OLD chord to the first distance measuring module 340. When all available chords in the column j of the table 310 have been scanned (and one of them has been selected and written into j-th element of the selected chord array 380 in such a manner as will be described in detail), the next column (j+1) of the table 310 is selected for the CURRENT chord and j-th element of the array 380 is selected for the OLD chord. The process repeats until the last column's available chords in the table 310 have been scanned, selected and written into the last element of the array 380.

The module 340 may measure or evaluate a distance of the CURRENT chord from the OLD chord as a function of, for instance, an extent of chord notes common to both CURRENT and OLD chords. In another version, the module 340 measures the distance as a function of an extent of pitches common to two note scale, one scale being implied by the CURRENT chord and the other scale implied by the OLD chord. For example, a chord of C major may imply a diatonic major scale with a tonic of C. A chord of A minor may imply a diatonic minor scale (which may be either harmonic, natural, or melodic) having a tonic of A. An evaluation function for measuring the distance may be in a reverse relationship with an extent of common scalar pitches. If desired, different weights may be assigned to respective pitches of a scale in order that particular scalar pitches having heavier weights (for example, pitches of first, fifth and seventh scale degrees) contribute more significantly in determining the distance between the CURRENT and OLD chords.

The second tonal distance measuring module 350, which receives the CURRENT chord from the array 310 and a key or tonic chord of melody from the key determination module 320, measures a distance of the CURRENT chord from the key or tonic chord. It will be understood that the key information serves as a reference relative to the CURRENT chord for the second distance measuring module 350 while for the first distance measuring module the OLD chord serves as a reference to the same CURRENT chord. The second module 350 may evaluate a distance in a similar manner to the first module 340, using the same or similar evaluation function.

The evaluated first and second distances are supplied to the selection criteria module 330.

The first constraint supply 360 provides a first constraint to the selection criteria module 330 while the second contraint supply 370 provides a second constraint to the same module 30. In order to select one of the available chords in a column (here column j) of the table 310, the criteria module 330 uses the first constraint to bound or limit a possible extent of the first distance formed between the CURRENT and OLD chords and uses the second constraint to limit a possible extent of the second distance formed between the CURRENT chord and the key of melody. For this purpose, the criteria module 330 may comprise a first departure submodule for computing a first departure or deviation of the first distance from the first constraint for each available chord in the current column j of the table 310, a second departure submodule for computing a second departure of the second distance from the second constraint for each available chord in the current column j, a combining submodule for combining the first and second departures for each available chord to produce a total or composite departure from the constraints, and a selecting submodule for selecting one available chord with the minimum total departure among the available chords in the column j of interest.

The selected chord in this manner is loaded into the j-th element of the array 380. At the end of the operation of the apparatus, the one dimensional array 380 has stored a progression or succession of chords, one per melody segment.

The selection criteria adopted in the module 330 may be modified or simplified if desired. For example, only one of the first and second departures discussed above may be computed for each available chord in a column of the table 310 and each computed departure is used in place of the above-mentioned total departure in order that one available chord with the minimum value of departure is selected from in each column of the table 310. With this arrangement, certain modules shown in FIG. 300 are not needed accordingly.

The description will now turn to a specific embodiment of the invention by way of example only.

Figure 4:
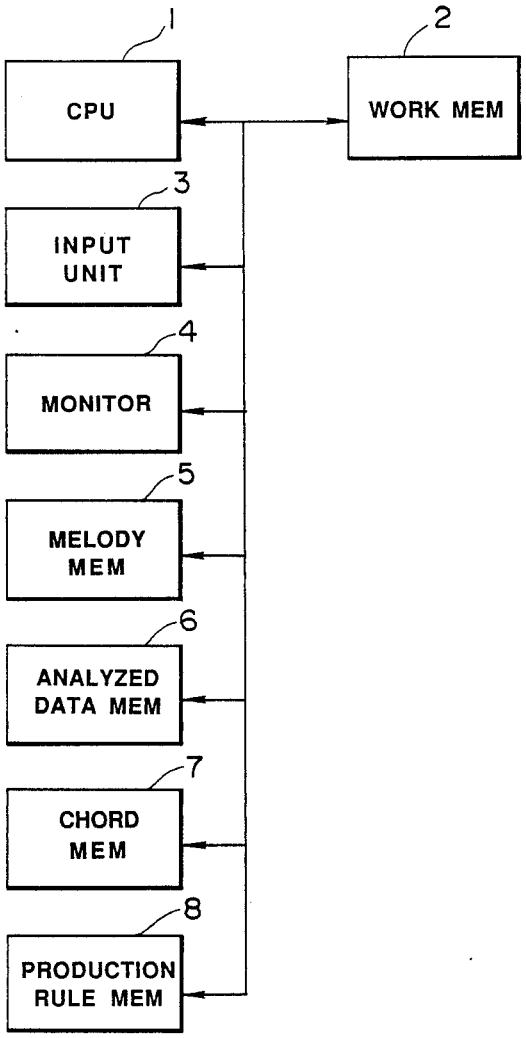
FIG. 4 is a block diagram of an automatic harmonizing apparatus in accordance with an embodiment of the invention.

The overall arrangement of the embodiment is shown in FIG. 4 in a block diagram. CPU1 controls the entire system according to programs incorporated therein. A work memory 2 is used by the CPU1 to temporarily store data. An input unit 3 is used to data such as a melody. For real-time entry of a melody, a musical keyboard may be employed. A monitor 4 may comprise a CRT, a music printer, and a tone generator to a sound system each for displaying, printing or playing a melody and/or analyzed results of melody such as chords. A melody memory 5 is used to store melodies input by the input unit 3. An analyzed data memory 6 stores analyzed results of melody. A chord memory 7 stores a set of chords. A production rule memory 8 stores data representing musical knowledge of classifying melodic nonharmonic tones.

The illustrated system has a function of producting available chords as many as there are for each melody segment such as bar. Two examples will be described in the following. The system also has a function of selecting one of such available chords for each melody segment, and this will be taken up later.

Production of Available Chord (EX1)

In a first exemplanary mode (PAC1) the system of FIG. 4 produces available chords as many as there are for each segment of a given melody. In this example, a chord candidate for a melody segment such as bar is deemed available whenever every melody note in a melody segment of interest is correctly identified as an available note (either a melodic harmonic tone or a "valid" melodic nonharmonic tone). At first, the system assumes tentatively that a chord candidate is an available chord. Under this assumption any melody note in a melody segment having the same pitch with a chord note or member of the chord candidate of interest can be deemed (labeled with) a melodic "harmonic" tone while the remaining melody notes can be deemed (labeled with) a melodic "nonharmonic" tone. This is because any melody note can be classified into either a melodic harmonic tone or a melodic nonharmonic tone and because a chord (suited) for melody notes i.e. a stream or a succession of such melody notes forms a basis for a harmony implied or suggested by that melody stream such that all melodic harmonic tones contained in the melody stream construct or build constituent notes or pitch content of that chord or partial pitch content thereof. In this manner, all melody notes contained in a melody segment of interest have been identified (tentatively) as either a melodic harmonic tone or a melodic nonharmonic tone. Then, those melody notes labeled with a melodic nonharmonic tone are analyzed further to determine the availability of a chord candidate of interest. More specifically, the system evaluates a local melodic situation of, near or around each melody note labeled with a nonharmonic tone. Each local melodic situation is represented by a plurality of situational functions (F) indicative of, for example, local characteristics of pitch intervals formed among melody notes of or around a nonharmonic-labeled note of interest such as stepwise/leap motion of a nonharmonic-labeled melody note from a harmonic-labeled melody note, passing or linear movement of a pitch or pitches between harmonic labeled melody notes and so on. Then, the system applies rules in the production memory 8 to the local situational functions evaluated around a nonharmonic labeled melody note to identify a musical character or nonharmonic function of that nonharmonic-labeled melody note in a forward reasoning. This process repeats for all nonharmonic-labeled melodic notes. Each result of forward reasoning for each nonharmonic-labeled melodic note indicates a choice of availability/unavailability of said each nonharmonic-labeled melodic notes. If all nonharmonic-labeled melodic notes are formed available or valid, the system confirms the first-mentioned assumption that a chord candidate is an available chord for a melody segment in question. Otherwise, the system recognizes that the assumption is incorrect i.e., the chord candidate is not an available chord. In this manner, the system determines or produces available chords as many as there are for a melody.

Figure 5:
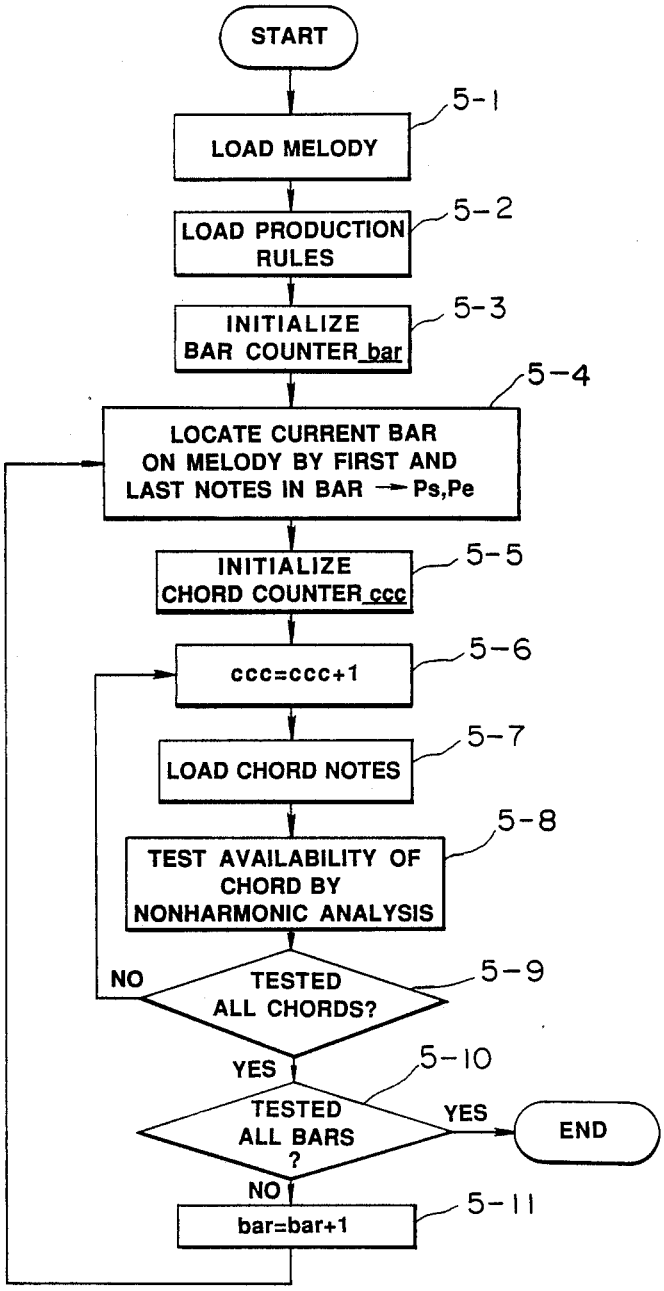
FIG. 5 is a flowchart of an operation of the apparatus in FIG. 4 for producing available chords for a given melody.
Figure 6:
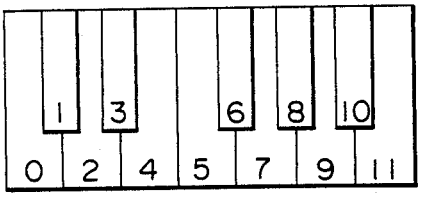
FIG. 6 shows data formats of musical notes and chords.
Figure 6:
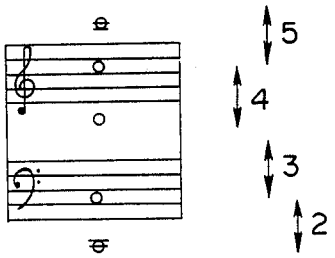

The operation of the system discussed above is illustrated in a general flowchart of FIG. 5. More detailed flowcharts are presented in FIGS. 8, 10, 11–13, and 15–28.

In FIG. 5, a routine 5 loads melody data into an area of the work memory 2 from the melody memory 5. A routine 5-2 loads production rules into an area of the work memory 2 from the production rule memory 5. A step 5-3 initializes a bar counter so that the analysis of melody will start on the first bar.

Routines 5-4 to 5-11 form an iteration loop in which the system produces available chords as many as there are for each bar of melody in such a manner as discussed above.

Routine 5-4 locates the current bar on the entire melody data by computing the locations of first (Pe) and last (Pe) notes in the current bar. Routine 5-5 initializes a chord candidate counter or chord identification number CCC.

Routines 5-6 to 5-8 formes an iteration loop in which the system produces available chords as many as there are with respect to the current bar. Routine 5-6 increments CCC to update a chord candidate called the current chord candidate. Routine 5-6 produces member pitches of the current chord candidate by reading chord member data from a chord member memory. Routine 5-8 forms the main portion of the general flowchart in which the system determines the availability of the current chord candidate for a melody bar of interest, using the associated melody data, chord member pitch data and production rule data, all already stored in the work memory 10. Routine 5-7 checks whether all chord candidates have been tested for availability with respect to a melody bar of interest.

To iterate the process for all bars of melody, bar number is incremented in routine 5-11 until stopping routine 5-10 finds that all bars of melody have been analyzed with the production of available chords.

(Data format)

Figure 8:
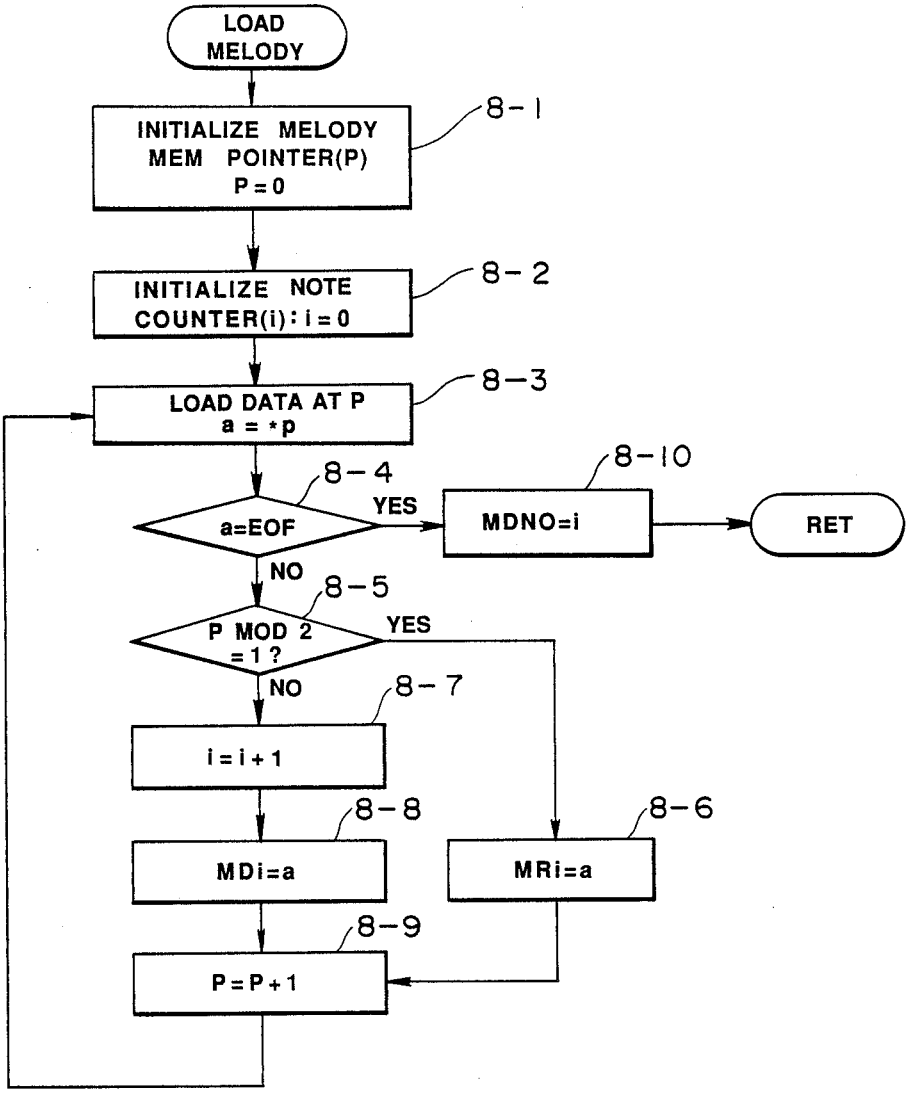
FIG. 8 is a flowchart of loading data of a melody.

FIG. 8 illustrates a format of melody note data and chord data as adopted in flowcharts to follow. In this example, a melody is represented by a succession of melody notes. Each melody note comprises a pitch and a duration. Each melody note pitch is represented by a 16-bit data, the highest 8 bits indicative of an octave range or number and the lowest 8 bits indicative of a vertical position of a note within an octave. The lowest 8 bits have an integer of "1" for "C", "2" for "C sharp" and so on and finally "11"for "B". Each melody note duration is represented by an integral multiple of an elementary or unit length.

Each chord is represented by 16-bit data, the highest 8 bits indicative of a type of chord and the lowest 8 bits indicative of a root of chord.

(Load melody)

Figure 7:
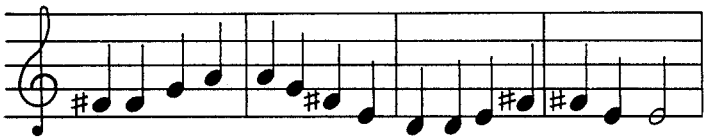
FIG. 7 illustrates data representative of a melody which is, here, an excerpt from "Ode to Joy" from Beethoven's Ninth symphony.

FIG. 7 shows a melody in a traditional notation together with the corresponding melody data stored in the melody memory 5. The illustrated melody material is an excerpt from "Ode to Joy" from Beethoven's Ninth Symphony.

FIG. 8 is a more detailed flowchart of block 2-1 in the general flowchart of FIG. 5 for loading a melody. As a result of the illustrated process, i-th melody note pitch data has been stored in MDi and i-th melody note durational data has been stored in MRi. MDNO indicates the total number of melody notes.

(Load production rules)

Figure 10:
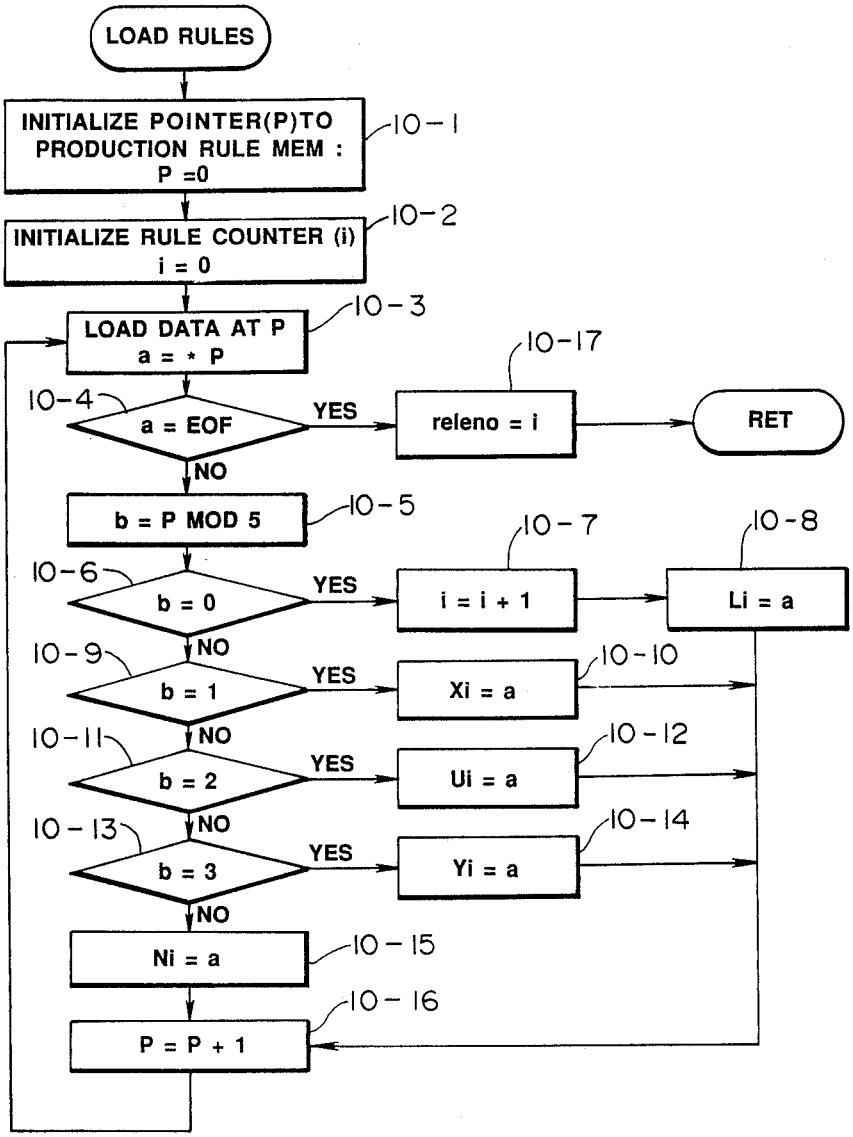
FIG. 10 is a flowchart of loading production rule data.
Figure 35:
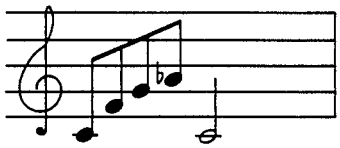
FIG. 35 demonstrates another result of harmonic analysis of a melody material shown.

FIG. 9 shows an example of production rule data stored in the production rule memory 6. FIG. 10 illustrates a detailed flowchart of block 2-2 in the general flowchart of FIG. 5 for loading production rules from the memory 6. The entirety of the production rules represents musical knowledge of classifying nonharmonic tones contained in a melody (see parts (b) and (c) in FIG. 9). Each production rule data contains lower limit data Li, function data Xi designating type of function, upper limit data Ui, these data defining a condition part of the rule, and data Yi and Ni as consequent parts of the rule. Each function is numerical expression of a local situational feature of the melody surrounding a nonharmonic tone to be analyzed. An example of the functions is shown in FIG. 35 which will be described later. The condition part states that the value Fxi of a function pointed to by data xi is greater than or equal to Li and less than or equal to Ui ($Li \leqq Fxi \leqq Ui$). If the condition is met, the result is shown by data Yi, and otherwise it is shown by data Ni. If the data Yi or Ni has a positive value, the value indicates the production rule number to be referenced next in forward reasoning. If the data has a negative value, the absolute value thereof represents the type of nonharmonic tone, conclusion of reasoning. The forward reasoning always starts from one rule, called a root. The forward reasoning ends when a negative conclusion Yi or Ni is found. It should be noted here that some negative-value consequent parts Y, N of production rules are marked by "ill" or "ILLEGAL" in FIG. 9. These nonharmonic tones are invalid, illegal, or unavailable melodic nonharmonic tones. As will be described, if the forward reasoning has reached a conclusion part Y, or N of "illegal" tone, the system withdraws the assumption initially made that a chord candidate is an available chord whereby rejecting that chord candidate for a melody bar of interest.

In production rule data address allocation shown in FIG. 9, each production rule is stored in five consecutive addresses of the production rule memory 8 with the lower limit data L in the front. More specifically, data Li (See FIG. 10) is stored in an address which yields a remainder of 0 when divided by 5, data Xi is stored in an address yielding a remainder of 1 in division by 5, data Ui is stored in an address yielding a remainder of 2 in division by 5, data Yi is stored in an address yeilding a remainder of 3 in the division, and data Ni is stored in an address yielding a remainder of 4 in the division.

In the flow shown in FIG. 10, the total number of production rules is set in a register RULENO. For the rest, the flow will be obvious from the above description and also from the Figure itself.

(Locate melody bar)

Figure 11:
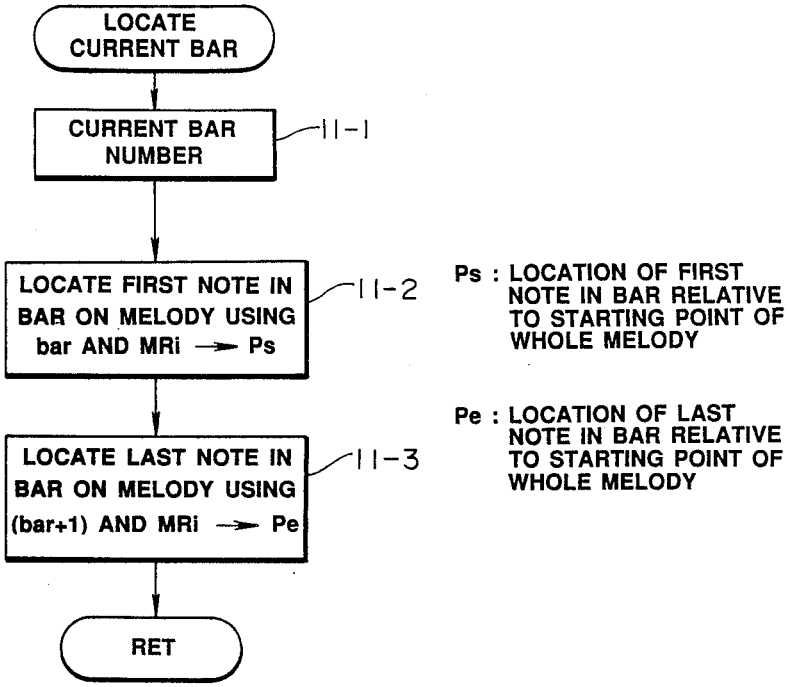
FIG. 11 is a flowchart of locating a bar on the melody data, also showing three examples of note durational series in which each second bar or segment has been bounded by the first and last notes identified by note numbers counting from the leftmost start note.
Figure 11:
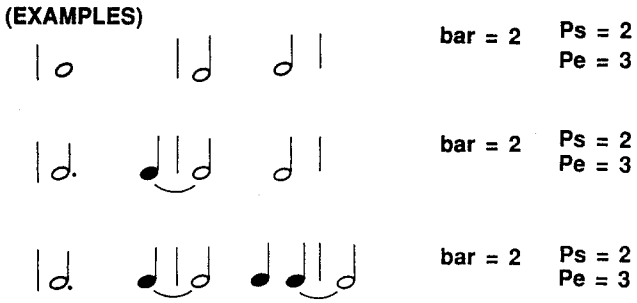
Figure 12:
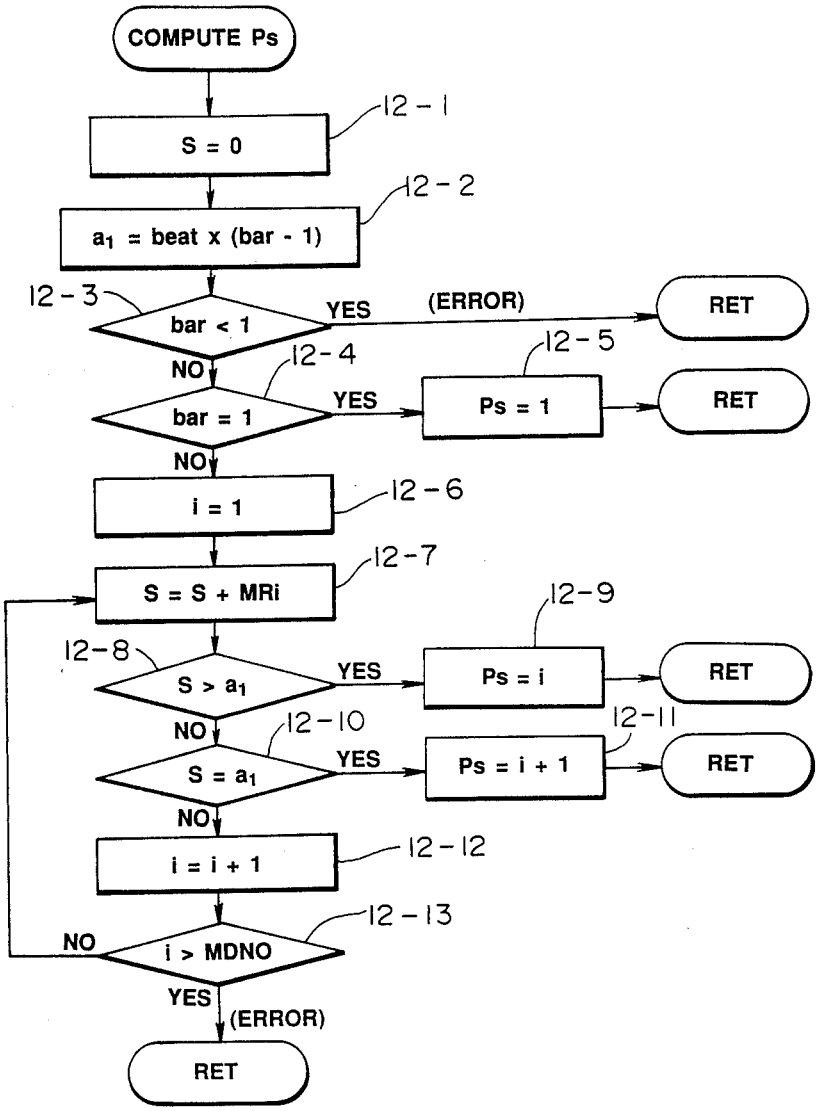
FIG. 12 is a flowchart of computing the location of the first note of a bar.
Figure 13:
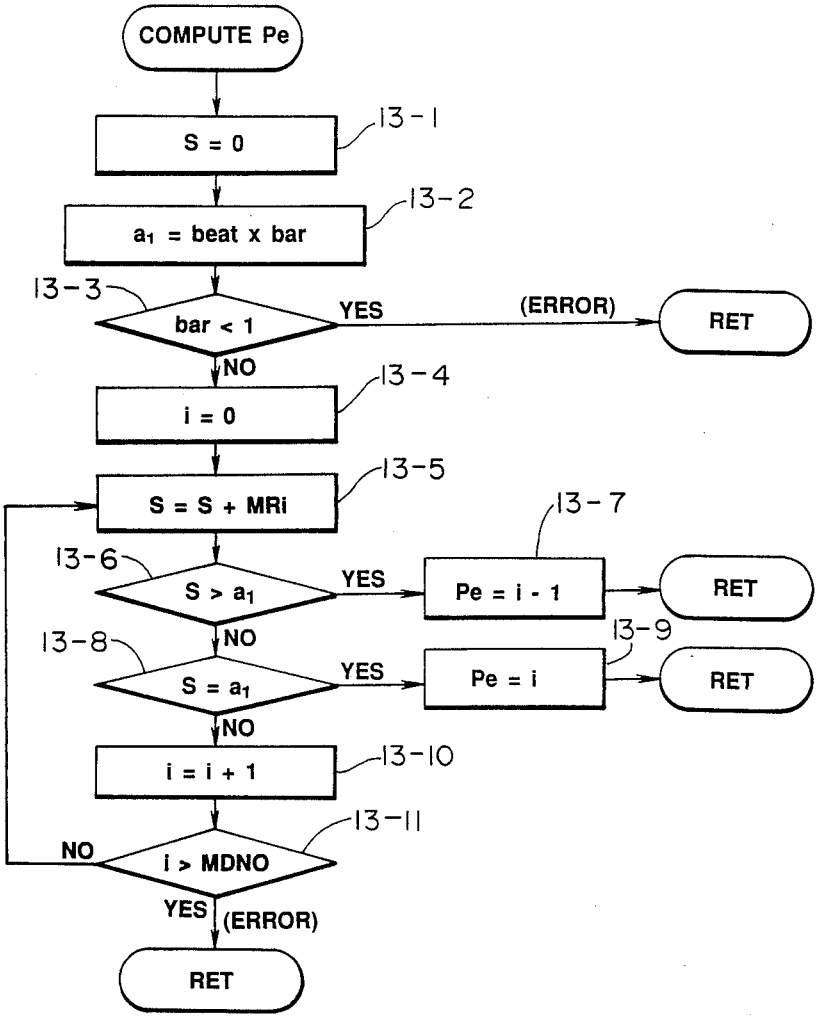
FIG. 13 is a flowchart of computing the location of the last note of a bar.

FIGS. 11 to 13 show a more detailed flowchart of block 5-4 of the general flow of FIG. 5 for locating a bar of interest on the entire melody data. By the location process, Ps register has stored a location of the first note in a bar of interest, relative to the entire melody, that is an element number or address of the melody note array {MDi}, {MRi} where the first note data of the bar of interest is placed. Similarly, Pe register has stored a location of the last note is the same bar. In this manner a pair of positional data Ps and Pe bound melody data in a bar of interest to which analysis will be made to determine available chords therefor.

(Generate a chord candidate)

Figures 14, 15:
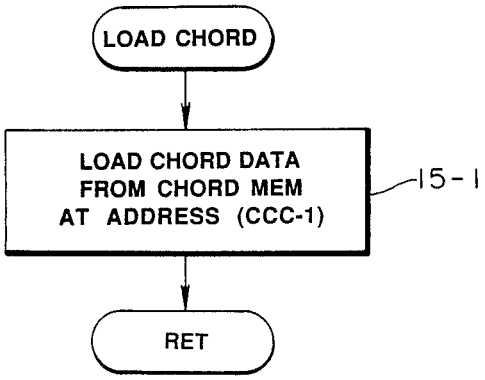
FIG. 14 illustrates chord data stored in the chord memory shown in FIG. 4.
FIG. 15 is a flowchart of loading a chord candidate.

FIG. 14 illustrates chord data stored in the chord memory 7 which serves as a source of chord candidates. Respective addresses of the chord memory 7 correspond to respective chords such that chord data specifying the respective chords by root and type are stored therein.

FIG. 15 shows a chord loading process 15-1 corresponding to block 5-7 in the general flow of FIG. 5. As shown, chord data is loaded from the chord memory 7 at an address (CCC-1). Systematically, the chord data loaded here is called the current chord candidate, a chord candidate of interest or a chord candidate in question etc. because this candidate will soon be tested with respect to its availability for a melody bar under analysis.

(Test chord candidate)

Figure 16:
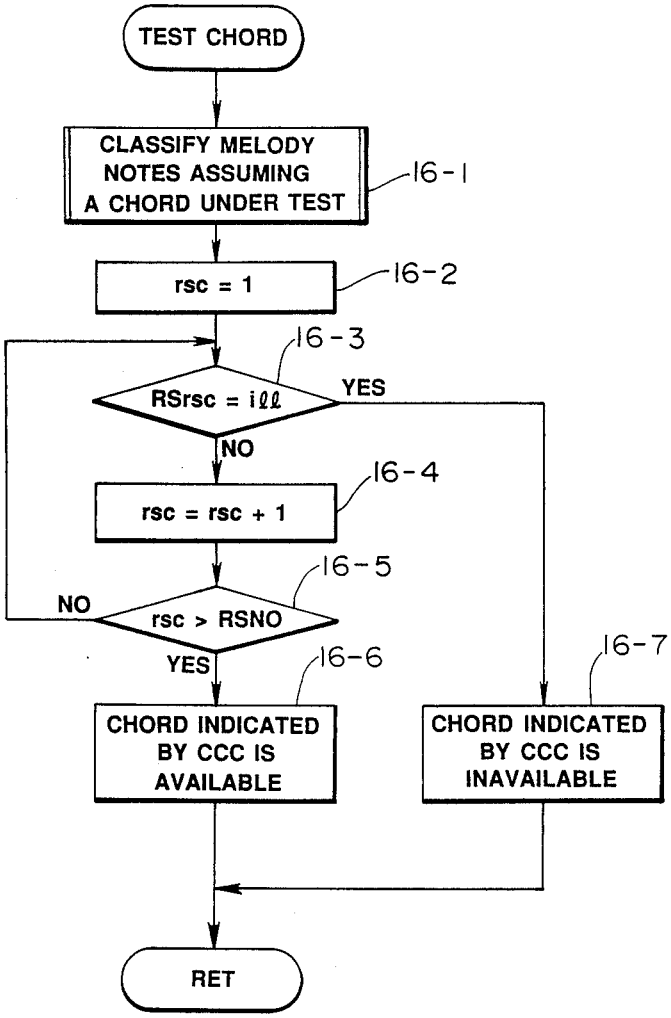
FIG. 16 is a flowchart of testing availability of a chord for a melody at a bar by means of nonharmonic tone analysis.

FIG. 16 is a detailed flowchart of block 5-8 in the general flow of FIG. 5.

Block 16-1, which will be described in more detail, classfies melody notes contained in a melody bar of interest, based on the tentative assumption that the current chord candidate is an available chord for that bar of melody. In doing so, the block 16-1 produces melodic nonharmonic tone identifiers corresponding to respective melody notes outside the pitch content of the current chord candidate, and saves these identifiers in an array {RSi}. Block 16-2 initializes a pointer rsc to the array.

Blocks 16-3 to 16-7 examines the array {RSi} to see whether the array contains an illegal, invalid or unavailable melodic nonharmonic identifier. If this is the case, the tentative assumption initially made that the current chord candidate is an available chord must be withdrawn.

More specifically, block 16-3 checks as to whether an element (rsc-th element) of the array is an illegal melodic nonharmonic tone. If this is correct, then the original assumption is wrong so that block 16-7 declares that the current chord candidate is an unavailable chord.

Block 16-4 is initiated when RSrsc is a valid melodic nonharmonic tone and increments rsc to test the next element of the array in Block 16-3. RSNO in block 16-5 is the total number of the elements of the array. If $rsc \leqq RSNO$, this returns to Block 16-3. $RSNO < rsc$ is satisfied when all elements of the array are valid or available nonharmonic tones so that block 16-6 confirms or determines that the current chord candidate pointed to by CCC is an available chord. This determination is saved by storing, for example, data or flag having a value of "available" into a melody location specified by $(100 \times ROOT + TYPE)$ wherein:

$$ROOT = (CCC\text{-}T) \bmod 12$$

$$TYPE = Int\{(CCC\text{-}1)/12\}$$

(Classify melody notes)

Figure 17:
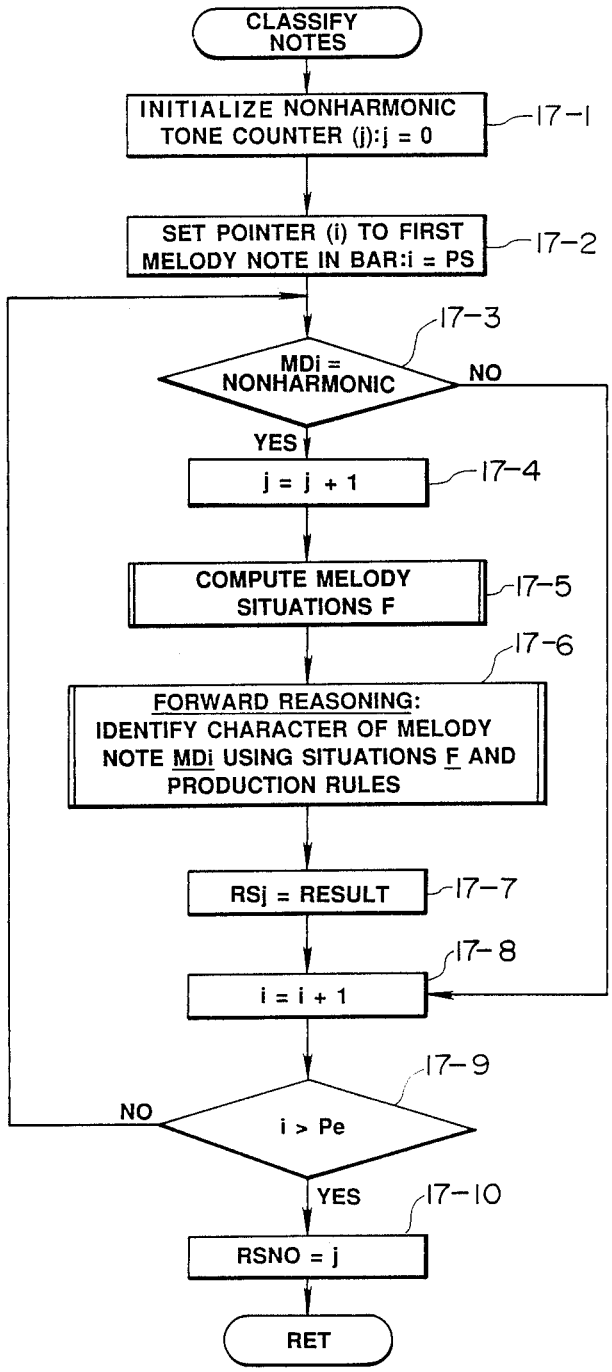
FIG. 17 is a flowchart of classifying melody notes under investigation.
Figure 18:
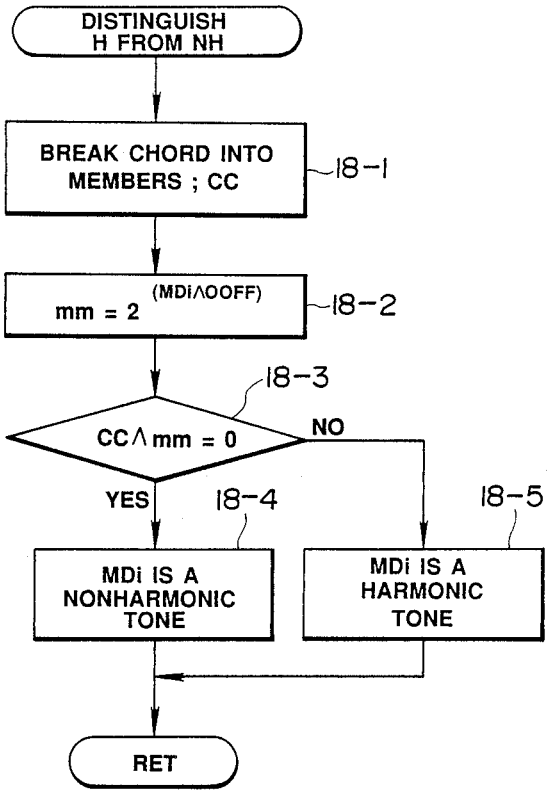
FIG. 18 is a flowchart of distinguishing between harmonic and nonharmonic tones.

FIG. 17 shows a detailed flowchart of block 16-1 in FIG. 16 for classifying melody notes based on the tentative assumption that the current chord candidate is an available chord.

Block 17-1 initializes nonharmonic tone counter j. Block 17-2 set a melody note pointer i to the first melody note in a bar of interest.

Blocks 17-3 to 17 9 form an iterative loop in which the system classifies all melody notes in a bar of interest by using the current chord candidate as an available chord for that melody bar.

More specifically, if a melody note MDi can be labeled with nonharmonic tone, i.e. if the pitch of that melody note is outside the pitch content of the current chord candidate (block 17-3), nonharmonic tone counter j is incremented (17-4), and functions F representing the local melodic situational features around the melody note just labeled with a nonharmonic tone are evaluated (17-5). Then, forward reasoning based on the production rules is execused to deduce the type or identity of that nonharmonic tone labeled melodic note MDi and stores it into RSj (17-7). Melody note number i is incremented (17-8) and the process is repeated until Pe is encountered (17 9). As a result, a row of types or identities of all nonharmonic labeled melodic notes in a bar of interest have been stored in an array {RSj}. Then block 17-10 stores into RSNO the total number of nonharmonic labeled melody notes in the bar of interest.

FIG. 17 shows the details of 17-3 in FIG. 17 for distinguishing between harmonic and nonharmonic tones for a melody note MDi, based on the assumption that the current chord candidate is an available or valid chord for a melody bar (in which the above MRi is included).

Block 18-1 derives a chord pitch content from chord data specifying the current chord candidate by its root and type. The chord pitch content i.e., chord constituent pitches, the members of chord are represented by 12-bit data CC in which LSB bit is for "C", 2nd bit for "C#" and so on and MSB bit for "B", and bits of "1" indicate the presence of corresponding pitches. For example, a chord of C major triad has a pitch content of C, E and G which is represented by:

```
000010010001
    G   E   C
```

Block 18-2 converts a melody note pitch data MDi to mm having the same data format with the chord pitch content data C.

Block 18-3 checks whether $CC \wedge mm = 0$ or not, that is whether a melody note MDi is outside the pitch content of the current chord candidate, if this is met, MDi is labeled with a nonharmonic tone (18-4). otherwise it is labeled with a harmonic tone (18-5) because, for the present, it is assumed that the current chord candidate is an available chord for a melody surrounding and including MDi.

FIGS. 19 to 27 illustrate details of block 17-5 in the flowchart of FIG. 17 for evaluating local melodic situational functions F near, around and associated with a nonharmonic tone labeled melody note. In the discussion to follow, a nonharmonic tone labeled melody note will be referred to simply as a nonharmonic tone while a harmonic tone labeled melody note will be called a harmonic tone.

Figure 19:
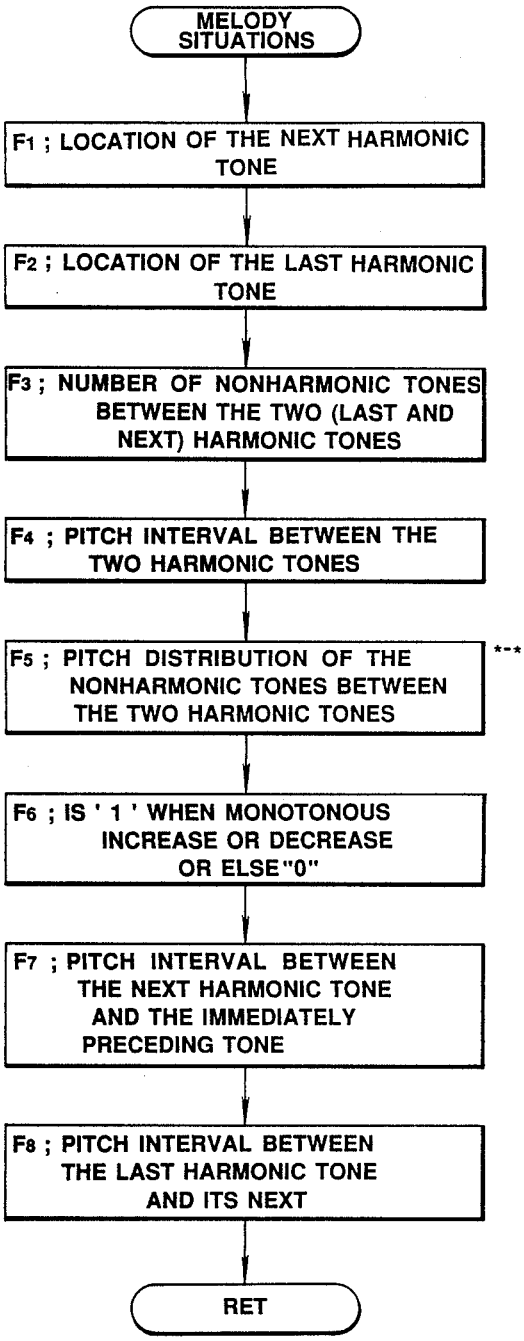
FIG. 19 is a flowchart of evaluating a melodic line or stream of notes, or melody situations around a nonharmonic tone under investigation, also illustrating situational functions evaluated from a melody example.
Figure 19:
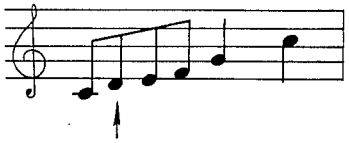
Figure 20:
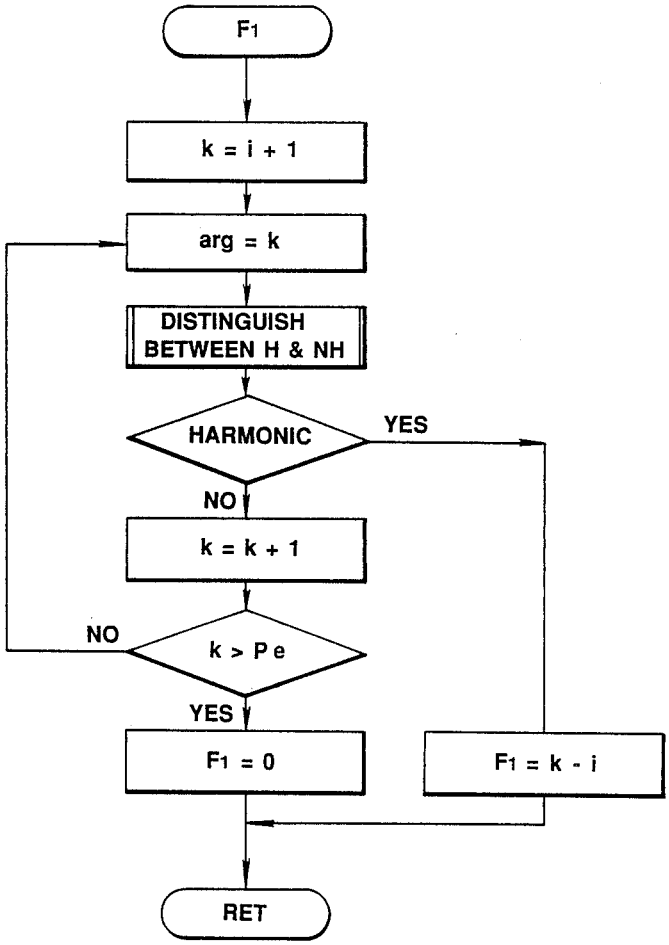
FIGS. 20 to 27 are detailed flowcharts of computing and saving the situational functions.
Figure 21:
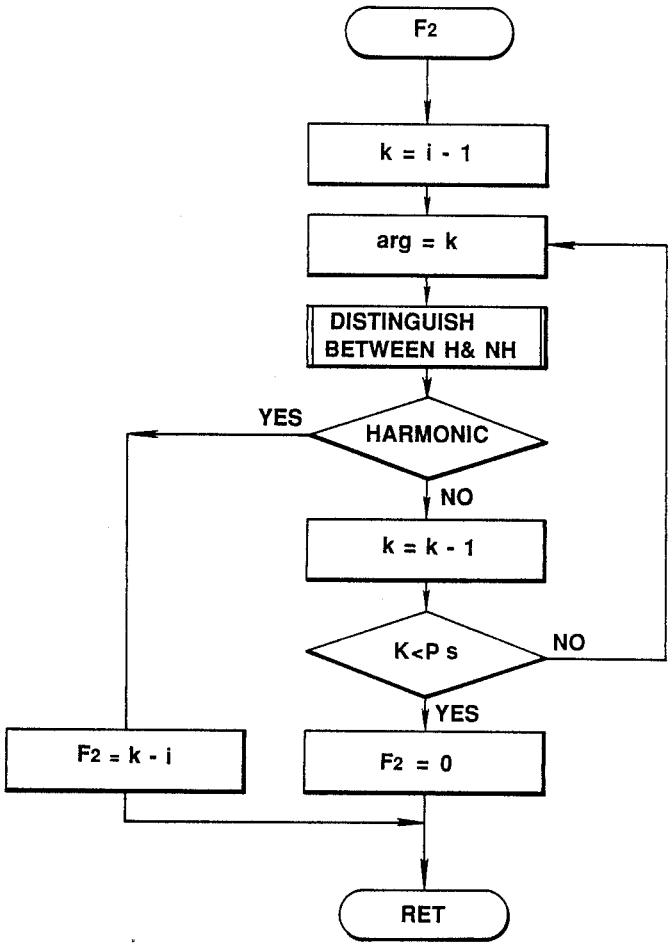
Figure 22:
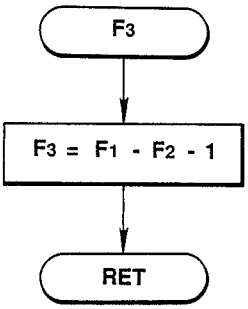
Figure 23:
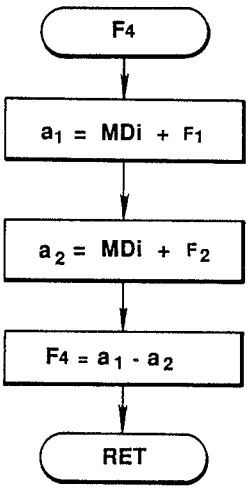
Figure 24:
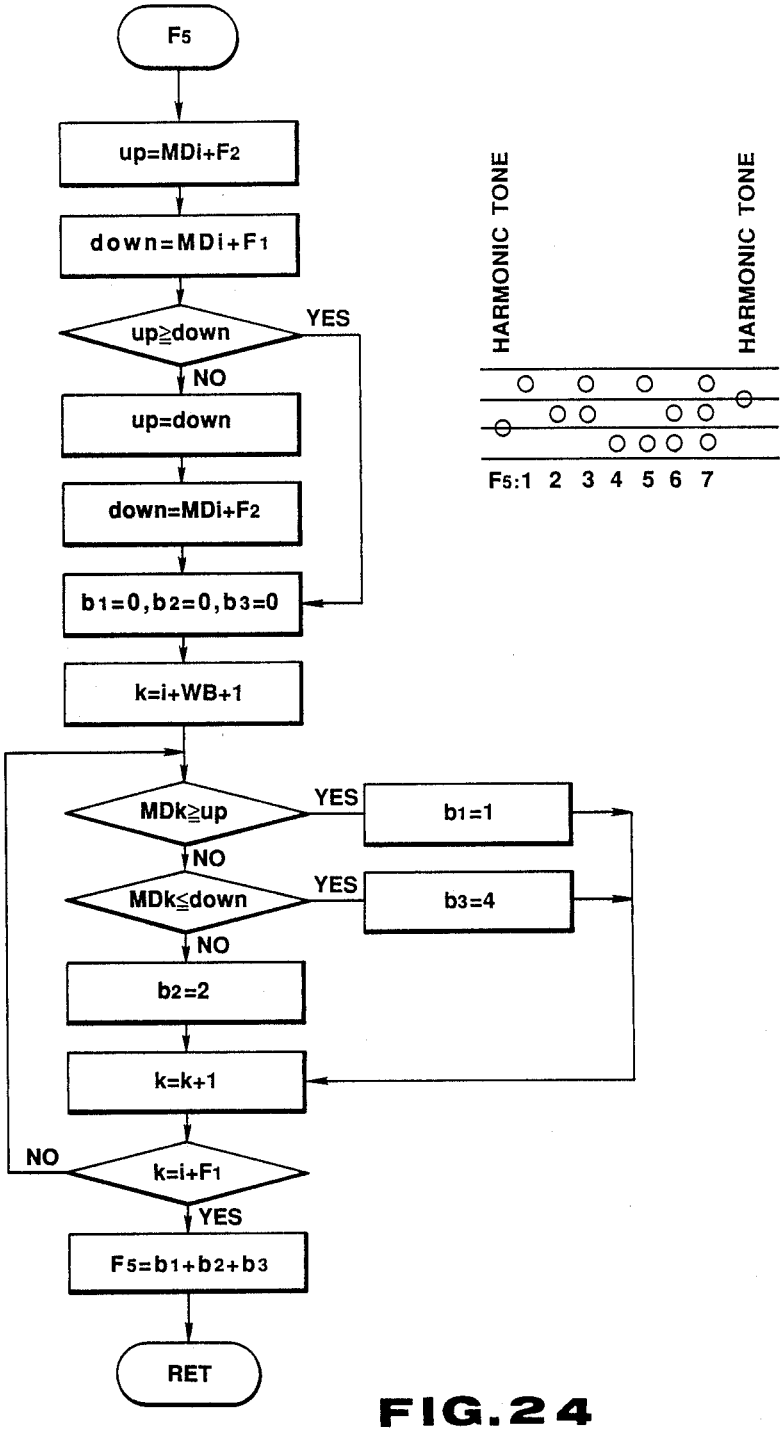
Figure 25:
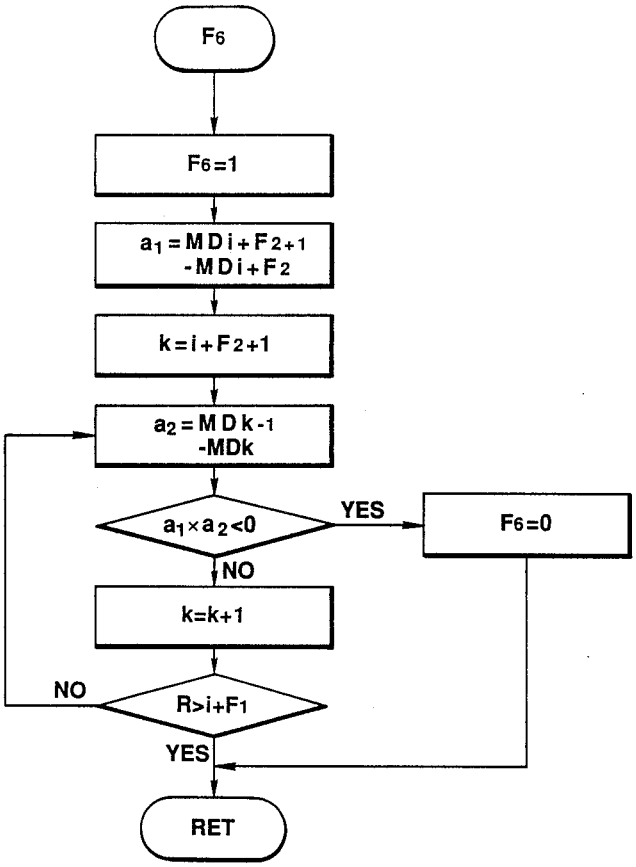
Figure 26:
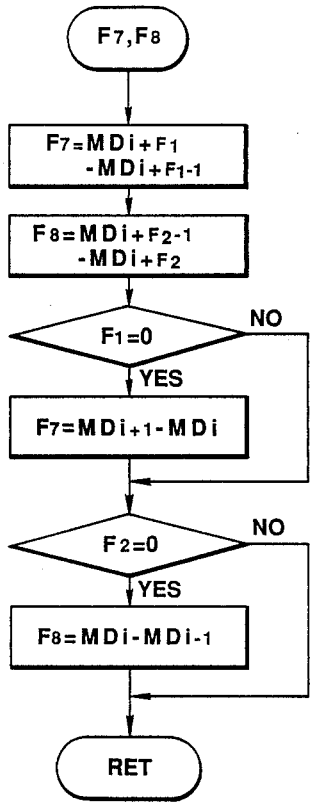
Figure 27:
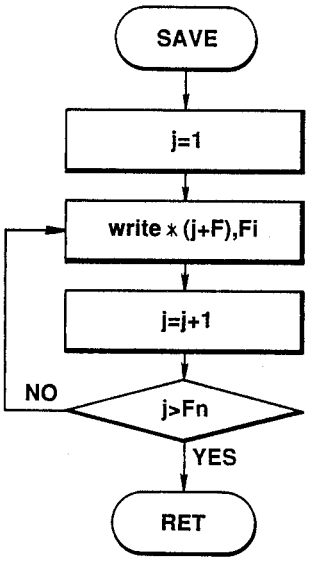

In FIG. 19, an example of situational functions is shown. The illustrated functions F include:

- F1: location of the next harmonic tone relative to the note (nonharmonic tone) under consideration,
- F2: location of the last harmonic tone,
- F3: number of harmonic tones between the last and next harmonic tones,
- F4: pitch interval between the last and next harmonic tones,
- F5: nonharmonic tone pitch distribution between the next and last harmonic tones,
- F6: whether the melody tone pitch changes monotonously from the last to the next harmonic tone,
- F7: pitch interval between the next harmonic tone and the immediately preceding tone, and
- F8: pitch interval between the last harmonic tone and the next tone.

Further, data as to whether the beat is weak or strong and also data for classifying tone durations may be added to the set of functions F. The calculation of the individual functions F is obvious from the detailed flowcharts of FIGS. 20 to 27, and further description is omitted.

Figure 28:
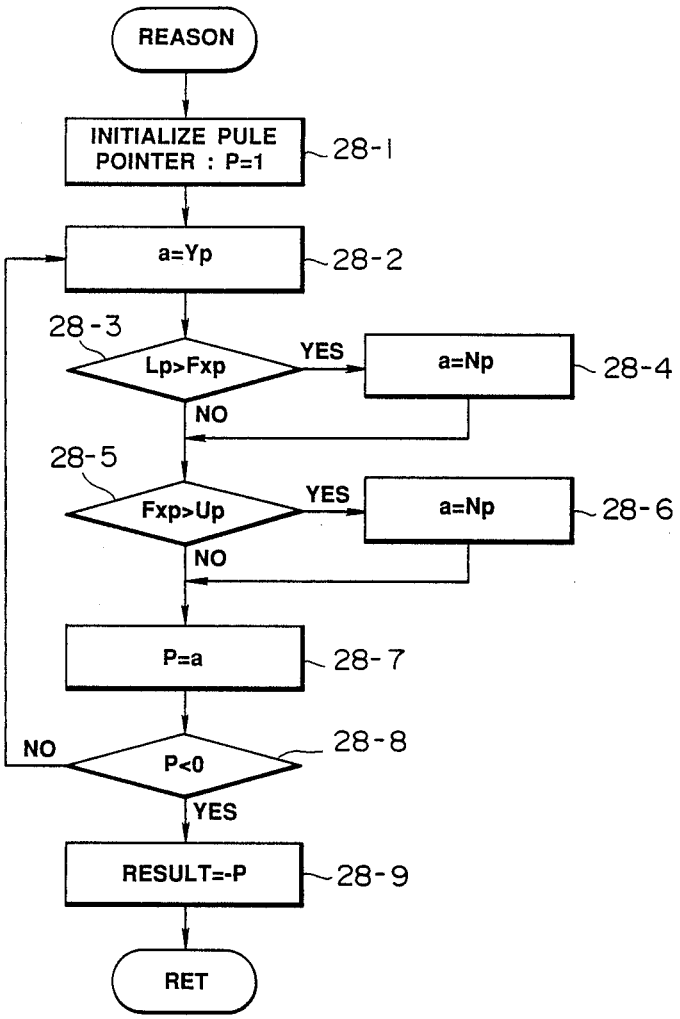
FIG. 28 is a flowchart of reasoning or deducing a character or identity of a nonharmonic tone by applying production rules to situational functions of a melody.

FIG. 28 shows details of 17-6 for forward reasoning. Block 28-1, a rule number pointer P is set to "1" so as to point to a root rule among the production rules. Then, a check is done as to whether a condition part of the rule designated by the rule pointer P is satisfied ($Lp \leqq Fxp \leqq Up$). If it is satisfied, data Yp of an affirmative consequent part of the rule is used as a pointer to the next rule. If the condition part is not satisfied, data Np of a negative consequent part of the rule is used as a pointer to the next rule. However, if data Yp or Np has a negative value, the final conclusion has been reached. In this case, the absolute value of the data (i.e, $-Yp$ or $-Np$) is set as a nonharmonic tone identifier in a conclusion register. According to the flow, if the condition $LP > Fxp$ in the block 28-3 or condition $Fxp > Up$ in the block 28-5 is satisfied, the condition part $Lp \leqq Fxp \leqq Up$ of the rule P is false, so that data Np of the negative consequent part of the rule is set in a (28-4 and 28-6). Otherwise, the condition part is satisfied, so that data Yp of the affirmative consequent part of the rule P is set in a (28-2). The set data a is substituted into P (28-7). If P is positive, the flow goes to the check of the next rule. If P is negative, $-P$ is used as the result of classification of nonharmonic tone (28-8 and 28-9).

Production of Available Chords (EX2)

Description will now turn to a second exemplanary mode of the system of FIG. 4 for production of available chords for a melody. In the second mode, there are provided three different modules for determining or testing the availability of chord; one of the three modules is identical with that as discussed in the section of "production of available chord (EX1)". This module will be referred to as a nonharmonic analysis module. Newly added two modules comprises a matching module and a scale test module.

These three modules are pipelined or coupled in a series such that the matching module is placed first or top, the nonharmonic analysis module is placed next or middle and the scale test module is placed last or bottom. The process of the system goes from the top module to the bottom. The top or first module tests chord candidates for availability and passes the available chords to the next or middle module. For the next or second module, those available chords passed from the first module are chord candidates. So the second module test these candidates and pass new available chords to the next, here the last module which also takes them for candidates and test them for availability. Available chords from the last module are, therefore, systematically or finally available chords. Each module can be regarded as a chord filter. What is important is the characteristics of each chord filter.

The top chord filter, i.e., the matching module evaluates a degree of matching in pitches between a melody segment and each chord candidate.

If the evaluated degree of matching is lower than a threshold level, the matching module rejects the corresponding chord candidate. Thus, only those chord candidates with a degree of matching greater than the threshold level passes through the matching module.

With an appropriate choice of the value of the matching threshold level as well as a suitable evaluation function for a degree of matching, the first module serves as a preliminary chord test device which provides a considerable reduction in time required by the entire system for determining and producing all available chords. Nevertheless, it will not miss or reject those chords which can be deemed available by the test modules to follow which modules test chord candidates for availability with a good knowledge of music.

The last i.e., scale test module generates note scales from each chord candidate. For this purpose, the scale test module considers possibilities of three different harmonic functions, tonic, dominant and subdominant. For example, if a chord candidate is a major triad, the scale test module will generate, e.g., three major scale, one having a key note, first scale degree or tonic of the same pitch (pitch class) as the root of the chord candidate, the second scale with a perfect fifth degree or dominant having the same pitch as the root of the candidate, and the third scale with a perfect fourth degree or subdominant having the same pitch as the root of the chord candidate.

Having generated note scale depending on a chord candidate, the scale test module matches the pitch content of a melody segment against the pitch content of each note scale. If a note scale is found which includes all pitches of the melody segment, chord candidate from which that note scale was produced is determined available. A chord candidate is determined unavailable when all scales generated therefrom have failed.

Figure 29:
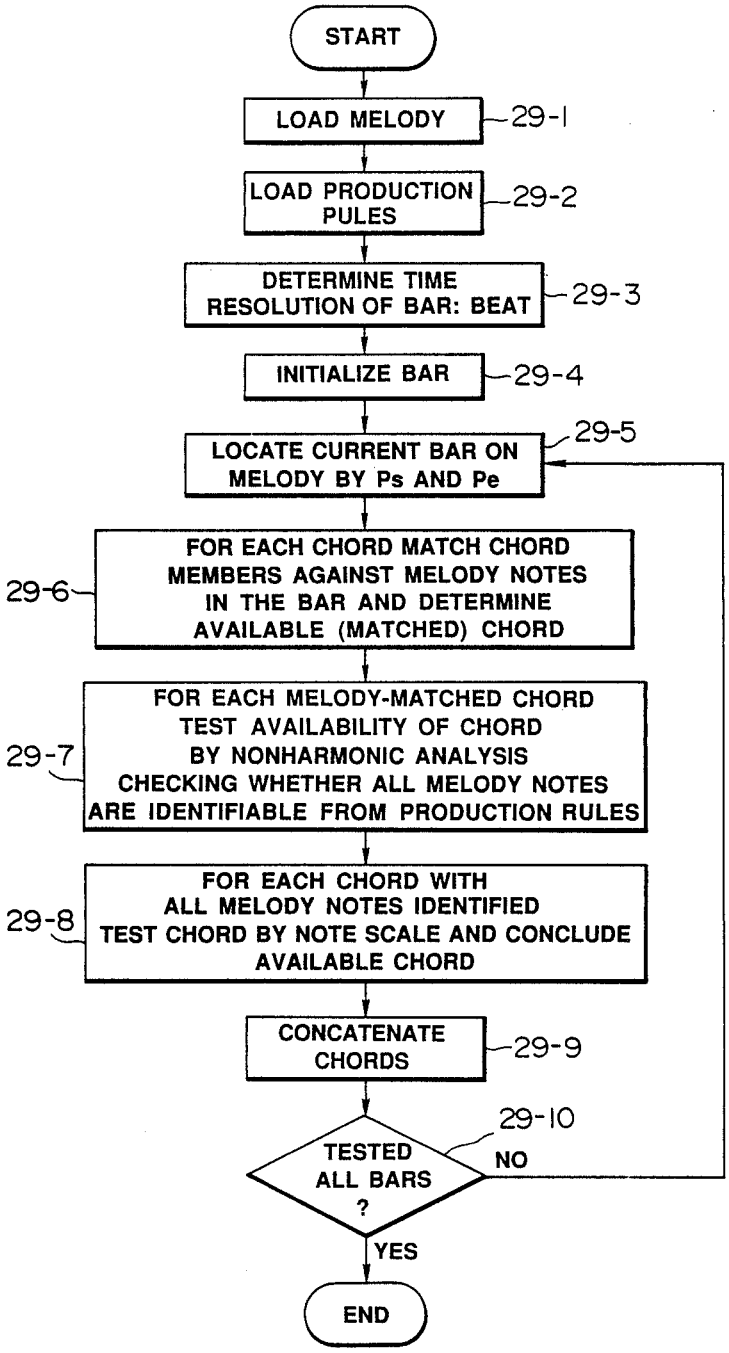
FIG. 29 is a flowchart showing another mode of operation of the apparatus in FIG. 4 for producing available chords for a given melody.

The second mode of the system discussed above is illustrated in a general flowchart of FIG. 29.

In comparison with the first mentioned general flowchart of FIG. 5, the present flowchart of FIG. 29 has an iterative loop formed by blocks 29-5 to 29-10 in which the system produces available chords for each melody bar. The loop starts with a current melody bar locating block 29-5 corresponding to the block 5-4 of FIG. 5 and then goes to a matching block 29-6 which is not present in FIG. 5 and serves as a preliminary chord test block in the system. For each chord candidate (not having been tested before), the block 29-6 evaluates a degree of pitch-matching against melody notes forming a melody bar of interest by using bar boundary data Ps, Pe obtained in 29-5 and time resolutional data BEAT already obtained in block 29-3. BEAT indicates a musical time resolution of a bar and has a numeric value of a multiple of elementary time durations equivalent to the length of a bar. Block 29-6 passes to the next block 29-7 only those chord candidates with a relatively high degree of matching against a bar melody. The block 29-7 has a nonharmonic analysis or classifying function which may be the same as the block 5-8 of FIG. 5, depending on the production rules involved (see 29-2). In the block 29-7, chords passed from the matching block 29-6 are tentatively assumed to be available chords. Then, the block 29-7 does the job of analyzing a melody bar of interest based on the assumption with respect to each chord passed from the block 29-6. Only when all notes in the melody bar are successfully identified as a valid tone, the associated chord is determined (confirmed) available. Only those chords determined available by the block 29-7 are passed as chord candidates to a scale test block 29-8. In block 29-8, scales are generated from each chord candidates and the pitch content of each scale is matched against that of a melody bar of interest. If the pitch content of melody bar is a subset of the pitches (pitch classes) of a scale generated from a chord candidate, then that chord candidate is determined available. Block 29-9 concatenates available chords in a series of melody bars to produce a two dimensional array of avaiable chords. Then, the next bar is selected and the process (29-5 to 29-9) repeats as many as there are bars. Block 2-10 has a stopping criteria for the interactive loop. The stopping condition may be expressed by:

$$\text{bar} > \text{END}$$

wherein END is given by;

$$\text{END} = \sum_{i=0}^{MDNO} MRi/\text{BEAT}$$

wherein:

MDNO=Total number of melody notes

MRi=i-th melody note duration

BEAT=time resolution computed in the block 29-3.

Details of blocks in FIG. 29 will now be described. However, some blocks or part thereof have the same functions as corresponding components already discussed in a section of "production of Available Chords (EX 1)". These blocks or parts will be omitted in the description to follow.

(Matching)

Figure 30:
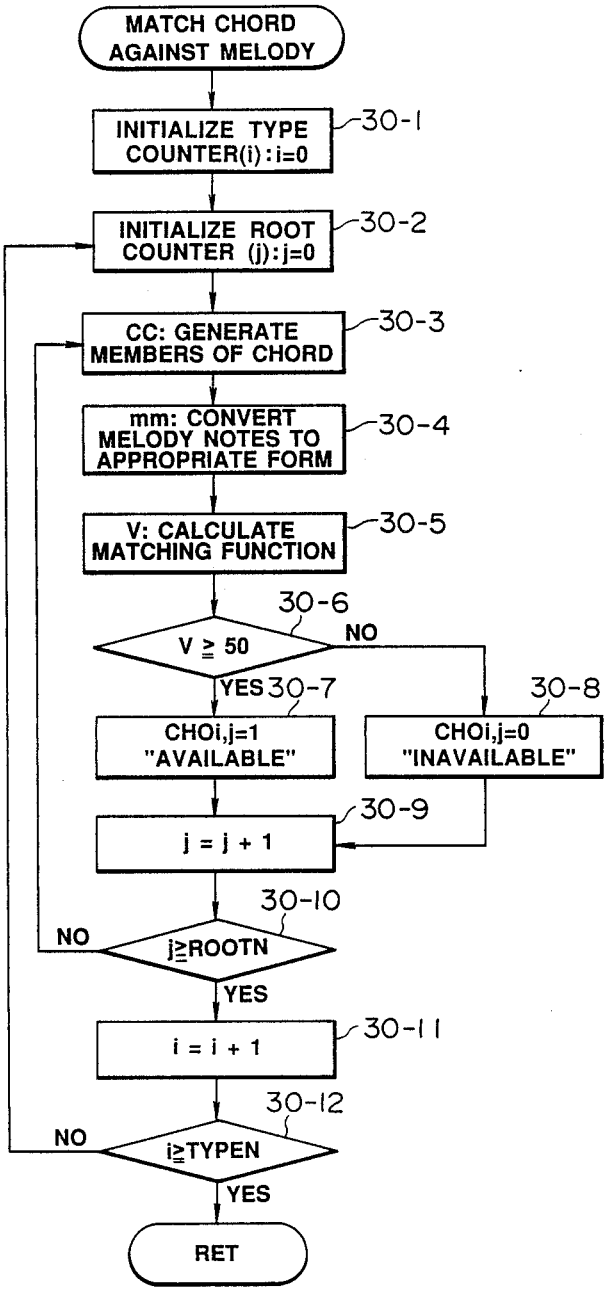
FIG. 30 is a flowchart of matching melody notes against chord notes or members of each chord candidate for determining available or matched chords, if any and as many as there are, for a line formed by the melody notes employed in the matching.

FIG. 30 shows a detailed flowchart of block 29-6 in the general flowchart of FIG. 29 for matching melody notes in a bar of interest against each chord candidate to determine available chords.

Block 30-1 initializes a chord type counter i. Block 30-2 forms an entry block of an iterative loop of blocks 30-2 to 30-12 which repeats as many chord types as there are. In the block 30-2, a chord root counter j is initialized. Block 30-3 is placed on the front of an internal iterative loop of blocks 30-3 to 30-10 which repeats as many chord roots as there are. Block 30-3 generates a chord candidate (called the current chord candidate) pointed to by a type count i and root count j. The chord candidate is represented by 12-bit chord member data CC indicative of the pitch content thereof. For example, if the current chord candidate is a minor triad chord of A, a corresponding chord member data (chord pitch content data) is given by:

```
001000010001
B A G FE D C
```

Block 30-4 generates data mm having the same data format as CC and representative of a pitch content of melody notes which are present in a melody bar of interest from Ps-th to Pe-th melody notes on the entire melody. Hence, melody pitch content data mm can be expressed by:

$$mm = 2^{(MDps \wedge 00ff)} \vee \ldots\ldots \vee 2^{(MDpe \wedge 00ff)}$$

wherein:

MDi=pitch of i-th melody note $\wedge$=logic conjunction (AND)

$\vee$=logic disjunction (OR)

For a meldoy of "do", "re" "mi" , for instance, the melody pitch content data mm is given by:

```
000000010101
        .E D C
```

Block 30-5 evaluates a degree of pitch-matching of the current chord candidate against a melody bar of interest. Evaluation function V representative of a degree of pitch-matching may be computed by:

$$V = \frac{\text{No. of Pitches Common to Melody and Chord}}{\text{No. of Melody Note Pitches}} \times 100(\%)$$

In the formula, the numerater is obtained by counting bits of "1" in (cc mm) and the denominator is given by counting bits of "1" in mm.

Block 29-6 checks as to whether the evaluated degree of matching is higher than or equal to a predetermined threshold level, here 50 percent. The purpose of this check is to accept as "available" those chord candidates with a relatively high degree of pitch-matching against a melody of interest and to reject as "unavailable" those chord candidate with a relatively low matching degree. In doing so, block 30-7 in response to the success in the test 30-6, stores "1" indicative of availability into a register CHOi,j while block 30-8 otherwise stores "0" indicative of unavailability into a register CHOi,j in response to the failure of the test 30-6. CHOi,j is pointed to by chord type variable i and chord root variable j, {CHOi,j} for i=0 to TYPEN-1 and for j=0 to ROOTN-1 forms a chord array.

Block 30-9 increments chord root variable or count j in order that the next chord candidate will be tested for availability. When all chord candidates with a type i have been tested, check 30-10 is satisfied. Then, block 30-11 is initiated to increment type number i. When all chord candidates for i=0 to TYPEN-1 and for j=0 to ROOTN-1 have been tested, then i≧TYPEN is satisfied in a stopping block 30-12. At this point, chord array {CHOi,j} comprises a first group of available chords (CHOi,j=1) and a second group of unavailable chord (CHOi,j=0).

As will be more apparent, chord data CHOi,j with "0" or "unavailable" will be neglected or skipped in the process to follow. Only chord data CHOi,j with "1" or "available" up to now will be further tested for systematic availability.

(Non-harmonic Analysis)

Figure 31:
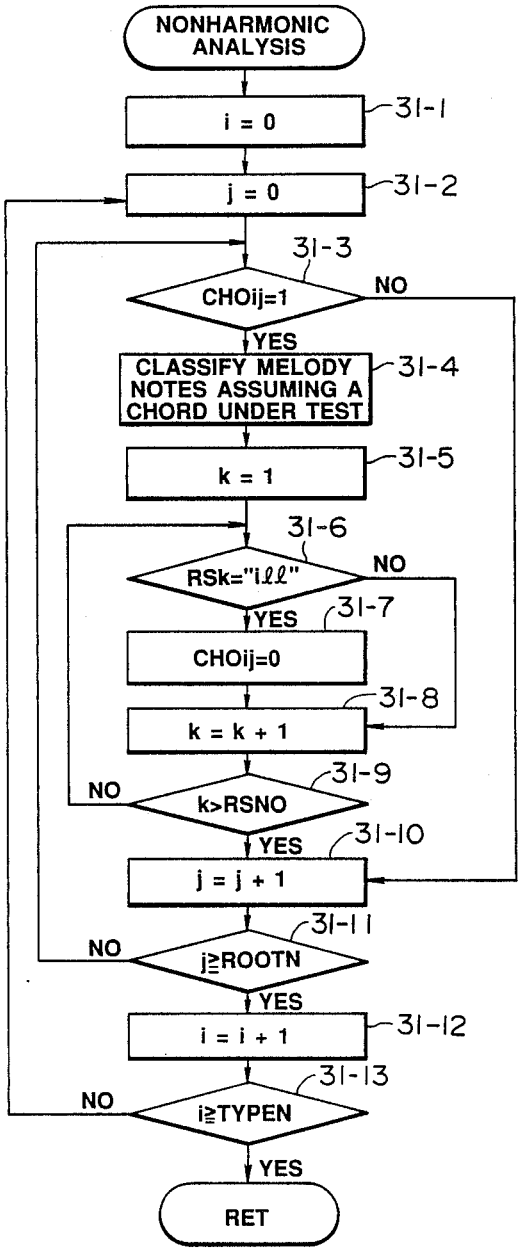
FIG. 31 is a flowchart of a nonharmonic analysis of a melody involving identification of a character or harmonic-nonharmonic function of each note of the melody, and determination, from the result of the character examination, of available chords, if any and as many as there are, for the melody.

FIG. 31 shows a detailed flowchart of the block 29-7 in FIG. 29 for testing availability of chord candidates by a nonharmonic analysis based on the tentative assumption that each chord candidate is an available chord. For the flowchart of FIG. 31, the chord array {CHOi,j} serves as a source of chord candidates. All chords in the array are scanned (see blocks 30-1, 31-2, 31-10, 31-11, 31-12, 31-13 and associated return paths), it should be noted, however that only those chords with CHOi,j=1 are examined for availability while other chords with CHOi,j=0 are skipped or jumped without changing the unavailable or rejected value "o" of CHOi,j. A body of nonharmonic analysis is formed by blocks 31-4 to 31-9. These blocks are skipped when CHOi,j=0 as seen in block 31-3 for checking the value of CHOi,j and a jump path from block 31-3 to block 31-10 for merely incrementing a root number j for the scanning of the chord array {CHOi,j}. Only those chords with CHOi,j=1 in the array are examined in the body of nonharmonic analysis 31-4 to 31-9 because they are chord candidates for the nonharmonic analysis body. In the examination, CHCi,j="1" is selectively changed to CHOi,j="0". This is shown in block 31-7 in a loop of 31-6 to 31-9. The loop repeats as many nonharmonic labeled melody notes as there are in a melody bar of interest, and checks to see whether an illegal or invalid nonharmonic tone is contained in these melody notes (See block 31-6), and if this is the case, the block 31-7 clears a corresponding CHOi,j to "0". Systematically, this check is to see whether the tentative assumption made in block 31-4 that a chord candidate is an available chord is wrong in fact. Block 31-4 has classified melody notes in a melody bar of interest based on this assumption. Details of the block 31-4 is shown in a flowchart of FIG. 17 which was fully described and discussed before. Further description is omitted here.

(Generate and test scale)

Figure 32:
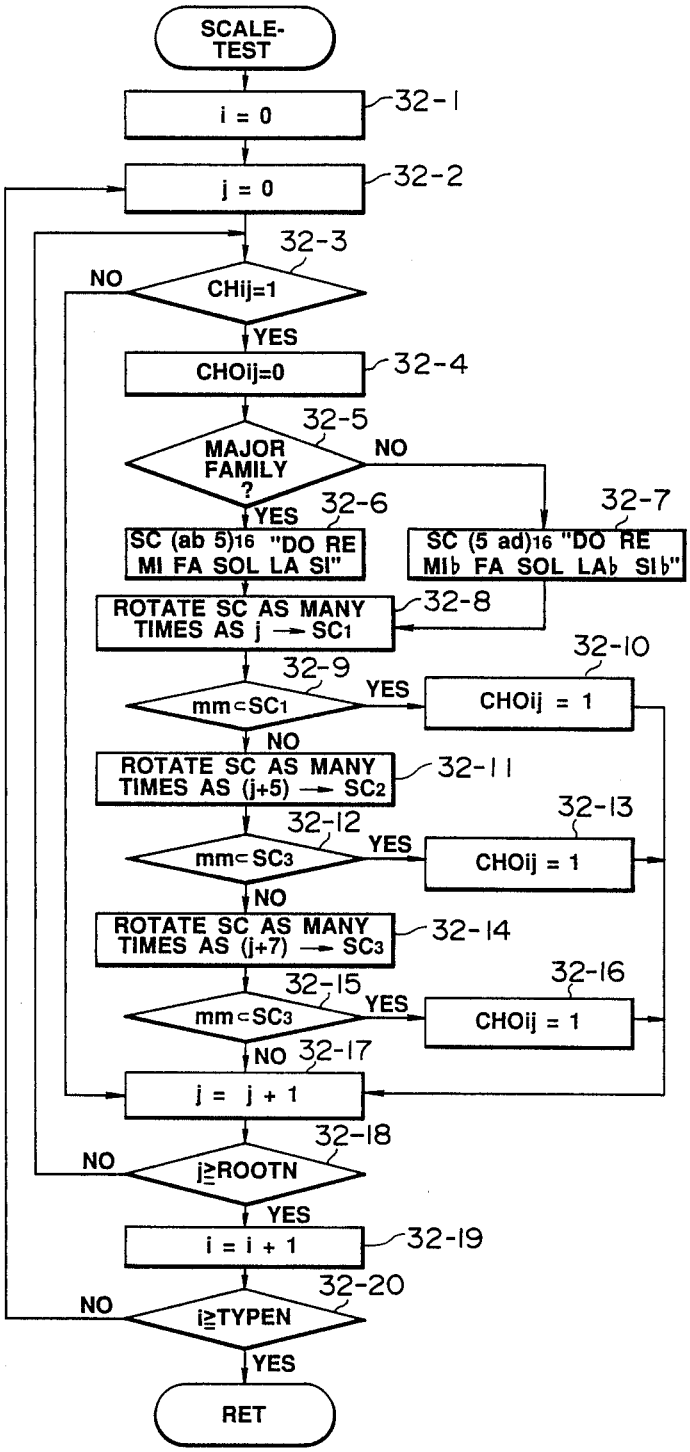
FIG. 32 is a flowchart of a scale-test of a melody involving production of note scales from a chord candidate and, matching the melody notes or pitch contents against those of each scale for determining the availability of the chord candidate for the melody.

FIG. 32 shows a detailed flowchart of the block 29-8 in FIG. 29 for determining available chords by generating and test note scales.

The flow of FIG. 32 scans the chord array {CHOi,j} passed over from the nonharmonic analysis block 29-7 in a similar manner to the flow of the latter shown in FIG. 31; see comparable blocks 32-1, 32-2, 32-17 to 32-20 and associated return paths. Also, the flow of FIG. 32 examines those chords only with CHOi,j=1; see a comparable block 32-3 and a jump path to block 32-17 for merely incrementing a root number j for the scanning of chord array {CHOi,j}.

Blocks 32-4 to 32-10 form a body of generate-and-test scale flow (called GTS) in which the system generates note scales from a chord candidate (called the current chord candidate) and tests these note scales for determining the availability of the current chord candidate for a melody bar of interest.

According to GTS, a plurality of different diatonic scales are generated from the current chord candidate. The type or mode of each diatonic scale is made to depend on the type, class or family of the current chord candidate (see blocks 32-5 to 32-7). If the current chord candidate belongs to a family of a major chord, a major diatonic scale is generated (32-5 and 32-6). If the candidate belongs to a class of a minor chord, a minor diatonic scale is generated (32-5 and 32-7): In the illustrated example, a natural minor scale is generated. Other minor scales such as harmonic minor and melodic minor scales can also be generated (and tested) if desired.

At this point, scale data SC represents a scale with a key of C, i.e., major or minor scale of C irrespective of the root of the current chord cadidate. That is, 12-bit scale data SC is either hexadecimal ab5 (for major) or 5ad (for minor).

According to GTS, key, key-note, tonic or first degree of each scale is made so as to depend on the root of the current chord candidate. In the illustrated example, three possible scale relationships are considered relative to a chord. First possible relationship is such that the tonic of a scale has the same pitch (pitch class) as the root of chord. This is established by block 32-8. Second possible relationship is such that the dominant of a scale has the same pitch as the root of chord. Block 32-11 makes such a scale. The third possible relationship is such that the subdominant of a scale has the same pitch as the chord root. This is done in block 32-14.

Scale data SC1 with the first possible relationship is tested first in block 32-9 to see whether mm ⊂SC1, that is whether the pitch content of melody notes is a subset of the pitch content of scale. If this is satisfied, CHOi,j of the current chord candidate is changed from "0" (see block 32-4) to "1" in block 32-10, otherwise CHOi,j remains "0".

Then, scale data SC2 with the second relationship is tested in block 32-12 to see mm ⊂SC2, and if satisfied, CHOi,j is changed to "1" indicative of the availability of the current chord for a melody bar of interest. Otherwise CHO still remains "0".

Finally, scale data SC3 with the third relationship is tested in block 32-15 in a similar manner and if satisfied, CHOi,j is changed to "1" in block 32-16, otherwise, CHOi,j remains "0" indicative of unavailability of the current chord.

When the process shown in FIG. 32 has finished, the chord array {CHOi,j} stores available chords for a melody bar of interest by CHOi,j=1. These available chords are systematically or finally available chords as seen from the general flowchart of FIG. 29.

The flow of FIG. 32 may be modified in such a manner that a variable number of scales are generated according to a chord candidate of interest.

(Concatenate chords)

Figure 33:
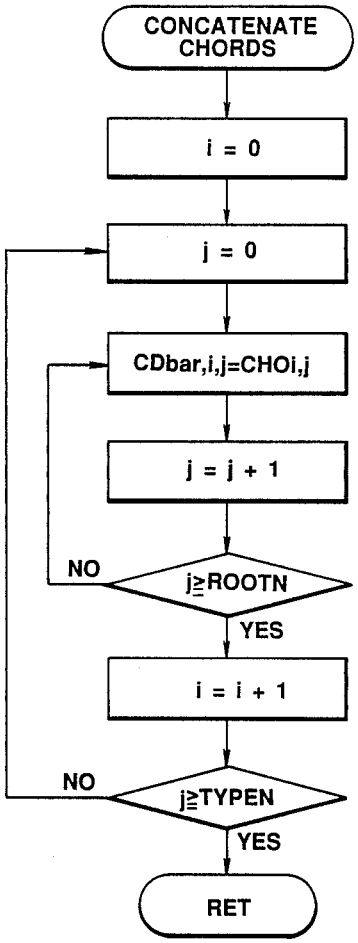
FIG. 33 is a flowchart of concatenating available chords in a series of bars to produce a two dimensional array of chords for the entire melody.

FIG. 33 shows details of the block 29-9 in FIG. 29 for concatenating available chords in a direction of melody. At an entry to the flow of FIG. 33, the available chord array {CHOi,j} has stored available chords by CHOi,j="1" as well as unavailable chords by CHOi,j="0" for a melody bar of interest. This bar number has been stored in a bar register (not shown in FIG. 29). There is provided another chord array {CDbar, i, j} for storing available chords along a melody, one bar after another. The purpose of the flow of FIG. 33 is to move the chord data CHOi,j to CDbar, i,j. The notation of {CDbar, i, j} appears that the array {CDbar, i, j} is a three dimensional array. However, a combination of i or type and j or root identifies a chord. Thus, the array {CDbar, i.j} can be rewritten to {CDbar, chord} which is a two dimensional array. Available chord data may be stored in any other data format or structure. For example, a two dimensional array {ACbar, x} can be made such that each element thereof indicates an available chord, those elements with a suffix of the same "bar" indicates all available chords for "bar", and x indicates an available chord number found in "bar".

(Analysis results)

FIG. 34 shows a melody analysis obtained by the system discussed in the foregoing. Operational conditions were as follows. Triadic major and minor chords were tested for a melody material shown in FIG. 7, "Ode to joy" from Beethoven's Ninth Symphony. Production reles shown in FIG. 9 were used.

In FIG. 34, each chord array {CHOi,j} is shown by a 2×12 matrix of zeros and ones wherein "1" indicates an available chord and "0" indicates an unavailable chord. "Matching", "Nonharmonic Analysis" and "Scale Analysis" correspond respectively to blocks 29-6, 29-7 and 29-8 in the flow of FIG. 29.

Another example is shown in FIG. 35. The melody material under analysis is also shown by Melody (2). The nonharmonic analysis block 29 7 rejected a major triad of C sharp. In testing the chord, the block 29-7 took the first melody note "do" for a melodic nonharmonic tone and then found the nonharmonic tone "do" leaped or jumped to "fa" of the second note, thus detecting an illegal movement because of an incorrect chord of C sharp major.

The scale analysis block 29-8 rejected chords of C major and F major. In testing chord of C major, the melody note of "la flat" was not found in either of the three sales:

"do, re, mi, fa, sol, la, ti" (tonic)
"sol, la, si, do, re, mi, fa#" (dominant)
"fa, sol, la, ti♭, do, re, mi" (subdominant).

For the chord of F major, the meldoy note "la♭" was not found in either of the three scales:

"fa, sol, la, ti♭, do, re, mi"
"do, re, mi, fa, sol, la, ti"
"ti♭, do, re, mi♭, fa, sol, la"

Selection of Chords

Each system discussed in the foregoing as Exs. 1 and 2 has produced available chords as many as possible for each segment (e.g., bar) of melody.

The description will now turn to a system which can be combined with either of the systems stated and automatically selects one of the available chords for each bar of melody.

Figure 36:
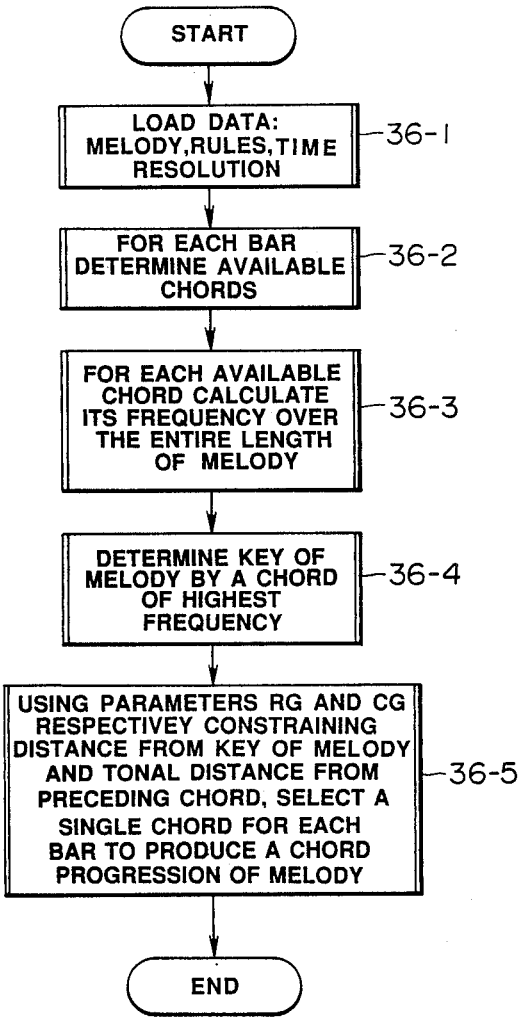
FIG. 36 is a flowchart of a further mode of operation of the apparatus in FIG. 4 involving determination if available chords for a given melody and selection of one of those chords for each bar.

FIG. 36 illustrates a general flowchart of a combined system, which is also incorporated in the arrangement of FIG. 4.

In FIG. 36, blocks 36-1 and 36-2 may be implemented by the flowchart of FIG. 5 or that of FIG. 29 though not restricted thereto. What is required for the block 36-2 is to produce available chords; there are two or more available chords for all or partial melody segments.

Blocks 36-3 to 36-5 to follow comprise an entire process of selecting chords. Block 36-3 produces a frequency distribution or histogram of available chords determined by the block 36-2 with respect to the entire melody comprising a plurality of bars or segments, each having a musical time during which a chord can last without changing the harmony.

Block 36-4 references the histogram of available chords and finds a chord which can be regarded as a tonic chord of the entire melody. A version of block 36-4 detects a chord with the highest frequency as a tonic chord or key of melody. In a broader aspect, the chord or information detected by the block 36-3 provides a reference or center at a relatively higher leveled tonal structure in music. If desired, the block 36-3 and 36-4 may be arranged such that the block 36 3 produces a histogram of available chords with respect to each portion (e.g., phrase) of the entire melody, and block 36-4 detects a tonic or reference chord with respect to each portion. A user may designate or locate each portion of the music by a suitable input unit. This arrangement may be useful for melodies having a change of key (modulation or tonal fluctuation) in their course.

Block 36-5 selects one of the available chords for each segment (e.g. bar) of the entire melody thereby to produce a single progression or succession of chords for the entire melody. Block 36-5 has suitable selection criteria for chords, using a reference chord from the block 36-4 and a contraint or constraints externally provided. An example will be described later in more details.

Figure 37:
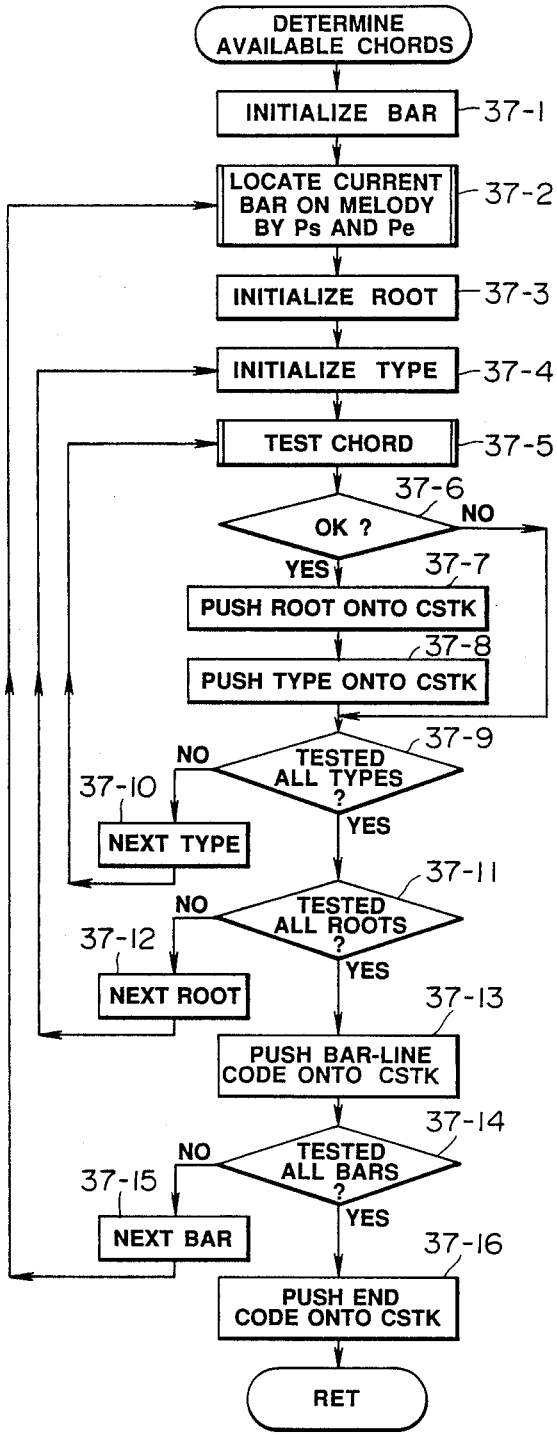
FIG. 37 is a more detailed flowchart of a portion of FIG. 36 for determining available chords.

FIG. 37 illustrate a more detailed flowchart of the block 36-2 for producing available chords for each segment (e.g. bar) of a melody. The illustration is merely to show an available chord array which may be suitable for (though not restricted for) the chord selection process to follow. A stack CSTK represents the available chord array. The illustrated stack CSTK is a push-down stack or a First-in First-out (FIFO) buffer. The first two addresses of CSTK are to store a first available chord by ROOT and TYPE found in a first segment or bar (see 37-7 and 37-8 as well as 37-1 to 37-6 and 37-9 to 37 12). All available chords found in the first melody bar are stored in the first and the following addresses of CSTK. Then, a bar-line mark or code is recorded in the next address of CSTK. (37-13). Bar is incremented (37-15), and available chords for the next bar are searched and found one by one, each being recorded in the following addresses of CSTK. When all bars have been tested, an end mark or code is recorded in CSTK (37-14, 37-16).

At this point, CSTK has all available cords (C) for each melody bar in the order of:

| | | | | | |
|---|---|---|---|---|---|
| R(C1,1), | T(C1,1), | ... | R(C1,x), | T(C1,x), | bar-line |
| R(C2,1), | T(C2,1), | ... | R(C1,y), | T(C2,y), | bar-line |
| ... | ... | ... | ... | ... | ... |
| R(Cn,1), | T(Cn,1), | ... | R(Cn,z), | T(Cn,z), | bar-line, |
| end. | | | | | |

end. wherein R=ROOT, T=TYPE, C=Available chord.

Accordingly, CSTK can be regarded as a two dimensional chord array for a melody, having available chords as many as there are for each melody bar.

(Histogram and key)

Figure 38:
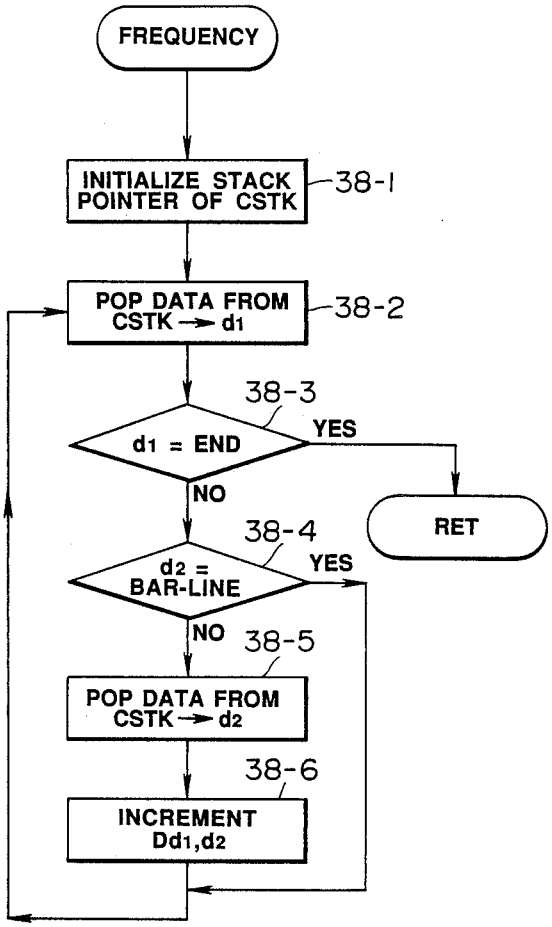
FIG. 38 is a more detailed flowchart of another portion of FIG. 36 for counting a frequency or a number of occurrences of each available chord over the entire length of melody.

FIG. 38 illustrates a detailed flowchart of the block 36-3 in FIG. 36 for producing a frequency table (histogram) of available chords. The table is expressed by $\{D_{ROOT,\ TYPE}\}$. Each element of the table is to store a frequency of an available chord specified by ROOT and TYPE, as measured from the chord array or stack CSTK. In the flow of FIG. 38, the stack CTSK is scanned from the first to the end (38-1, 38-3). Each time an available chord (specified by a root of d1, and a type of d2) is encountered, a corresponding element on the table is incremented (38-2 to 38-6). In this manner, a histogram of available chords are produced on the table $\{D_{ROOT,\ TYPE}\}$.

Figure 39:
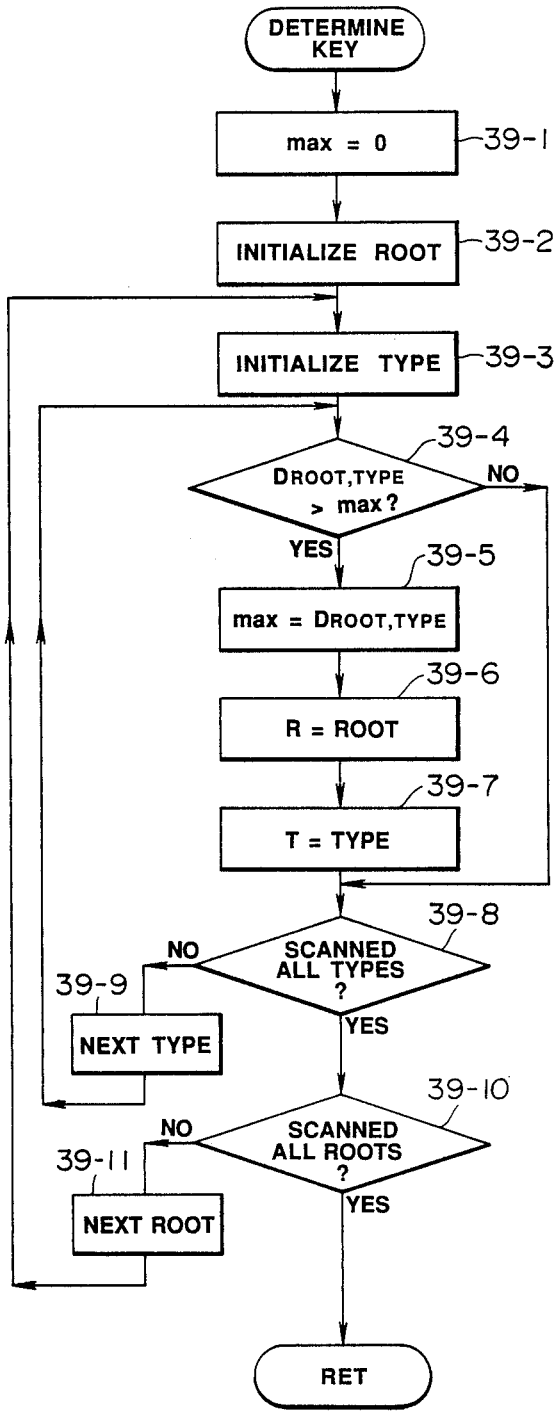
FIG. 39 is a more detailed flowchart of another portion of FIG. 36 for determining a key or tonality of melody according to chord frequencies measured by the flowchart of FIG. 38.

FIG. 39 shows a detailed flowchart of the block 36-4 for determining a tonic or reference chord or a key of melody. The flow of FIG. 39 scans the chord frequency table $\{D_{ROOT, TYPE}\}$ from the first to last elements (see 39-1 to 39-3, 39-8 to 39-11 and associated return paths each for forming a loop). Each time a chord with a higher frequency is encountered, its chord data of ROOT and TYPE are loaded into R and T, respectively (39-4 to 39-7). Thus, at the end of the process, R and T has stored the root and type of an available chord having the highest frequency in the frequency table $\{D_{ROOT, TYPE}\}$. A pair of R and T defines a reference, tonic chord or key of melody.

(Select a chord)

Figure 40:
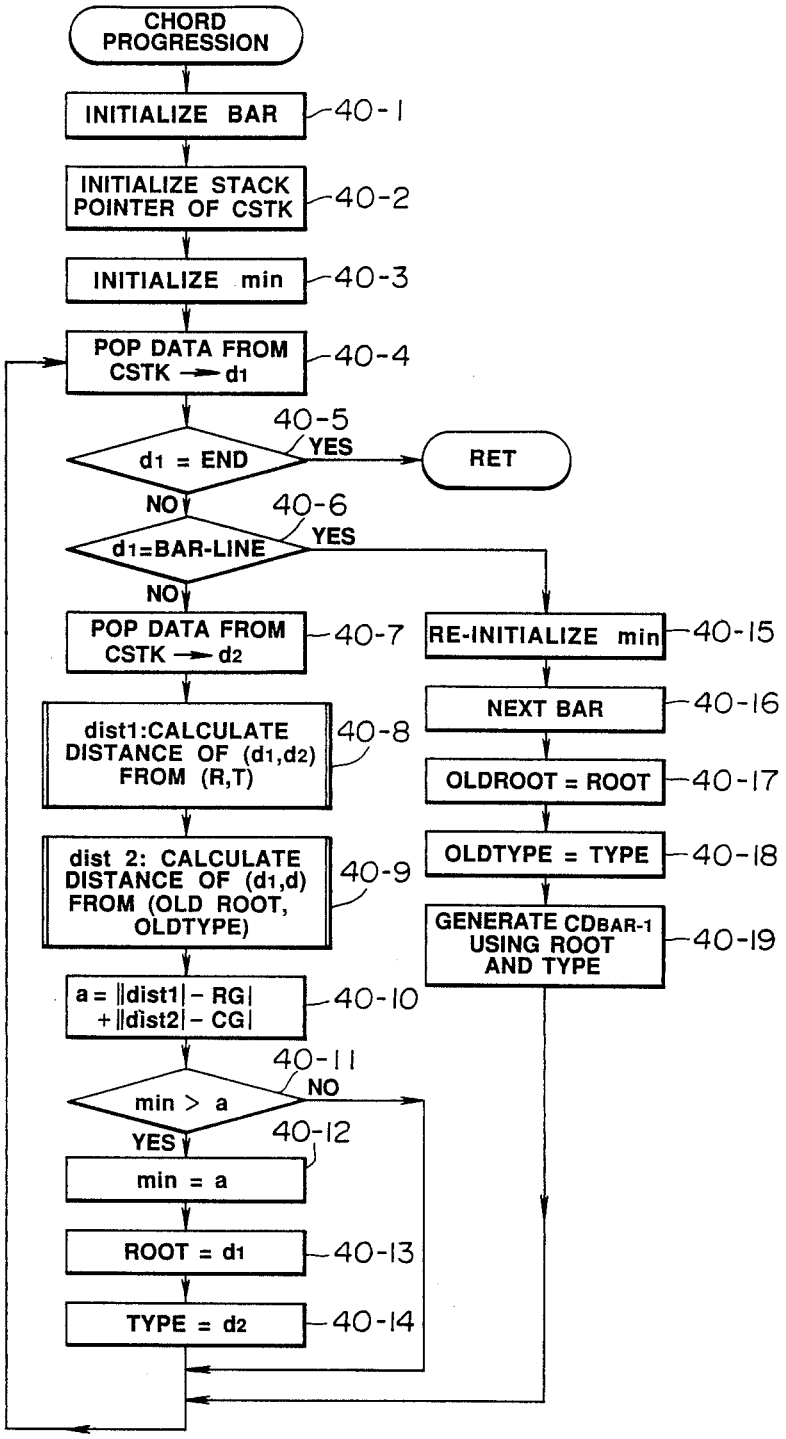
FIG. 40 is a more detailed flowchart of still another portion of FIG. 37 for selecting one of the available chords for each melody bar or segment according to selection criteria associated with tonal distances, thereby to produce a single chord progression or succession over the length of melody.

FIG. 40 shows a detailed flowchart of the block 36-5 in FIG. 36 for selecting a chord for each segment, here, bar of melody.

Two parameters RG and CG are indicated in the illustrated flow of FIG. 40 (see 40-10). These parameters are constraints for a chord selection and may be designated by means of the input unit 3 (FIG. 4). In the alternative, an automatic constraint generator (not shown) may generate constraints RG and CG. In either case, the constraints may typically be fixed over the entire melody but could be varied in the course of melody if desired. The first constraint RG serves to bound a possible tonal harmonic or chordal distance at a relatively high structured level in music. The second constraint CG serves to bound a possible tonal harmonic or chordal distance at a relatively low or immediate level of structure in music. A combination of RG and CG functions to limit a total or composite distance. According to chord selection criteria, a chord with the smallest deviation from the desired composite distance determined by RG and CG is selected. Block 40-10 indicates a version of a deviation by:

$$a = ||\text{dist } 1| - RG| + ||\text{dist } 2| - CG|$$

wherein dist 1 = measured distance of a chord ($d_1$, $d_2$) of interest from a key of melody or a higher level reference or tonic chord in music, and dist 2 = measured distance of a chord ($d_1$, $d_2$) of interest from the chord (OLDROOT: OLDTYPE) immediately preceding that chord of interest. In the formula, dist 1 and dist 2 can be either negative, zero or positive. "Zero" indicates a distance of zero. A negative valued distance may sound unnatural, but it is matter of representation. Drawing an analogy, you sit on a chair among a plurality of chairs arranged in a circle. The chair you sit on has a distance of zero from itself. Now you move to a next chair. If you move to a next chair in a clockwise direction of the circle of chairs, that next chair can be said to have a positive distance of say, "1" from the original chair. In the opposite case (counter-clockwise), the next chair can be said to have a negative distance of "−1".

The absolute value of dist 1, dist 2 is always nonnegative (indicated by |dist 1|, |dist 2|).

For each available chord for a melody bar of interest, a deviation from the desired value limited by RG and CG is computed (40-4 to 4-10). Among all available chords for a melody bar of interest, a chord with the least deviation is selected and recorded (see blocks 40-11 to 40-14 and 40-19). Then, the next bar is selected (40-11) and all available chords for the next bar are read out one at a time from the chord array or stack CSTK and all deviation values are similarly computed and a chord with the least deviation with respect to the bar now under consideration is selected and recorded. The process repeats as many bars as there are by scanning CSTK from the top to the bottom.

At the end of the process, an array $\{CD_{BAR-1}\}$ has recorded a single chord for each bar, thus establishing a single succession of chords in a direction of melody.

Deviation a may be expressed by another evaluation function if desired. For example:

$$a = W_1 \times ||\text{dist } 1| - RG| + W_2 \times ||\text{dist } 2| - CG|$$

where $W_1$ and $W_2$ are weights ($\geqq 0$). If further distances at different levels of tonal-harmonic structure in music are considered, an evaluation function representative of deviation may be given by:

$$a = \sum_{i=1}^{N} W_i \times ||\text{dist}_i| - \text{CONSTRAINTS}_i|$$

where $N \geqq 3$, $W_i \geqq 0$, $\text{CONSTRAINT}_i \geqq 0$.

Turning back to FIG. 40, block 40-8 measures or evaluates a tonal, harmonic or chordal distance of a chord of interest (R, T) from a key of melody, or tonic chord in music, or a global higher leveled reference which has been determined by the block 36-4 in FIG. 36. Block 40-9 measures or evaluates a tonal, harmonic or chordal distance (simply referred to as tonal distance hereinafter) of a chord of interest (R,T) from the chord (OLDROOT, OLDTYPE) immediately preceding that chord of interest, i.e., a local or immediate reference. In FIG. 40, the local reference is a chord (called the old chord) already selected and recorded in the array $\{CD_{BAR-1}\}$ for a melody bar or segment that immediately precedes a melody segment for which a chord is now being selected from available chord(s) including the above-mentioned chord of interest.

(Evaluate a tonal distance)

Figure 41:
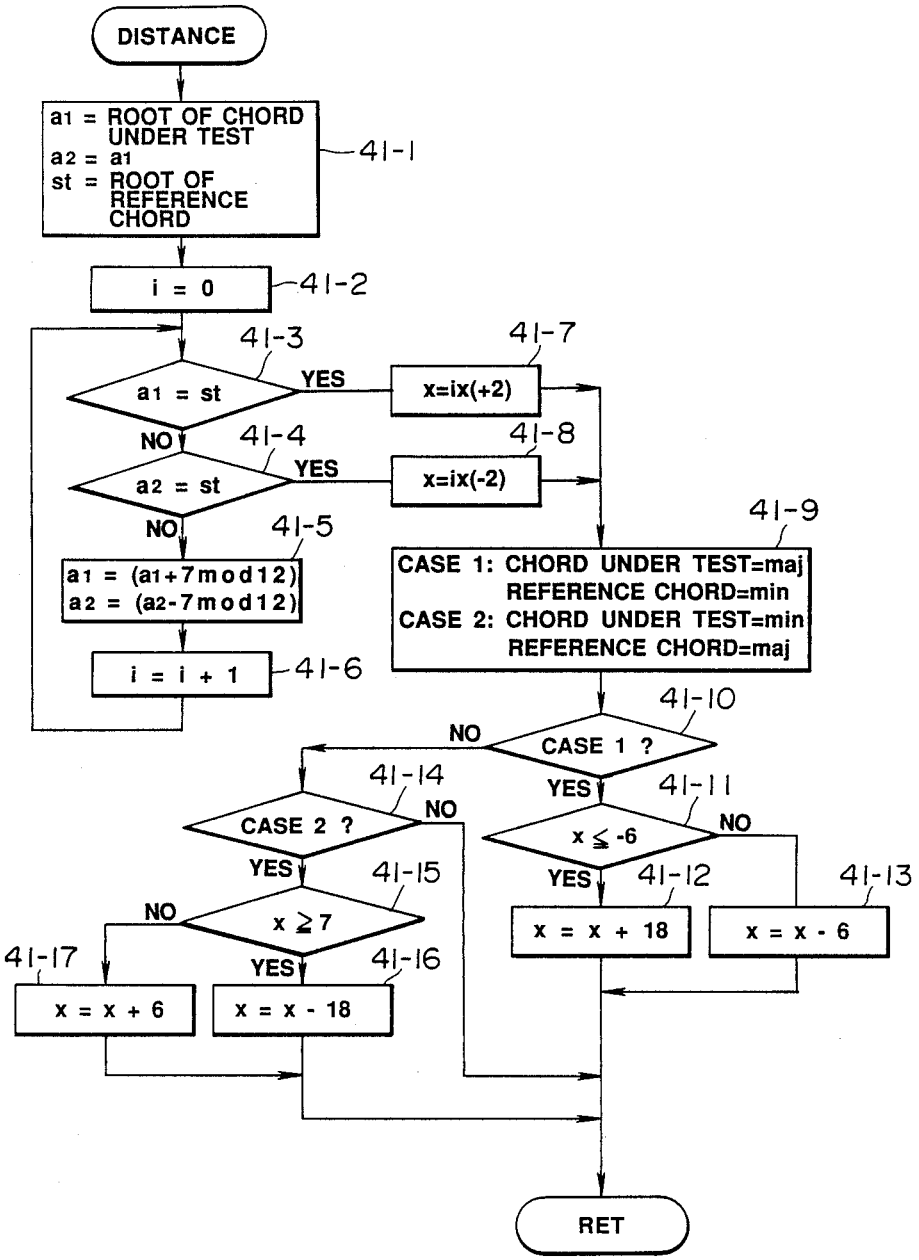
FIG. 41 is a more detailed flowchart of a portion of FIG. 40 for measuring a tonal distance of a chord under test from a reference.
Figure 42:
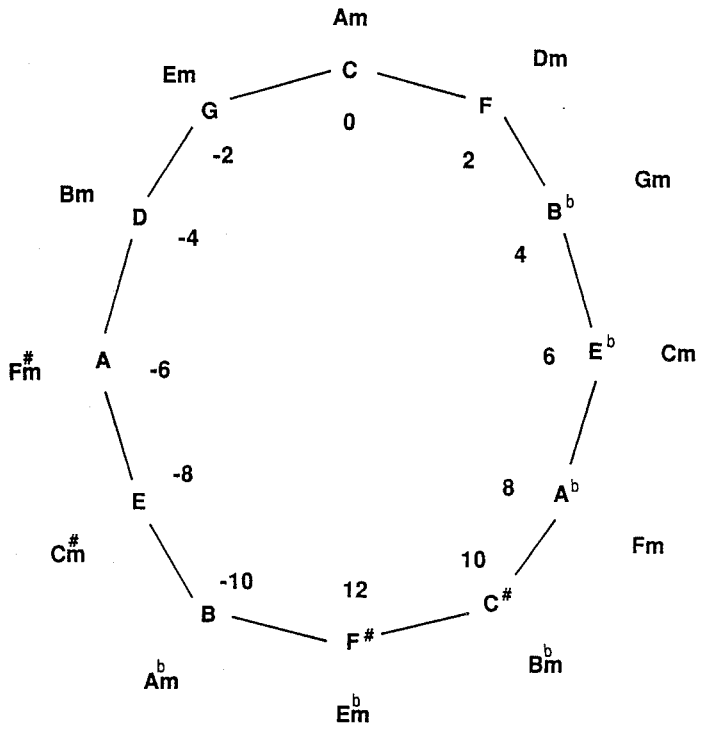
FIG. 42 shows a cycle of fifths used, here, to evaluate a tonal distance between chords.

FIG. 41 shows a detailed flowchart of block 40 8 or 40-9 in FIG. 40 for evaluating or measuring a tonal distance of a chord of interest from a global or local reference as the case may be. FIG. 42 shows a definition of a tonal distance of a chord from a reference. The flow of FIG. 40 is made to evaluate a tonal distance according to the definition in FIG. 42. Since other definitions may be employed to measure a tonal distance, FIG. 42 exemplifies an evaluation of a (natural) tonal distance as a function of an extent of pitches common to the pitch content of a first key or (natural) scale having the first key and that of a second key or (natural) scale having the second key: TD = f(cp1, cp2 . . . , cpn). A natural scale is meant here by either a natural diatonic major scale of do, re, mi, fa, sol, la, si or a natural diatonic minor scal of la, si, do, re, mi, fa, sol. In one of the simplest cases, a natural tonal distance may be evaluated in proportion to a number of pitches or scale degrees uncommon to a pair of natural scales under consideration. The numbers indicated in FIG. 42 accord with this evaluation. These numbers are successive even numbers in a so called cycle of fifths.

A harmonic tonal distance may also be evaluated as a function of an extent of pitches common to the pitch contents of two harmonic scales each comprising either a harmonic diatonic major scale equal to the above-mentioned natural diatonic major scale, or a harmonic diatonic minor scale of la, si, do, re, mi, fa, sol#. In a similar manner, a melodic tonal distance may also be evaluated assuming a melodic diatonic major scale and a melodic diatonic minor scale.

Further, a group crossing (e.g. harmonic to natural) tonal distance may be evaluated between a first scale which may belong to a group of a natural, harmonic and melodic major/minor scale and a second scale which may belong to a group of melodic natural and harmonic major/minor scale. Other scales could be used to evaluate a tonal distance.

A scale is meant here by a musical note scale which is available for a chord. A set of chords may contain those chords having the same alphabetic symbols as corresponding available scales and keys [e.g., Am(Chord)=Am(Scale)=Am(key)]. In this respect, alphabetic symbols shown in FIG. 42 can indicate those chords, those scales and/or those keys. Accordingly, chord of, say, F (major) is said to have a tonal distance of 2 from a reference, here, C (chord, key or scale) and have a tonal distance of 4 from G, 6 from D and, in a reverse direction, −2 from Bb, −4 from Eb etc., and 0 from F itself and Dm. Tonal distance of 12 equals to tonal distance of −12, though not shown because of a normalization: $-10 \leqq TD \leqq 12$.

Turning back to FIG. 41, the illustrated flow evaluates or measures a tonal distance of a chord of interest from a reference which is either a key of melody or higher leveled reference chord (in the case of block 40-8 in FIG. 40) or an immediately preceding chord or local reference chord (in the case of block 40-9).

In block 41-1, the root of a chord of interest is stored in a1 and a2 while the root of a reference chord is stored in st. Every time a loop of blocks 41-3 through 41-6 circulates, the root data of al is rotated upwards by a perfect fifth degree while the root data of a2 is rotated downwards by a perfect fifth degree (41-5). This corresponds to either counterclockwise or clockwise rotation on the ring shown in FIG. 42. In block 41-3, al=st is satisfied when the root data of the chord of interest is rotated upwards by the fifth degree as many times as i, and in block 41-4, a2=st is satisfied by the fifth degree as many times as i. Thus, for the former i x (+2) is placed into x register as a tonal distance (41-7), and for the latter i x (−2) is placed into x (41-8). The process of blocks 41-9 to 41-17 is for converting x depending on whether the reference and chord under consideration are both major chords or both minor chords, or not so. For example, if the reference and the chord of interest are respectively Am and Gmaj, x is x=+4 in 41-7 (from the comparison of the roots A and G). According to FIG. 42, x should be x=−2. In this case, process goes form 41-10 through 41-11 to 41-13, so that x=−2 is obtained from x=x−6. If the reference and the chord of interest are respectively Gmaj and Bmin, x is x=−10 in 41-8. According to the definition of a tonal distance shown in FIG. 42, x should be x=−4. In this case, process goes from 41-10 through 41-15 to 41-17, and x=−4 is obtained from x=x+6.

In this manner, a tonal distance of a chord of interest from a reference is evaluated.

This concludes the detailed description. However, many modifications and variations will be obvious to a person of ordinal skill in the art without departing from the sprit and scope of the invention. For example, the chord selection system in FIG. 3 may be easily modified such that a modified system sorts the available chord array 310 according to priorities in a priority criteria module in place of the selection criteria module 330. For example, such a priority criteria module provides priorities by the magnitude of a measured deviation from the desired tonal distance determined by the first and/or second constraint supplies 360, 370: A chord with the least deviation is given the highest priority and a chord with the second smallest deviation is given the second highest priority and so on. According to the priorities, a sorting module sorts the available chord array 310 or produces a new array having the sorted available chords for each melody segment. The sorted available chord array can be used for presentation to a user by means of any suitable output devices. Therefore, the scope of the invention should be limited only by the appended claims.

What is claimed is:

1. An apparatus for selectively producing an available chord for a melody comprising:

knowledge storage means for storing a musical knowledge of classifying nonharmonic tones in a melody in accordance with an analyzed stream of that melody and an available chord for that melody;

melody supply means for supplying a melody;

chord candidate supply means for supplying a chord candidate;

execution means for executing classification of all nonharmonic tones in said melody from said melody supply means by applying said musical knowledge to an analyzed stream of said melody from said melody supply means based on the assumption that said chord candidate is available for said melody from said melody supply means; and determination means for determining from the classification provided by said execution means as to whether said chord candidate is available for said melody from said melody supply means, thereby to selectively produce an available chord for said melody.

2. The apparatus according to claim 1 wherein said chord candidate supply means comprises:

candidate source means for providing a chord candidate;

preliminary chord test means responsive to said candidate source means and said melody supply means for passing said chord candidate only when said chord candidate matches with a pitch content of said melody and for determining said chord candidate to be unavailable for said melody when said chord candidate mismatches with said pitch content of said melody, and wherein said execution means includes means for receiving said chord candidate that has matched with said pitch content of said melody so that the received chord candidate is used to classify all nonharmonic tones in said melody.

3. The apparatus according to claim 1 further comprising:

scale generator means for generating at least one musical scale in accordance with said chord candidate;

evaluator means for evaluating a relationship between each musical scale from said scale generator means and said melody from said melody supply means;

additional determining means for determining from the relationship evaluated by said evaluator means as to whether said chord candidate is available for said melody from said melody supply means; and means responsive to said determination means and said additional determining means for selectively producing a finally available chord for said melody when each of said determination means and said additional means determines said chord candidate to be available for said melody.

4. The apparatus according to claim 3 wherein said musical scale has a plurality of different scale degrees part of which includes all chord members of said chord candidate and said apparatus further comprising means responsive to said melody supply means for defining a pitch content of said melody and wherein said additional determining means determines said chord candidate to be available for said melody from said melody supply means when said relationship evaluated by said evaluator means indicates that said pitch content of said melody is a subset of said plurality of different degrees of said musical scale.

5. The apparatus according to claim 3 wherein said scale generator means generates a plurality of scales in accordance with said chord candidate.

6. The apparatus according to claim 5 wherein said plurality of said musical scales are three scales each having a plurality of scale degrees containing, as a part, tonic, dominant and subdominant, the first of said three scales having said tonic which corresponds to a root of said chord candidate, the second of said three scales having said dominant which corresponds to said root of said chord candidate, the third of said three scales having said subdominant which corresponds to said root of said chord candidate, said apparatus further comprising means responsive to said melody supply means for defining a pitch content of said melody and wherein said evaluator means comprises means for matching said pitch content of said melody against a pitch content of said plurality of said scale degrees with respect to each of said three scales.

7. The apparatus according to claim 5 wherein each of said plurality of said musical scales has seven scale degrees.

8. The apparatus according to claim 7 wherein each of said plurality of said musical scales is a diatonic scale.

9. The apparatus according to claim 5 wherein each of said plurality of said musical scales has a plurality of different scale degrees part of which includes all members of said chord candidate and said apparatus further comprising means responsive to said melody supply means for defining a pitch content of said melody and wherein said evaluator means comprises matching means for matching said pitch content of said melody against said plurality of different scale degrees with respect to each of said plurality of said musical scales.

10. The apparatus according to claim 5 wherein each scale of said plurality of said musical scales has a plurality of different scales degrees part of which includes all chord members of said chord candidate and said apparatus further comprising means responsive to said melody supply means for defining a pitch content of said melody and wherein said additional determining means determines said chord candidate to be available for said melody from said melody supply means when said relationship evaluated by said evaluator means indicates that said pitch content of said melody is a subset of said plurality of different degrees with respect to one of said plurality of musical scales.

11. The apparatus according to claim 5 wherein said chord candidate is represented by a root and a type, and each of said plurality of said musical scales has a plurality of scale degrees, the first degree of which is a function of said root of said chord candidate, pitch intervals formed among said plurality of said scale degrees being a function of said type of said chord candidate.

12. The apparatus according to claim 5 wherein said plurality of said musical scales are different functions of at least said chord candidate.

13. The apparatus according to claim 3 wherein said chord candidate supply means comprises:

candidate source means for providing a chord candidate;

preliminary chord test means responsive to said candidate source means and said melody supply means for passing said chord candidate only when said chord candidate matches with a pitch content of said melody and for determining said chord candidate to be unavailable for said melody when said chord candidate mismatches with said pitch content of said melody, and wherein said execution means includes means for receiving said chord candidate that has matched with said pitch content of said melody so that the received chord candidate is used to classify all nonharmonic tones in said melody, and wherein said scale generator means includes means for receiving said chord candidate that has matched with said pitch contents of said melody so that the received chord candidate is used to generate at least one musical scale.

14. An apparatus for selectively producing an available chord for a melody comprising:

melody supply means for supplying a melody;

chord candidate supply means for supplying a chord candidate;

knowledge storage means for storing a musical knowledge of classifying nonharmonic tones into an available nonharmonic tone and an unavailable nonharmonic tone in accordance with a stream of a melody;

execution means for executing classification of all nonharmonic tones in said melody from said melody supply means by applying said musical knowledge to a stream of said melody from said melody supply means which is analyzed based on the assumption that said chord candidate is available for said melody from said melody supply means; and determination means for determining from the classification provided by said execution means as to whether said assumption is correct, thereby to selectively produce an available chord for said melody.

15. An apparatus for selectively producing an available chord for a melody comprising:

melody supply means for supplying a melody;

chord candidate supply means for supplying a chord candidate;

knowledge storage means for storing a musical knowledge of classifying nonharmonic tones into an available nonharmonic tone and an unavailable nonharmonic tone in accordance with a stream of a melody;

execution means for executing classification of all nonharmonic tones in said melody from said melody supply means by applying said musical knowledge to a stream of said melody from said melody supply means which is analyzed based on the assumption that said chord candidate is available for said melody from said melody supply means; and determination means for determining from the classification provided by said execution means as to whether said classification indicates that said all non-harmonic tones are available in order to find availability of said chord candidate for said melody from said melody supply means, thereby to selectively produce an available chord for said melody.

16. An apparatus for selectively producing an available chord for a melody comprising:

(A) melody supply means for supplying a melody;

(B) chord candidate supply means for supplying a chord candidate; and (C) analyzer means based on tentative assumption that said chord candidate is an available chord comprising:

(i) separator means for separating all melody notes in said melody from said melody supply means into harmonic-labeled melody notes as many as there are and nonharmonic-labeled melody notes as many as there are by using said tentative assumption;

(ii) melody stream evaluating means responsive to said separator means for evaluating a local melodic situation associated with each of said nonharmonic-labeled melody tones;

(iii) knowledge storage means for storing a network of musical knowledge of classifying nonharmonic tones in a melody;

(iv) exploring means for exploring said network by using said local melodic situation associated with said each of said nonharmonic labeled melody tones for nonharmonic classification thereof; and (v) determination means for determining from said nonharmonic classification as to whether said chord candidate is available for said melody from said melody supply means, thereby to selectively produce an available chord for said melody.

17. An apparatus for selectively producing an available chord for a melody comprising:

knowledge storage means for storing a musical knowledge of classifying nonharmonic tones in a melody in accordance with an analyzed stream of that melody applied thereto, said musical knowledge being arranged to successfully provide a correctly classified result of nonharmonic tones in that melody when said analyzed stream of that melody is based on an available chord for that melody, and to provide an incorrectly classified result of nonharmonic tones in that melody when said analyzed stream of that melody is based on an unavailable chord for that melody, said correctly classified result being distinguishable from said incorrectly classified result;

melody supply means for supplying a melody;

chord candidate supply means for supplying a chord candidate;

execution means for executing classification of nonharmonic tones in said melody from said melody supply means by applying said musical knowledge to an analyzed stream of said melody from said melody supply means based on the assumption that said chord candidate is available for said melody from said melody supply means; and determination means for determining from the classification provided by said execution means as to whether said chord candidate is available for said melody from said melody supply means, thereby to selectively produce an available chord for said melody.

18. An apparatus for selectively producing an available chord for a melody comprising:

knowledge storage means for storing a musical knowledge of classifying melody tones in a melody in accordance with an analyzed stream of that melody applied thereto, said musical knowledge being arranged to successfully provide a correctly classified result of melody tones in that melody when said analyzed stream of that melody is based on an available chord for that melody, and to provide an incorrectly classified result of melody tones in that melody when said analyzed stream of that melody is based on an unavailable chord for that melody, said correctly classified result being distinguishable from said incorrectly classified result;

melody supply means for supplying a melody;

chord candidate supply means for supplying a chord candidate;

execution means for executing classification of melody tones in said melody from said melody supply means by applying said musical knowledge to an analyzed stream of said melody from said melody supply means based on the assumption that said chord candidate is available for said melody from said melody supply means; and determination means for determining from the classification provided by said execution means as to whether said chord candidate is available for said melody from said melody supply means, thereby to selectively produce an available chord for said melody.

19. An apparatus for producing available chords as many as there are for a melody comprising:

knowledge storage means for storing a musical knowledge of classifying nonharmonic tones contained in a melody in accordance with a stream of tones forming that melody and an available chord for that melody;

melody supply means for supplying a melody;

chord candidate supply means for supplying a plurality of different chord candidates;

execution means for executing, with respect to each chord candidate of said plurality of chord candidate from said chord candidate supply means, classification of all nonharmonic tones in said melody from said melody supply means by applying said musical knowledge to a stream of tones forming said melody from said melody supply means based on the assumption that said each chord candidate is available for said melody from said melody supply means; and determination means for determining from the classification by said execution means with respect to said each chord candidate, as to what chord candidates are available for said melody from said melody supply means thereby to produce available chords as many as there are for said melody.

20. The apparatus according to claim 19 wherein said chord candidate supply means comprises:

candidate source means for providing a plurality of chord candidates;

preliminary chord test means responsive to said candidate source means and said melody supply means for passing a first portion of said chord candidates only when each chord candidate in said first portion matches with a pitch content of said melody and for determining each chord candidate in a second portion of said chord candidates to be unavailable for said melody when said each chord candidate in said second portion mismatches with said pitch content of said melody, and wherein said execution means includes means for receiving each chord candidate that has matched with said pitch content of said melody so that each received chord candidate is used to classify all nonharmonic tones in said melody.

21. The apparatus according to claim 19 further comprising:

scale generator means for generating at least one musical scale in accordance with and with respect to each of said chord candidates;

evaluator means for evaluating, with respect to each chord candidate from said chord candidate supply means, a relationship between each musical scale from scale generator means and said melody from said melody supply means;

additional determining means for determining from the relationship evaluated by said evaluator means with respect to said each chord candidate as to which of said chord candidates from said chord candidate supply means are available for said melody supply means; and means responsive to said determination means and said additional determining means for selectively producing finally available chords as many as there are for said melody by selecting chord candidates that have been determined available for said melody by both of said determination means and said additional determining means.

22. The apparatus according to claim 21 wherein said musical scale has a plurality of different scale degrees part of which includes all chord members of a chord candidate from said chord candidates and said apparatus further comprising means responsive to said melody supply means for defining a pitch content of said melody and wherein said additional determining means includes means for determining said chord candidate to be available for said melody from said melody supply means when said relationship evaluated by said evaluator means with respect to said chord candidate indicates that said pitch content of said melody is a subset of said plurality of different degrees of said musical scale.

23. The apparatus according to claim 21 wherein said scale generator means generates a plurality of scales in accordance with said chord candidate.

24. The apparatus according to claim 23 wherein said plurality of said musical scales are three scales each having a plurality of scale degrees containing, as a part, tonic, dominant and subdominant, the first of said three scales having said tonic which corresponds to a root of a chord candidate from said chord candidates, the second of said three scales having said dominant which corresponds to said root of said chord candidate, the third of said three scales having said subdominant which corresponds to said root of said chord candidate, said apparatus further comprising means responsive to said melody supply means for defining a pitch content of said melody and wherein said evaluator means comprises means for matching said pitch content of said melody against a pitch content of said plurality of said scale degrees with respect to each of said three scales.

25. The apparatus according to claim 23 wherein each of said plurality of said musical scales has seven scale degrees.

26. The apparatus according to claim 25 wherein each of said plurality of said musical scales is a diatonic scale.

27. The apparatus according to claim 23 wherein each of said plurality of said musical scales has a plurality of different scale degrees part of which includes all members of a chord candidate from said chord candidates and said apparatus further comprising means responsive to said melody supply means for defining a pitch content of said melody and wherein said evaluator means comprises matching means for matching said pitch content of said melody against said plurality of different scale degrees with respect to each of said plurality of said musical scales.

28. The apparatus according to claim 23 wherein each scale of said musical scales has a plurality of different scale degrees part of which includes all chord members of a chord candidate from said chord candidates and said apparatus further comprising means responsive to said melody supply means for defining a pitch content of said melody and wherein said additional determining means determines said chord candidate to be available for said melody from said melody supply means when said relationship evaluated by said evaluator means with respect to said chord candidate indicates that said pitch content of said melody is a subset of said plurality of different degrees with respect to one of said plurality of said musical scales.

29. The apparatus according to claim 23 wherein each of said chord candidates is represented by a root and a type, and each of said plurality of said musical scale has a plurality of scale degrees, the first degree of which is a function of a root of a chord candidate from chord candidates, pitch intervals formed among said plurality of said scale degrees being a function of a type of said chord candidate.

30. The apparatus according to claim 23 wherein said plurality of said musical scales are different functions of at least a chord candidate from said chord candidates.

31. The apparatus according to claim 21 wherein said chord candidate supply means comprises:

candidate source means for providing a plurality of chord candidates;

preliminary chord test means responsive to said candidate source means and said melody supply means for passing a first position of said chord candidates in which each chord candidate in said first portion matches with a pitch content of said melody and for determining each chord candidate in a second portion of said chord candidates to be unavailable for said melody in which each chord candidate in said second portion mismatches with said pitch content of said melody, and wherein said execution means includes means for receiving at most each chord candidate in said first portion that has matched with said pitch content of said melody so that only each received chord candidate is used to classify all nonharmonic tones in said melody, and wherein said scale generator means includes means for receiving at most each chord candidate in said first portion that has matched with said pitch content of said melody so that only each received chord candidate is used to generate at least one musical scale.

32. The apparatus according to claim 19 wherein said melody supply means includes means for supplying a melody formed by a plurality of melody segments each having a duration during which a chord can last without change thereof, wherein said determination means includes means for producing available chords as many as there are for each melody segment of said plurality of melody segments, and said apparatus further comprising chord succession means for producing a succession of chords for said melody from said melody supply means by selecting a chord per melody segment from said available chords associated with respective melody segments of said melody in accordance with tonal deviations respectively assigned to said available chords associated with said respective melody segments.

33. The apparatus according to claim 32 wherein said chord succession means comprises:

constraint supply means for supplying at least one tonal constraint;

distance measuring means for measuring, with respect to each melody segment of said melody, total distances respectively assigned to one of said available chords for a melody segment which is one of said plurality of melody segments;

deviation evaluation means for evaluating, with respect to said each melody segment of said melody, tonal deviations respectively assigned to one of said available chords for a melody segment which is one of said plurality of melody segments, each deviation being a function of a tonal distance measured by said distance measuring means and assigned to one of said available chords, and said at least one tonal constraint from said constraint supply means; and chord selecting means for selecting, with respect to said each melody segment of said melody, a chord such that the selected chord has been assigned the least tonal deviation among said available chords including said selected chord for a melody segment which is one of said plurality of melody segments whereby a single chord is selected per melody segment so that a succession of chords will be produced for said melody from said melody supply means.

34. The apparatus according to claim 32 wherein said chord succession means comprises:

first constraint supply means for supplying a first tonal constraint;

second constraint supply means for supplying a second tonal constraint;

first distance measuring means for measuring, with respect to each melody segment of said melody, first tonal distances respectively assigned to one of said available chords for a melody segment which is one of said plurality of melody segments;

second distance measuring means for measuring, with respect to said each melody segment of said melody, second tonal distances respectively assigned to one of said available chords for a melody segment which is one of said plurality of melody segments;

deviation evaluating means for evaluating, with respect to said each melody segment of said melody, tonal deviations respectively assigned to one of said available chords for a melody segment which is a respective one of said plurality of melody segments, each deviation being a function of first and second tonal distances measured by said first and second distance measuring means and assigned to one of said available chords, and said first and second tonal constraints from said first and second constraint supply means; and chord selecting means for selecting, with respect to said each melody segment of said melody, a chord such that the selected chord has been assigned the least tonal deviation among said available chords including said selected chord for a melody segment which is one of said plurality of melody segments whereby a single chord is selected per melody segment so that a succession of chords will be produced for said melody from said melody supply means.

35. The apparatus according to claim 34 wherein said first distance measuring means comprises global reference means for evaluating a relatively high-leveled tonal reference indicative of a relatively high-leveled tonal function of said melody from said melody supply means and global distance measuring means for measuring, with respect to said each melody segment of said melody, said first tonal distances respectively assigned to one of said available chords for a melody segment in question which is one of said plurality of melody segments, each of said first tonal distances with respect to said melody segment in question being defined by a distance of one of said available chords for said melody segment in question from said relatively high-leveled tonal reference, and wherein said second distance measuring means comprises local reference means for providing a relatively low-leveled tonal reference indicative a relatively low-leveled tonal function of said melody from said melody supply means and local distance measuring means for measuring, with respect to said each melody segment of said melody, said second tonal distances respectively assigned to one of said available chords for said melody segment in question, each of said second tonal distances with respect to said melody segment in question being defined by a distance of one of said available chords for said melody segment in question from said relatively low-leveled tonal reference which is locally associated with said melody segment in question.

36. An apparatus for producing available chords as many as there are for a melody comprising:

melody supply means for supplying a melody;

chord candidate supply means for supplying a plurality of different chord candidates;

preliminary chord test means responsive to said chord candidate supply means and said melody supply means for passing a portion of said plurality of different chord candidates, said portion defining passed chord candidates;

knowledge storage means for storing a musical knowledge of classifying nonharmonic tones contained in a melody in accordance with a stream of tones forming that melody and an available chord for that melody;

execution means for executing, with respect to each chord candidate of said passed chord candidates from said preliminary chord test means, classification of all nonharmonic tones in said melody from said melody supply means by applying said musical knowledge to a stream of tones forming said melody from said melody supply means based on the assumption that said each chord candidate of said passed chord candidates is available for said melody from said melody supply means; and determination means for determining from the classification by said execution means with respect to said each chord candidate of said passed chord candidates as to what chord candidates are available for said melody from said melody supply means thereby to produce available chords as many as there are for said melody.

37. The apparatus according to claim 36 wherein said preliminary chord test means comprises means for rejecting those chord candidates from said chord candidate supply means which apparently mismatch said melody from said melody supply means whereby the remaining chord candidates define said passed chord candidates.

38. The apparatus according to claim 36 wherein said preliminary chord test means comprises means for deriving a pitch content of said melody from said melody supply means, pitch-matching means for matching each of said plurality of chord candidates from said chord candidate supply means against said pitch content of said melody and for passing those chord candidates each having a degree of matching higher than a preselected threshold level, whereby said preliminary chord test means not only serves to provide a substantial reduction in time required by said execution means for completing said executing for said passed chord candidates only instead of executing for all of said plurality of said chord candidates directly from said chord candidate supply means, but also holds that said determination means is unlikely to miss an available note even though said preliminary chord test means can reject a considerable portion of said plurality of said chord candidates supplied thereto.

39. An apparatus for selectively producing an available chord for a melody comprising:

melody supply means for supplying a melody;

chord candidate supply means for supplying a chord candidate;

scale generator means for generating a musical scale in accordance with said chord candidate;

evaluator means for evaluating a relationship formed between said musical scale from said scale generator means and said melody from said melody supply means; and determining means for determining from the relationship evaluated by said evaluator means as to whether said chord candidate is available for said melody from said melody supply means thereby to selectively produce an available chord for said melody.

40. The apparatus according to claim 39 wherein said musical scale has a plurality of different scale degrees part of which includes all chord members of said chord candidate and said apparatus further comprising means responsive to said melody supply means for defining a pitch content of said melody and wherein said determining means determines said chord candidate to be available for said melody from said melody supply means when said relationship evaluated by said evaluator means indicates that said pitch content of said melody is a subset of said plurality of different degrees of said musical scale.

41. An apparatus for selectively producing an available chord for a melody comprising:

melody supply means for supplying a melody;

chord candidate supply means for supplying a chord candidate;

scale generator means for generating at least one musical scale in accordance with said chord candidate;

evaluator means for evaluating a relationship formed between each of said at least one musical scale from said scale generator means and said melody from said melody supply means; and determining means for determining from the relationship evaluated by said evaluator means as to whether said chord candidate is available for said melody from said melody supply means thereby to selectively produce an available chord for said melody.

42. An apparatus for selectively producing an available chord for a melody comprising:

melody supply means for supplying a melody;

chord candidate supply means for supplying a chord candidate;

scale generator means for generating a plurality of musical scales in accordance with said chord candidate;

evaluator means for evaluating a relationship formed between each of said plurality of musical scales from said scale generator means and said melody from said melody supply means; and determining means for determining from the relationship evaluated by said evaluator means as to whether said chord candidate is available for said melody from said melody supply means thereby to selectively produce an available chord for said melody.

43. The apparatus according to claim 42 herein said plurality of said musical scales are three scales each having a plurality of scale degrees containing, as a part, tonic, dominant and subdominant, the first of said three scales having said tonic which corresponds to a root of said chord candidate, the second of said three scales having said dominant which corresponds to said root of said chord candidate, the third of said three scales having said subdominant which corresponds to said root of said chord candidate, said apparatus further comprising means responsive to said melody supply means for defining a pitch content of said melody and wherein said evaluator means comprises means for matching said pitch content of said melody against a pitch content of said plurality of said scale degrees with respect to each of said three scales.

44. The apparatus according to claim 42 wherein each of said plurality of said musical scales has seven scale degrees.

45. The apparatus according to claim 44 wherein each of said plurality of said musical scales is a diatonic scale.

46. The apparatus according to claim 42 wherein each of said plurality of said musical scales has a plurality of different scale degrees part of which includes all members of said chord candidate and said apparatus further comprising means responsive to said melody supply means for defining a pitch content of said melody and wherein said evaluator means comprises matching means for matching said pitch content of said melody against said plurality of different scale degrees with respect to each of said plurality of said musical scales.

47. The apparatus according to claim 42 wherein each scale of said plurality of said musical scales has a plurality of different scale degrees part of which includes all chord members of said chord candidate and said apparatus further comprising means responsive to said melody supply means for defining a pitch content of said melody and wherein said determining means determines said chord candidate to be available for said melody from said melody supply means when said relationship evaluated by said evaluator means indicates that said pitch content of said melody is a subset of said plurality of different degrees with respect to one of said plurality of said musical scales.

48. The apparatus according to claim 42 wherein said chord candidate is represented by a root and a type, and each of said plurality of said musical scales has a plurality of scale degrees, the first degree of which is a function of said root of said chord candidate, pitch intervals formed among said plurality of said scale degrees being a function of said type of said chord candidate.

49. The apparatus according to claim 42 wherein said plurality of said musical scales are different functions of at least said chord candidate.

50. An apparatus for selectively producing an available chord for a melody comprising:

melody supply means for supplying a melody;

chord candidate supply means for supplying a chord candidate;

scale generator means for generating a variable number of musical scales including one in accordance with said chord candidate;

evaluator means for evaluating a relationship formed between each of said musical scales from said scale generator means and said melody from said melody supply means; and determining means for determining from the relationship evaluated by said evaluator means as to whether said chord candidate is available for said melody from said melody supply means thereby to selectively produce an available chord for said melody.

51. An apparatus for producing available chords as many as there are for a melody comprising:

melody supply means for supplying a melody;

chord candidate supply means for supplying a plurality of different chord candidates;

scale generator means for generating, with respect to each chord candidate of said plurality of chord candidates from said chord candidate supply means, at least one musical scale in accordance with a chord candidate which is a corresponding one of said plurality of said plurality of chord candidates;

evaluator means for evaluating, with respect to said each chord candidate, a relationship formed between each of said at least one musical scale from said scale generator means and said melody from said melody supply means; and determining means for determining from the relationship evaluated by said evaluator means, with respect to said each chord candidate, as to what chord candidates are available for said melody from said melody supply means thereby to produce available chords as many as there are for said melody.

52. An apparatus for producing available chords as many as there are for a melody comprising:

melody supply means for supplying a melody;

chord candidate supply means for supplying a plurality of different chord candidates;

scale generator means for generating, with respect to each chord candidate of said plurality of chord candidates from said chord candidate supply means, a plurality of musical scales in accordance with a chord candidate which is a corresponding one of said plurality of said plurality of chord candidates;

evaluator means for evaluating, with respect to said each chord candidate, a relationship formed between each of said plurality of musical scales from said scale generator means and said melody from said melody supply means; and determining means for determining from the relationship evaluated by said evaluator means, with respect to said each chord candidate, as to what chord candidates are available for said melody from said melody supply means thereby to produce available chords as many as there are for said melody.

53. An apparatus for producing a succession of chords for a melody comprising:

melody supply means for supplying a melody which is dividable into a plurality of melody segments each having a duration during which a chord can last without change thereof;

available chord means for determining and supplying available chords as many as there are for each melody segment of said melody respectively corresponding to one of said plurality of melody segments;

constraint supply means for supplying at least one tonal constraint;

distance measuring means for measuring, with respect to said each melody segment of said melody, total distances respectively assigned to one of said available chords for a melody segment which is one of said plurality of melody segments;

deviation evaluation means for evaluating, with respect to said each melody segment of said melody, tonal deviations respectively assigned to one of said available chords for a melody segment which is one of said plurality of melody segments, each deviation being a function of a tonal distance measured by said distance measuring means and assigned to one of said available chords, and said at least one tonal constraint from said constraint supply means; and chord selecting means for selecting, with respect to said each melody segment of said melody, a chord such that the selected chord has been assigned the least tonal deviation among said available chords including said selected chord for a melody segment which is one of said plurality of melody segments whereby a single chord is selected per melody segment so that a succession of chords will be produced for said melody from said melody supply means.

54. The apparatus according to claim 53 wherein said available chord means comprises:

knowledge storage means for storing a musical knowledge of classifying nonharmonic tones in a melody segment in accordance with an analyzed stream of that melody segment and an available chord for that melody segment; chord candidate supply means for supply at least one chord candidate;

execution means for executing classification of all nonharmonic tones in a melody segment of said melody from said melody supply means by applying said musical knowledge to an analyzed stream of said melody segment of said melody from said melody supply means based on the assumption that a chord candidate from said chord candidate supply means is available for said melody segment of said melody from said melody supply means; and determination means for determining from the classification provided by said execution means as to whether said chord candidate from said chord candidate supply means is available for said melody segment of said melody from said melody supply means, thereby to selectively produce available chords as many as there are for each melody segment of said melody from said melody supply means.

55. The apparatus according to claim 53 wherein said available chord means comprises:

chord candidate supply means for supplying a plurality of different chord candidates;

preliminary chord test means responsive to said chord candidate supply means and said melody supply means for passing a portion of said plurality of different chord candidates, said portion defining passed chord candidates for a melody segment of said melody from said melody supply means;

knowledge storage means for storing a musical knowledge of classifying nonharmonic tones contained in a melody segment in accordance with a stream of tones forming that melody segment and an available chord for that melody segment;

execution means for executing, with respect to each chord candidate of said passed chord candidates from said preliminary chord test means, classification of all nonharmonic tones in said melody segment of said melody from said melody supply means by applying said musical knowledge to a stream of tones forming said melody segment of said melody from said melody supply means based on the assumption that said each chord candidate of said passed chord candidates is available for said melody segment of said melody from said melody supply means; and determination means for determining from the classification by said execution means with respect to said each chord candidate of said passed chord candidates as to what chord candidates are available for said melody segment of said melody from said melody supply means thereby to produce available chords as many as there are for said each melody segment of said melody.

56. The apparatus according to claim 53 wherein said available chord means comprises:

chord candidate supply means for supplying a plurality of different chord candidates;

scale generator means for generating at least one musical scale in accordance with and with respect to each chord candidate from said chord candidate supply means;

evaluator means for evaluating with respect to said each chord candidate a relationship formed between each musical scale from said scale generator means and a melody segment of said melody from said melody supply means; and determining means for determining from the relationship evaluated by said evaluator means with respect to said each chord candidate as to which of said plurality of chord candidates from said chord supply means are available for said melody segment of said melody from said melody supply means thereby to selectively produce available chords as many as there are for said each segment of said melody.

57. The apparatus according to claim 53 wherein said available chord means comprises:

chord candidate supply means for supplying a plurality of different chord candidates;

preliminary chord test means responsive to said chord candidate supply means and said melody supply means for passing a portion of said plurality of different chord candidates, said portion defining passed chord candidates for a melody segment of said melody from said melody supply means;

knowledge storage means for storing a musical knowledge of classifying nonharmonic tones contained in a given melody segment in accordance with a stream of tones forming said given melody and a given chord for said given melody segment;

execution means responsive to said preliminary chord test means for executing, with respect to each passed chord candidate from said preliminary chord test means, classification of all nonharmonic tones in said melody segment of said melody from said melody supply means by applying said musical knowledge to a stream of tones forming said melody segment of said melody from said melody supply means;

first determining means for determining from the classification by said execution means with respect to said each passed chord candidate as to which of said passed chord candidates from said preliminary chord test means are suitable for said melody segment of said melody from said melody supply means, chord candidates determined by said first determining means defining identifiable chord candidates;

scale generator means responsive to said first determining means for generating at least one musical scale in accordance with and with respect to each identifiable chord candidate from said first determining means;

evaluator means for evaluating, with respect to said each identifiable chord candidate, a relationship between said musical scale from said scale generator means and said melody segment of said melody from said melody supply means; and second determining means for determining from the relationship evaluated by said evaluator means with respect to said each identifiable chord candidate as to which of said identifiable chord candidates from said first determining means are available for said melody segment, thereby to selectively produce available chords as many as there are for said each melody segment of said melody from said melody supply means.

58. The apparatus according to claim 53 wherein said available chord means comprises:

chord candidate supply means for supplying a plurality of different chord candidates;

knowledge storage means for storing a musical knowledge of classifying nonharmonic tones contained in a given melody segment in accordance with a stream of tones forming said given melody and a given chord for said given melody segment;

executing means responsive to said chord candidate supply means for executing, with respect to each chord candidate from said chord candidate supply means; classification of all nonharmonic tones in a melody segment of said melody from said melody supply means by applying said musical knowledge to a stream of tones forming said melody segment of said melody from said melody supply means; and determining means for determining from the classification by said executing means with respect to said each chord candidate as to which of said chord candidates from said chord supply means are available for said melody segment of said melody from said melody supply means, thereby to selectively produce available chords as many as there are for said each melody segment of said melody from said melody supply means.

59. The apparatus according to claim 53 wherein said available chord means comprises:

chord candidate supply means for supplying a plurality of different chord candidates;

knowledge storage means for storing a musical knowledge of classifying nonharmonic tones contained in a given melody segment in accordance with a stream of tones forming said given melody and a given chord;

executing means for receiving first supplied chord candidates; for executing with respect to each of said first supplied chord candidates, classification of all nonharmonic tones in a melody segment of said melody from said melody supply means and for outputting chord candidates selected from said first supplied chord candidates, in which, for each outputted chord candidate, said melody segment has been found to contain valid nonharmonic tones;

scale generator means for receiving second supplied chord candidates and for generating at least one musical scale in accordance with and with respect to each of said second supplied chord candidates;

evaluator means for evaluating, with respect to said each of said second supplied chord candidates, a relationship between each musical scale from said scale generator means and said melody segment of said melody from said melody supply means and for outputting chord candidates selected from said second chord candidates, in which each outputted chord candidate is found to bear a predetermined relationship with said melody segments;

coupling means for coupling said chord candidate supply means, said executing means, said scale generator means and said evaluator means for passing of chord candidates; and determining means for determining available chords as many as there are for said melody segment in which said available chords are common to chord candidates outputted from said executing means and chord candidates outputted from said evaluator means.

60. The apparatus according to claim 53 wherein said deviation evaluating means and said chord selection means are combined into chord selection criteria means.

61. An apparatus for producing a succession of chords for a melody comprising:

melody supply means for supplying a melody which is dividable into a plurality of melody segments each having a duration during which a chord can last without change thereof;

available chord means determining and supplying available chords as many as there are for each melody segment of said melody respectively corresponding to one of said plurality of melody segments;

first constraint supply means for supplying a first tonal constraint;

second constraint supply means for supplying a second tonal constraint;

first distance measuring means for measuring, with respect to said each melody segment of said melody, first tonal distances respectively assigned to one of said available chords for a melody segment which is one of said plurality of melody segments;

second distance measuring means for measuring, with respect to said each melody segment of said melody, second tonal distances respectively assigned to one of said available chords for a melody segment which is one of said plurality of melody segments;

deviation evaluating means for evaluating, with respect to said each melody segment of said melody, tonal deviations respectively assigned to one of said available chords for a melody segment which is a respective one of said plurality of melody segments, each deviation being a function of a first and second tonal distances measured by said first and second distance measuring means and assigned to one of said available chords, and said first and second tonal constraints from said first and second constraint supply means; and chord selecting means for selecting, with respect to said each melody segment of said melody, a chord such that the selected chord has been assigned the least tonal deviation among said available chords including said selected chord for a melody segment which is one of said plurality of melody segments whereby a single chord is selected per melody segment so that a succession of chords will be produced for said melody from said melody supply means.

62. The apparatus according to claim 61 wherein said first distance measuring means comprises global reference means for evaluating a relatively high-leveled tonal reference indicative of a relatively high-leveled tonal function of said melody from said melody supply means and global distance measuring means for measuring, with respect to said each melody segment of said melody, said first tonal distances respectively assigned to one of said available chords for a melody segment in question which is one of said plurality of melody segments, each of said first tonal distances with respect to said melody segment in question being defined by a distance of one of said available chords for said melody segment in question from said relatively high-leveled tonal reference, and wherein said second distance measuring means comprises local reference means for providing a relatively low-leveled tonal reference indicative of a relatively low-leveled tonal function of said melody from said melody supply means and local distance measuring means for measuring, with respect to said each melody segment of said melody, said second tonal distances respectively assigned to one of said available chords for said melody segment in question, each of said second tonal distances with respect to said melody segment in question being defined by a distance of one of said available chords for said melody segment in equetion from said relatively low-leveled tonal reference which is locally associated with said melody segment in question.

* * * * *

UNITED STATES PATENT AND TRADEMARK OFFICE

CERTIFICATE OF CORRECTION

PATENT NO. : 4,951,544
DATED : August 28, 1990
INVENTOR(S) : Junichi Minamitaka

It is certified that error appears in the above-identified patent and that said Letters Patent is hereby corrected as shown below:

Title page,
Item [73], Assignee, change "Cadio Computer Co., Ltd.,"
to -- Casio Computer Co., Ltd., --

Signed and Sealed this

Twentieth Day of July, 2004

JON W. DUDAS
*Acting Director of the United States Patent and Trademark Office*